US006003853A

United States Patent [19]

Nakazawa et al.

[11] Patent Number: 6,003,853

[45] **Date of Patent: *Dec. 21, 1999**

[54] SHEET FOLDING APPARATUS

[75] Inventors: Noriaki Nakazawa; Yoshihiko Kitahara; Hideaki Furukawa, all of Yokohama, Japan

[73] Assignee: Canon Aptex Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/777,175

[22] Filed: Dec. 27, 1996

[30] Foreign Application Priority Data

| | | | |
|---|---|---|---|
| Dec. 28, 1995 | [JP] | Japan | 7-343913 |
| Dec. 28, 1995 | [JP] | Japan | 7-343914 |
| Dec. 28, 1995 | [JP] | Japan | 7-343915 |

[51] Int. Cl.[6] ..... B65H 39/02

[52] U.S. Cl. ..... 270/58.11; 270/58.08

[58] Field of Search ..... 270/58.01, 58.07, 270/58.08, 58.11

[56] References Cited

U.S. PATENT DOCUMENTS

| | | | |
|---|---|---|---|
| 4,863,152 | 9/1989 | Milo | 270/47 |
| 5,045,039 | 9/1991 | Bay | 493/1 |
| 5,159,376 | 10/1992 | Ries et al. | 493/445 |
| 5,161,724 | 11/1992 | Radtke et al. | 227/1 |
| 5,169,376 | 12/1992 | Ries et al. | 493/445 |

FOREIGN PATENT DOCUMENTS

| | | |
|---|---|---|
| 0 748 756 A2 | 12/1996 | European Pat. Off. . |
| 0748756 | 12/1996 | European Pat. Off. . |
| 4-333469 | 11/1992 | Japan . |
| 92/12087 | 7/1992 | WIPO . |
| WO 92/12087 | 7/1992 | WIPO . |

*Primary Examiner*—Hoang Nguyen

*Attorney, Agent, or Firm*—Fitzpatrick, Cella, Harper & Scinto

[57] ABSTRACT

A sheet folding apparatus wherein a set of sheets is fed by a pair of rotatable members, and is folded by nip force between the rotatable members, the improvement residing in that a feeding speed of the sheet set by the rotatable member, is changed in accordance with a thickness of the sheet set.

32 Claims, 40 Drawing Sheets

SHEET FOLDING APPARATUS

FIELD OF THE INVENTION AND RELATED ART

The present invention relates to a sheet folding apparatus and an image forming apparatus. More specifically, the present invention relates to a sheet folding apparatus in which a sheet, or a set of sheets, on which an image has been formed by an image forming apparatus, are deposited and folded.

A conventional sheet folding apparatus capable of folding a set of sheets comprises two pairs of rollers, that is, a pre-fold roller pair and a pressure roller pair, and a pusher bar which presses a set of sheets into the nip of the pre-fold roller pair, as disclosed in Japanese Laid-Open Patent Application No. 333,469/1992. In this type of sheet folding apparatus, a set of sheets is pushed into the nip of the pre-fold pair by the pusher bar to pre-fold the set of sheets, and then, the pre-folded set of sheets is pressed by the pressure roller pair.

However, the above described conventional apparatus has following problems because it comprises two sets of roller pairs and its folding speed is fixed.

(1) It is impossible to reduce the apparatus size.

(2) Since the folding speed is fixed regardless of the number of sheets in a set of sheets, the appearance of a set of sheets after binding is liable to be extremely deteriorated as the number of sheets in a set increases.

SUMMARY OF THE INVENTION

Accordingly, the primary object of the present invention is to provide a sheet folding apparatus capable of folding a set of sheets in such a manner that the appearance of the set of sheets after binding turns out to be desirable regardless of the sheet count in the set or the thickness of the set.

According to an aspect of the present invention, there is provided a sheet folding apparatus wherein a set of sheets is fed by a pair of rotatable members, and is folded by nip force between the rotatable members, the improvement residing in that a feeding speed of the sheet set by the rotatable member, is changed in accordance with a thickness of the sheet set.

According to another aspect of the present invention, there is provided a sheet folding apparatus wherein a set of sheets is fed by a pair of rotatable members, and is folded by nip force between the rotatable members, the improvement residing in that the rotatable member is rotated forwardly and backwardly to apply folding force to the sheet set a plurality of times.

According to a further aspect of the present invention, there is provided a sheet folding apparatus comprising: sheet feeding means for feeding sheets; sheet accommodating means for temporarily accommodating the sheets fed one by one by said sheet feeding means; sheet number counting means for counting the number of the sheets accommodated in the sheet accommodating means; binding means for binding the sheets accommodated in said sheet accommodating means; folding means for half-folding the sheet set substantially at a center portion of the sheet set accommodated in the sheet accommodating means; sheet accommodation moving means for moving a sheet accommodating position of the sheet accommodating means relative to said binding means; control means for controlling the sheet accommodation moving means to move the sheet accommodating position, in accordance with an output signal of the sheet count means, to a first predetermined position where a predetermined position of the sheet set corresponds to said binding means or to a second predetermined position where substantially a central portion of the sheet set corresponds to the sheet folding.

According to one aspect, the present invention is characterized in that in a sheet folding apparatus, in which a set of sheets is conveyed through the nip formed by a pair of rollers to fold the set of sheets by the pressure of the nip, the speed at which the set of sheets is conveyed by the pair of rollers is varied in response to the thickness of the set of sheets.

Also, the present invention is characterized in that in a sheet folding apparatus, in which a set of sheets is conveyed through the nip formed by a pair of rollers to fold the set of sheets by the pressure of the nip, the nip pressure is applied to the set of sheets a predetermined number of times by rotating the pair of rollers forward and backward, alternately.

According to an aspect of the present invention, a sheet folding apparatus comprises sheet conveying means for conveying a sheet, sheet holding means for temporarily holding the sheet conveyed one by one by the sheet conveying means, counting means for counting the number of sheets held by the sheet holding means, binding means for binding a set of sheets held in the sheet holding means, folding means for folding the set of sheets held in the sheet holding means, substantially at the center portion of the set of sheets held in the sheet holding means, and sheet holding means moving means for moving the position at which the set of sheets is held by the sheet holding means, toward the binding means, controlling means for controlling the sheet holding means moving means in such a manner that it is moved to a predetermined first position or a predetermined second position, wherein the predetermined first position is a position at which the set of sheets is positioned for the binding means, and the predetermined second position is a position at which the substantial center portion of the set of sheets is positioned for the sheet folding means.

More specifically, with the provision of the above structure, a discharged sheet is counted by the sheet counting means, and then, is held in the sheet holding means. The set of sheets held in the first sheet holding means is folded in half, and is discharged into the second sheet holding means. During this process, the attributes of the sheet conveying means, for example, the conveying speed, is controlled in response to the output signal of the sheet counting means. Therefore, the set of sheets folded in half is conveyed at a proper speed to improve the post-binding appearance of the set of sheets.

Further, the sheet set conveying means also functions as folding means. In other words, the sheet set conveying means folds the set of sheets in half as it conveys the set.

Further, when the sheet count of a set of sheets is no more than two, the sheet set conveying means discharges the set of sheets into the second sheet holding means at a predetermined normal speed, but when the sheet count in a set of sheets is no less than three, the sheet conveying means conveys the set of sheets to be folded in half, at a first speed which is slower than the predetermined normal speed.

Regarding the first speed, a plurality of settings may be provided for the first speed so that a proper sheet conveying speed, that is, a proper sheet folding speed, can be selected according to the sheet count in a set of sheets.

The distance a set of sheets is moved, while being folded, by the sheet set conveying means is measured by sheet set movement measuring means. After the set of sheets is moved by a predetermined distance, the set of sheets is conveyed at a second speed to be discharged into the second sheet holding means. More specifically, after a set of sheets is folded in half at the center portion as it is conveyed at the first speed, it is quickly conveyed at the second speed which is faster than the first speed.

The sheet set conveying means folds a set of sheets as it conveys the set of sheets at the first speed in response to the output signal of the sheet counting means, and after it is detected, based on the output signal of the sheet set movement measuring means, that the set of sheets has been conveyed a predetermined distance, the set of sheets is quickly discharged at the second speed which is faster than the first speed.

With the provision of the above arrangement, a set of sheets can be folded at a speed which matches the sheet count of the set of sheets, and after the set of sheets is folded, that is, after the set of sheets is conveyed a predetermined distance, the folded set of sheets can be discharged at the second speed, the faster speed.

According to the present invention, the sheet conveyance speed of the sheet conveying means can be adjusted to a proper speed matching the sheet count (thickness) of a set of sheets, so that the set of sheets will have desirable appearance after it is bound.

Further, the appearance of the fold can be improved by passing a set of sheets through the nip a plural number of times.

Further, the distance a set of sheets is conveyed as it is folded is measured by the sheet set conveyance distance measuring means, and after the sheet set is conveyed a predetermined distance, the sheet set is conveyed at a higher speed. In other words, after the sheet set is folded, it is conveyed at a faster speed to be discharged. As a result, operational efficiency is improved.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinafter, the preferred embodiments of the present invention will be described with reference to the drawings.

First, referring to FIG. 8, a typical image forming apparatus compatible with a sheet folding apparatus in accordance with the present invention will be described.

Figure 8:
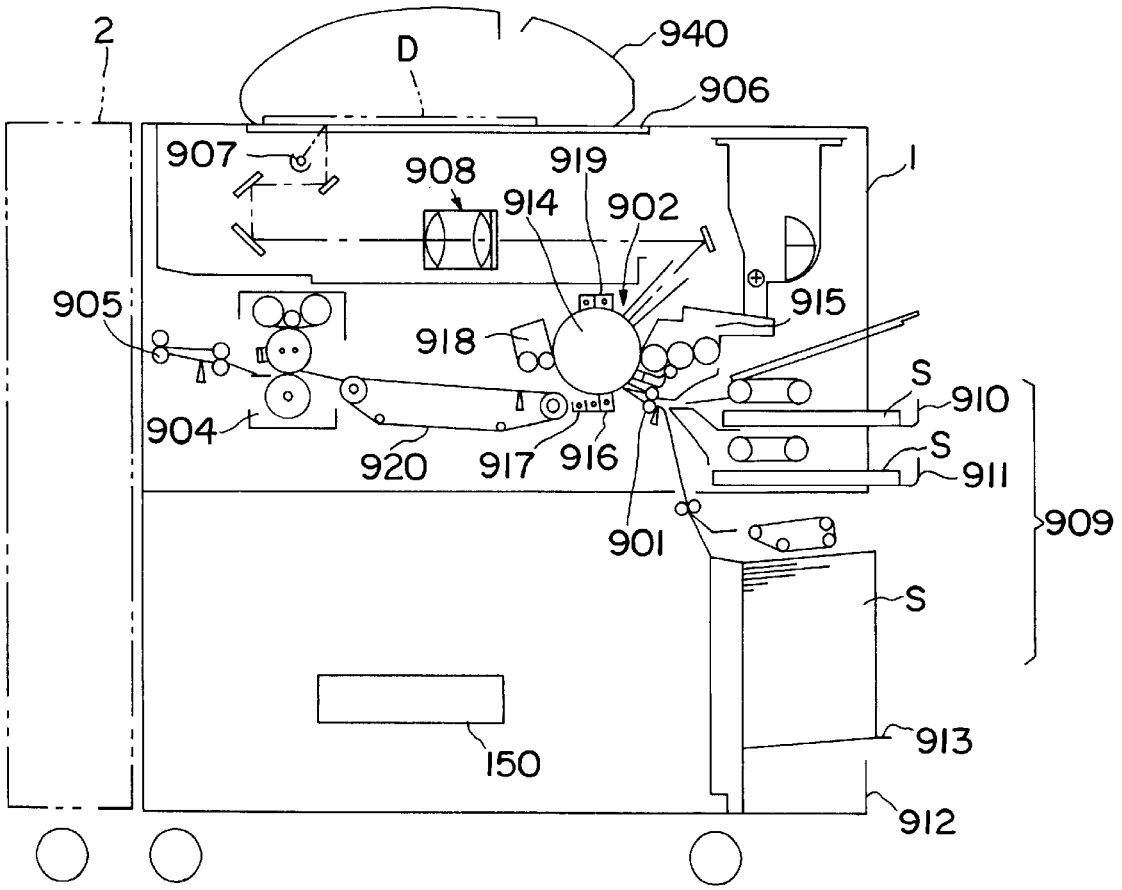
FIG. 8 is a vertical sectional view of an image forming apparatus compatible with the same sheet folding apparatus.

FIG. 8 illustrates the main assembly of a typical image forming apparatus (copy machine) comprising a sheet folding apparatus in accordance with the present invention.

The image forming apparatus main assembly 1 (copy machine main assembly) 1 comprises a platen glass 906 as an original placement table, a light source 907, a lens system 908, a sheet feeding section 909, an image forming section 902, and the like. A reference numeral 940 designates an automatic original feeding apparatus which automatically delivers a sheet of an original D onto the platen glass 906.

The sheet feeding section 909 comprises cassettes 910 and 911, which store recording sheets S and are removably mountable in the apparatus main assembly 900, and a deck 913 disposed on a pedestal 912. The image forming section 902 comprises a cylindrical photosensitive drum 914, as well as a developing device 915, a transfer charger 916, a separation charger 917, a cleaner 918, a primary charger 919, and the like, which are disposed around the photosensitive drum 914. On the downstream side of the image forming section 902, a conveying apparatus, a fixing apparatus, a discharger roller pair 905, and the like, are disposed.

Next, the operation of this image forming apparatus main assembly will be described.

As a sheet feeding signal is outputted from a control section 150 of the apparatus main assembly 900, a sheet S is fed out of either cassette 910 or 911, or the dock 913. Meanwhile, the light which is projected from the power source 907 and reflected by the original D placed on the original placement table 206 is projected by way of the lens system 908, onto the photosensitive drum 914 (image forming section), which will have been charged in advance by the primary charger 919, by this point of the image forming process. As the light is projected onto the photosensitive drum 919, an electrostatic latent image is formed on the photosensitive member 919, and this electrostatic latent image is developed into a toner image by the developing device 915.

The sheet S fed from the sheet feeding section 909 is straightened, if it is skewed, and sent, with correct timing, to the image forming section 902 by the registration roller 901. In the image forming section 902, the toner image on the photosensitive drum 914 is transferred by the transfer charger 916 onto the sheet S having been delivered to the image forming section 902. The sheet S with the transferred toner image is charged by the separation charger 917, to the polarity opposite to that of the transfer charger 916, becoming thereby separated from the photosensitive drum 914.

The sheet S separated from the photosensitive drum 914 is conveyed to the fixing apparatus 904 by the conveying apparatus 920. In the fixing apparatus 904, the transferred image is permanently fixed to the sheet S. The sheet S with the fixed image is discharged from the apparatus main assembly 900 by the discharge roller pair 905.

As described above, on the sheet S fed from the sheet feeding section, an image is formed, and then, the sheet S is discharged from the apparatus main assembly 900 into a sheet folding apparatus 2.

Figure 1:
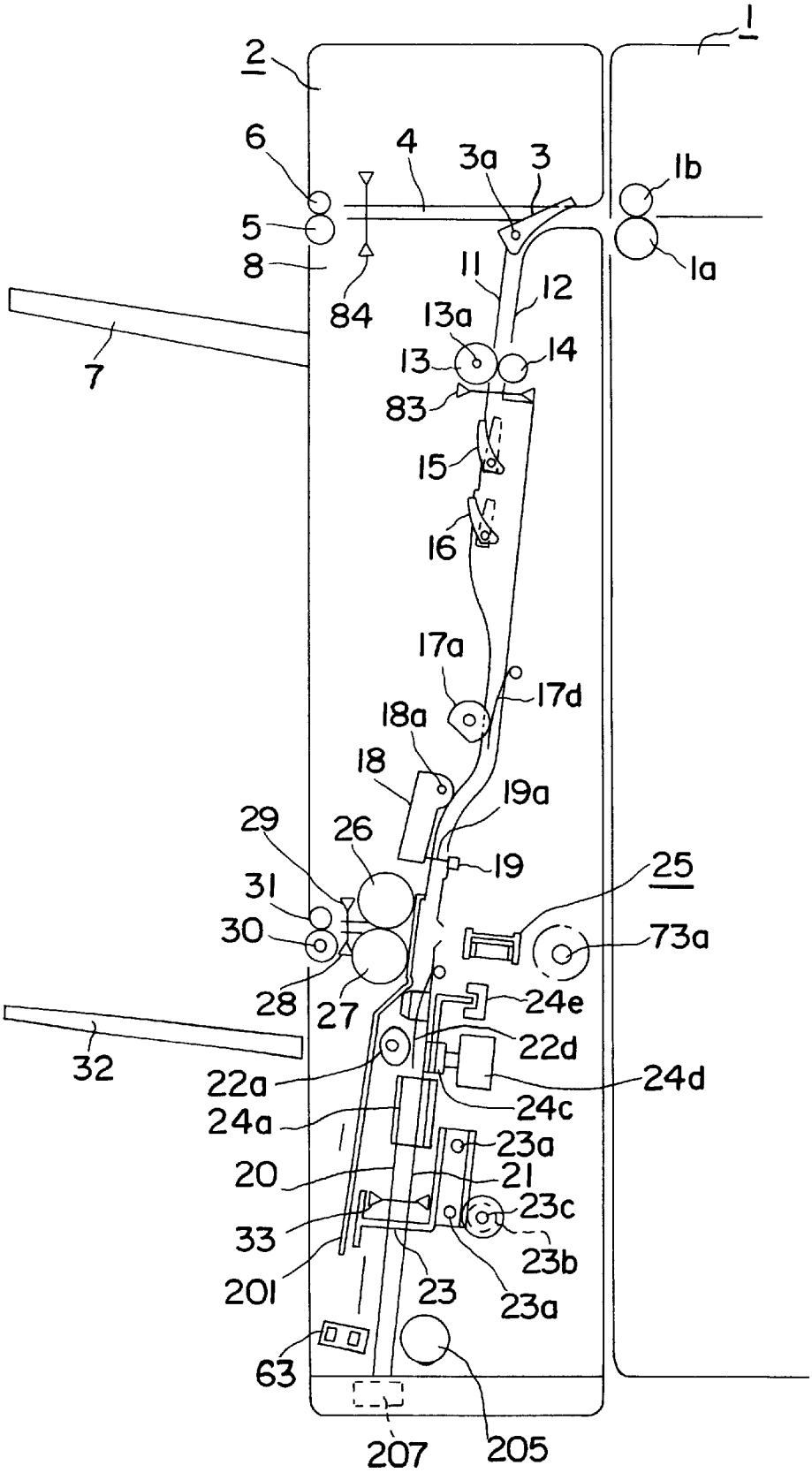
FIG. 1 is a vertical sectional view of a sheet folding apparatus in accordance with the present invention.

FIG. 1 depicts in detail the characteristics of the present invention. In the drawing, a reference numeral 1 designates an image forming apparatus such as a copy machine or a printer.

In FIG. 1, a reference numeral 1*a* designates a sheet discharge roller, and a reference numeral 1*b* also designates a discharge roller which is placed in contact with the sheet discharge roller 1*a* in a manner to maintain a predetermined contact pressure. These two rollers forms a discharge roller pair. A reference numeral 2 designates the sheet folding apparatus in accordance with the present invention, which could be a finishing apparatus.

Figure 2:
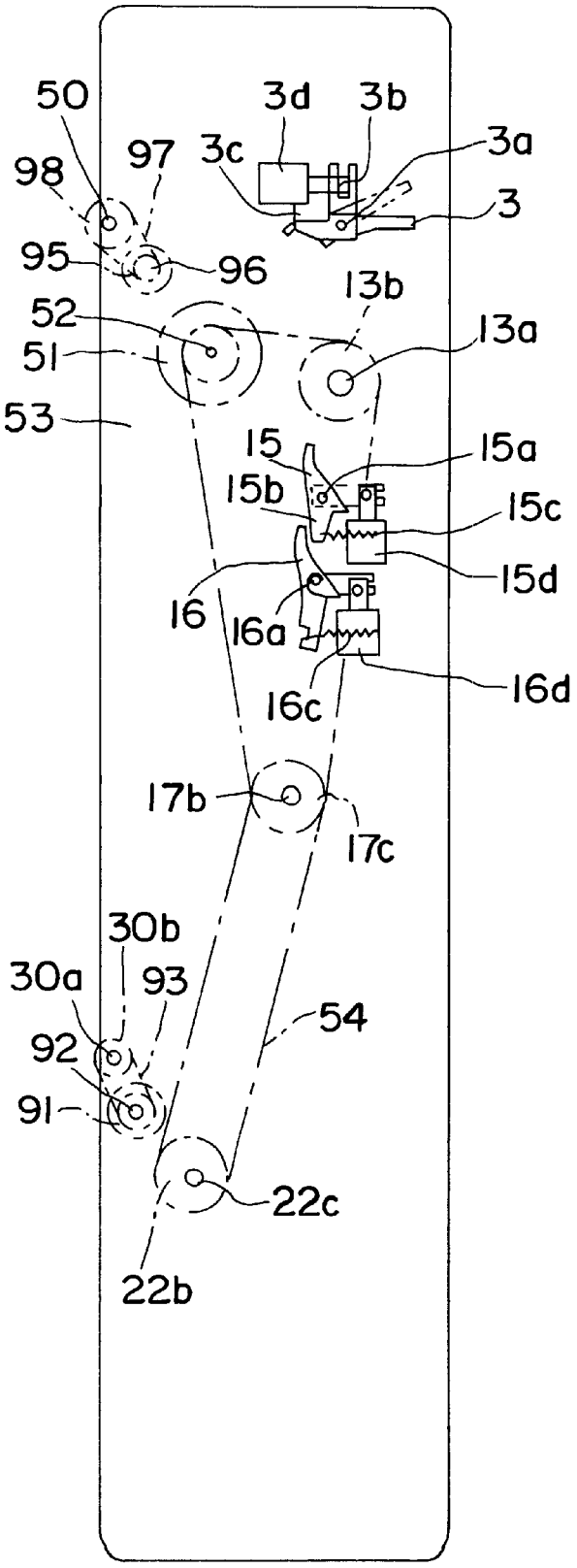
FIG. 2 is a front view of the driving section of the sheet conveying system in the same sheet folding apparatus.

A reference numeral 3 designates an entrance flapper, which is connected to the entrance solenoid 3*d* (FIG. 2). As the solenoid 3*d* is turned on or off, the operating mode of the sheet folding apparatus 7 is switched between a binding (binding) mode and a stacking mode.

[Stacking Mode]

A reference numeral 4 designates a sheet discharge guide. On the downstream side of the sheet discharge guide 4, stacker discharge rollers 5 and 6 are disposed.

A reference numeral 7 designates a stacker tray, in which the sheets discharged by the stacker discharge rollers 5 and 6 are stacked.

[Bookbinding Mode]

Reference numerals 11 and 12 designate guides, respectively, and reference numerals 13 and 14 designate conveyor rollers, respectively, which are kept pressed upon each other. Reference numerals 15 and 16 designate top and bottom path switching flappers, respectively.

Referring to FIG. 2, the path switching flappers 15 and 16 are connected to the top and bottom path switching flapper solenoids 15*d* and 16*d*, respectively, and take a position outlined with a single dot chain line or another position outlined with a solid line as the solenoids 15*d* and 16*d* are turned on or off in response to an electric signal.

Reference numerals 17*a* and 22*a* designate half-moon rollers in the form of a half-moon, respectively, which are placed in contact with elastic members 17*d* and 22*d* in a manner to generate predetermined contact pressures, respectively.

A reference numeral 18 designates a stapler unit which comprises staples joined in the form of a plate, and a driving motor.

The stapler unit 18 is oscillatable about a rotational axis 18*a*.

A reference numeral 19 designates an anvil, which guides the tips of a U-shaped staple so that the leading end portions of the staple are bent toward each other in a manner to form a glass frame-like configuration as the stapler 18 is oscillated about the rotational axis 18*a*.

Reference numerals 20 and 21 designate guides, respectively, which are disposed on the downstream side of the stapler unit 18 (binding means).

A reference numeral 24 designates a cross-shift member, which jogs sheets by coming in contact with the sheets from the direction perpendicular to the sheet conveyance direction (FIG. 2).

Figure 9:
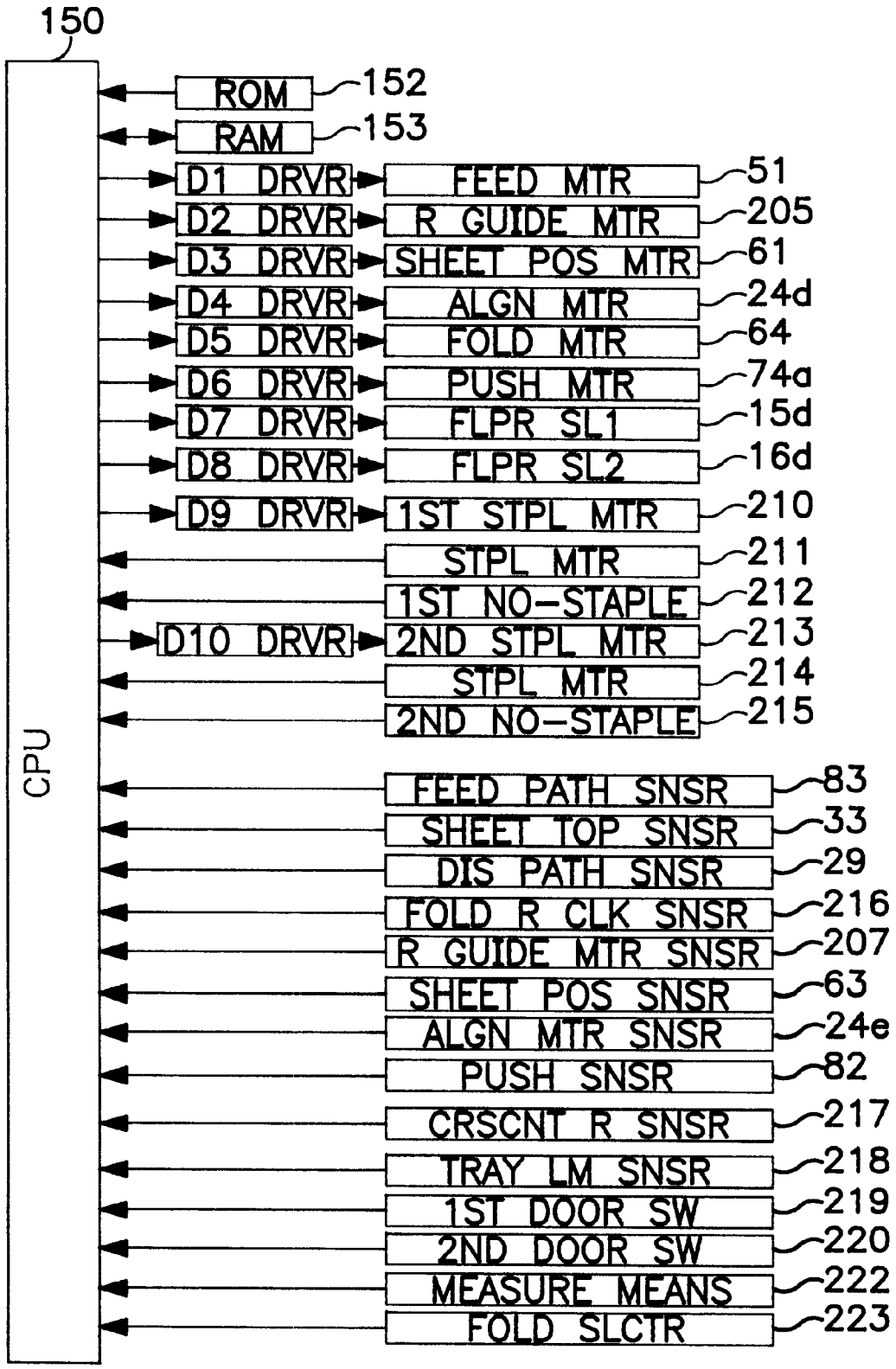
FIG. 9 is a block diagram for controlling the same sheet folding apparatus.

A reference numeral 23 designates a sheet positioning member (first sheet holding means), which comes in contact with the leading end of a sheet as the sheet enters between the guides 20 and 21, and temporarily holds the sheet. The number of sheets held in the sheet positioning member 23 is counted by a sheet counting means CNT 1 disposed within a controlling means 150 (FIG. 9).

The sheet positioning member 23 is movable in the direction of an arrow mark in the drawing.

On the sheet positioning member 23, a sheet edge detection sensor 33 for detecting the sheet edge is disposed.

A reference numeral 25 designates a pusher unit, which remains on standby below the guides 12 and 21 when not folding a set of sheets.

Reference numerals 26 and 27 designate folding rollers (folding means), respectively, as a means for conveying. The folding rollers 26 and 27 are kept pressed upon each other. They are controlled so that when the sheet count of a set of sheets is no more than two, they convey the set of sheets at a predetermined normal speed, but when the sheet count of a set of sheets is no less than three, they convey the set of sheets at a first speed, which is slower than the normal speed.

A reference numeral 28 designates a sheet discharge guide, which guides a set of sheets discharged from the sheet folding rollers 26 and 27, into the nip formed between a discharge rollers 30 and a roller 31.

A reference numeral 29 designates a sheet discharge sensor, which detects the leading and trailing ends of a set of sheets.

A reference numeral 32 designates a delivery tray (second sheet holding means), into which a finished set of sheets is delivered.

Referring to FIG. 2, the driving of the entrance flapper 3, the sheet path switching flapper 15, the sheet path switching flapper 16, the conveyer roller 13, and the half-moon rollers 17*a* and 22*a* will be described in detail.

[Driving Mechanism for Entrance Flapper]

The entrance flapper 3 is oscillatable about the central axis 8*a*, and a link 3*b* is fixed to one end of the central axle 3*a*.

To the link 3*b*, a spring 3*c* is attached to apply pressure in one direction (clockwise direction in FIG. 2) to the flapper. A reference numeral 3*d* designates an entrance solenoid, which is connected to one end of the link 3*b*.

When turned on, the entrance solenoid 3*d* retracts its iron core to flip the flapper 3 in the upward direction, switching thereby the operational mode of the apparatus to a binding mode. While the entrance solenoid 3*d* is off, the apparatus is in a stacking mode.

[Conveyor Roller, and Driving Mechanism for Half-moon Roller]

To the central axle 13*a* of the conveyer roller 13, a conveyer pulley 13*b* (FIG. 2) is fixed, and to the central axes 17*b* and 22*b* of the half-moon rollers 17*a* and 22*a*, half-moon pulleys 17*c* and 22*c* are fixed, respectively.

A reference numeral 51 designates a conveyer motor, and to its output shaft, a conveyer motor pulley 52 is fixed.

Around the peripheral surfaces of the conveyer motor pulley 53, conveyer pulley 13*b* and half-moon roller pulley 17*c*, a timing belt 53 is wrapped, and further, around the half-moon roller pulleys 17*c* and 22*c*, a timing belt 54 is wrapped.

The rotation of the conveyer motor 51 is transmitted to the timing belt 53 by way of the conveyer motor pulley 52, rotating thereby the conveyer pulley 13*b* and half-moon roller pulley 17*c*, and is further transmitted to rotate the half-moon roller pulley 22*c* by way of the timing belt 54, rotating thereby the conveyer roller 13, and half-moon rollers 17*a* and 22*a*.

[Driving Mechanism for Sheet Path Switching Flapper]

To the rotational center axes 15*a* and 16*a* of the sheet path switching flappers 15 and 16, flapper links 15*b* and 16*b* are fixed, respectively. One end of the flapper link 15*b* is connected to a sheet path switching solenoid 15*d*, and one end of the flapper link 16*b* is connected to a sheet path switching solenoid 16*d*.

The other ends of the flapper links 15*b* and 16*b* are connected to springs 15*c* and 16*c* to hold the sheet path switching flappers 15 and 16 to the illustrated positions, respectively.

When turned on, the sheet path switching solenoids 15*d* and 16*d* retract their iron cores to flip the sheet path switching flappers 15 and 16 to the positions illustrated by a single dot chain line in FIG. 1, and hold them there.

[Cross-Shifting Mechanism]

Figure 3:
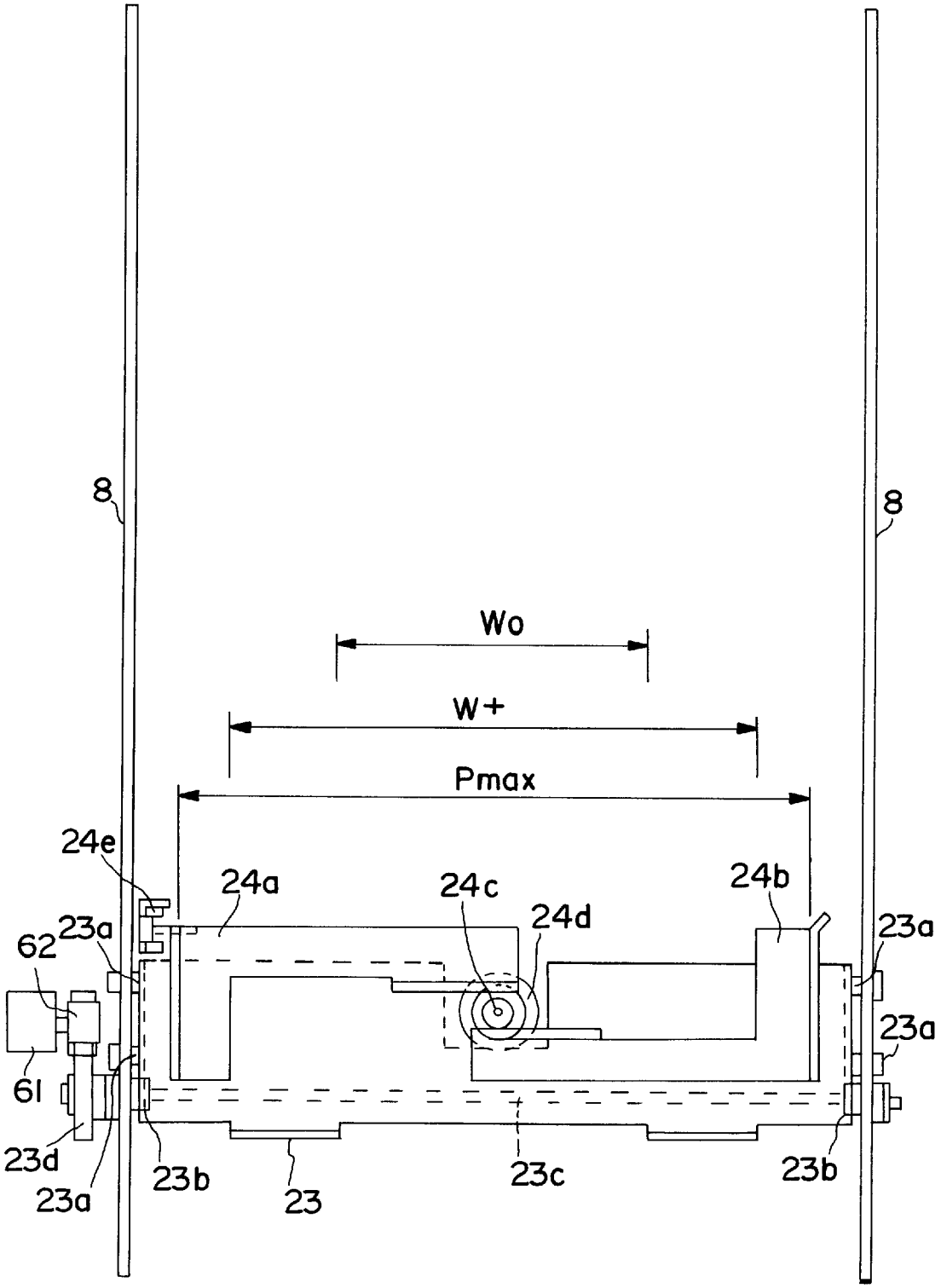
FIG. 3 is a front view of the cross-shift section and sheet positioning member of the same sheet folding apparatus.

Referring to FIG. 3, a cross-shift mechanism will be described.

Reference numerals 24*a* and 24*b* designate cross-shift members disposed in the front and in the rear, respectively. Their bottom wells are parallel with the sheet conveyance direction. Their outward ends are provided with a lateral wall perpendicular to the bottom walls, and their inward ends are provided with a rack portion, which is engaged with a pinion gear 24*c*.

A reference numeral 24*d* designates a cross-shift motor constituted of a stepping motor, and to its output shaft, the pinion gear 24*c* is fixed.

A reference numeral 24*e* designates a cross-shift home position sensor constituted of a photointerruptor.

The cross-shift home position sensor 24*e* is disposed in such a manner that it detects a flag formed as a part of the cross-shift member 24*a*, when the cross-shift members 24*a* and 24*b* are positioned 5 mm to 10 mm outward of the edge of a sheet of the largest size which can be jogged by the cross-shift members 24*a* and 24*b*.

[Driving Mechanism for Sheet Positioning Member]

Referring to FIGS. 1 and 3, the driving mechanism for the sheet positioning member will be described.

A reference numeral 23 designates a sheet positioning plate as a stopper, which comes in contact with the leading end of a sheet as the sheet is advanced between the guides 20 and 21. Both ends of the sheet positioning member 23 are provided with a plurality of rollers 23*a* which are allowed to rotate freely. The rollers 23 are fitted in the grooves formed in a frame 8, so that the sheet positioning member 23 can be moved along the frame 8.

Also, both ends of the sheet positioning member 23 are provided with a rack which is engaged with a pinion gear 23*b*.

The force for driving the pinion gear 23*b* on the right-hand side and the pinion gear 23*b* on the left-hand side is transmitted through an axis 23*c* on which both pinion gears 23*b* are mounted.

To one end of the axle 23*c*, a sheet jogging gear 23*d* is fixed. A reference numeral 61 designates a sheet positioning motor (first means for holding sheets and moving them) which moves the sheet positioning member 23 to a first predetermined position (position at which the center portion of a set of sheets is aligned with the stapler 18), or to a second predetermined position (position at which the center portion of a set of sheets is aligned with the folding rollers 26 and 27). The sheet positioning motor 61 is constituted of a stepping motor. To the output shaft of the sheet positioning motor 61, a gear 62 is fixed, and this gear 62 is engaged with the sheet jogging (stopper) gear 23*d*.

The sheet positioning member 23 is provided with a flag, which is detected by the sheet positioning member home position sensor 63 when the sheet positioning member 23 arrives at its home position.

A reference numeral 33 designates a sensor for detecting the leading end of a sheet, which detects the arrival of a sheet at the stopper.

[Driving Mechanism for Roller Guide]

Figure 6:
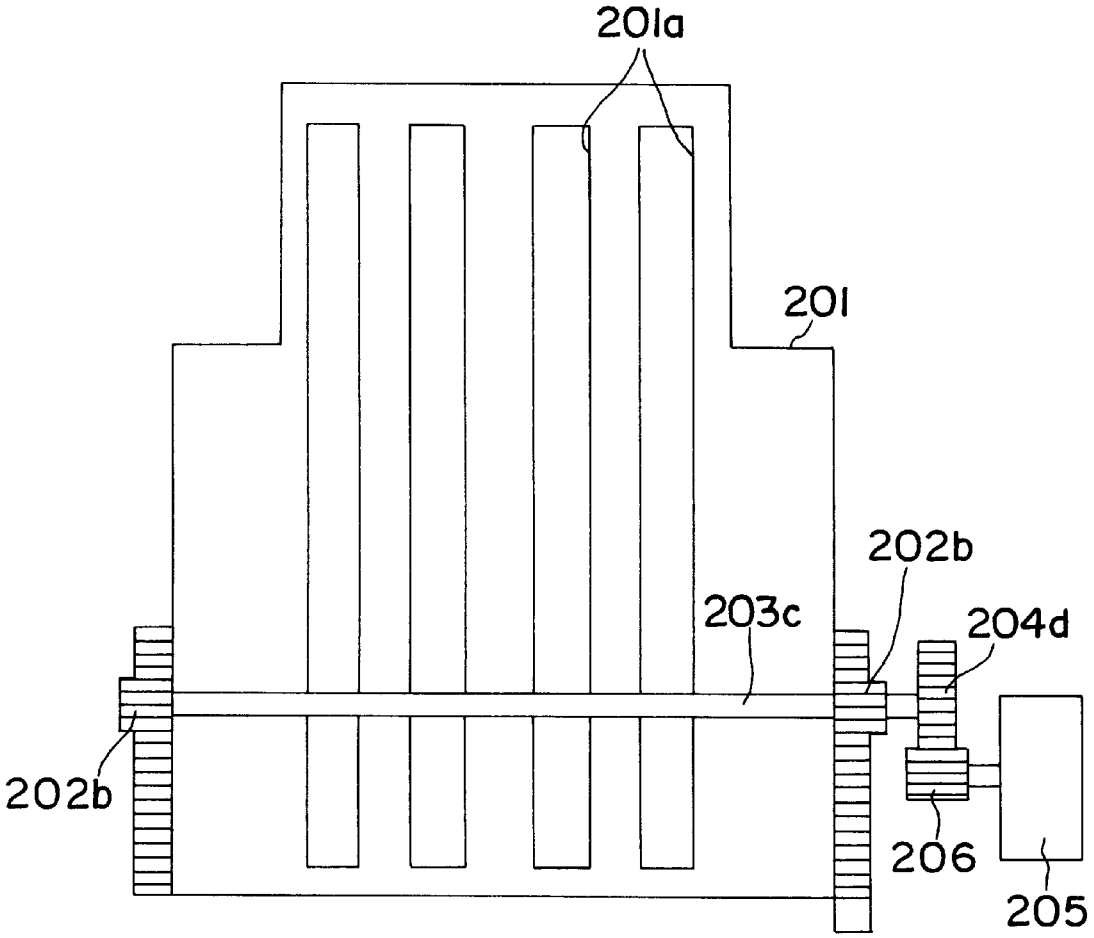
FIG. 6 is a front view of the roller guide section of the same sheet folding apparatus.

Referring to FIG. 6, the driving mechanism for the roller guide will be described.

A reference numeral 201 designates a roller guide, which prevents a sheet, which is being advanced between the guides 20 and 21, from entering the conveyance path leading to the folding rollers 26 and 27 (FIG. 1). The roller guide 201 is in the form of a plate, and is provided with a plurality of elongated holes 201*a* so that it does not interfere with the half-moon roller 22*a* and sheet positioning member 23.

Both lateral ends of the roller guide 201 are provided with a rack, which is engaged with a pinion gear 202*b*.

The force for driving the pinion gear 202*b* on the right-hand side and the pinion gear 202*b* on the left-hand side is transmitted through an axis 203*c* on which both gears are attached.

To one end of the axis 203*c*, a roller guide gear 203*d* is fixed. A reference numeral 205 designates a roller guide motor constituted of a stepping motor.

To the output shaft of the roller guide motor 205, a gear 206 is fixed, and the gear 206 is engaged with the roller guide 201.

A part of the roller guide 201 forms a flag, which is detected by a roller guide home position sensor 207 when the roller guide arrives at its home position.

[Driving Mechanism for Folding Means]

Figure 4:
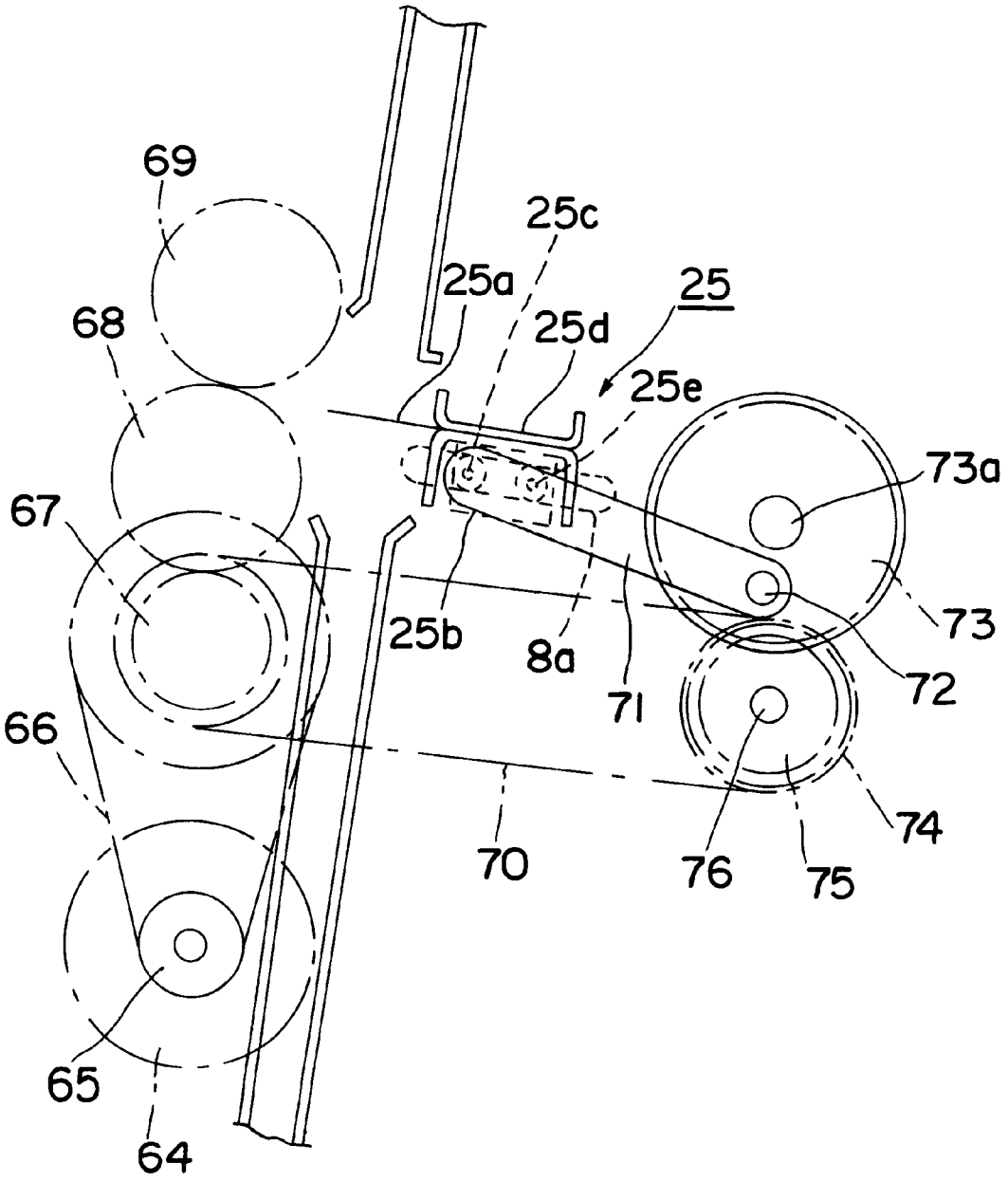
FIG. 4 is a front view of the pusher unit and fold roller section of the same sheet folding apparatus.
Figure 5:
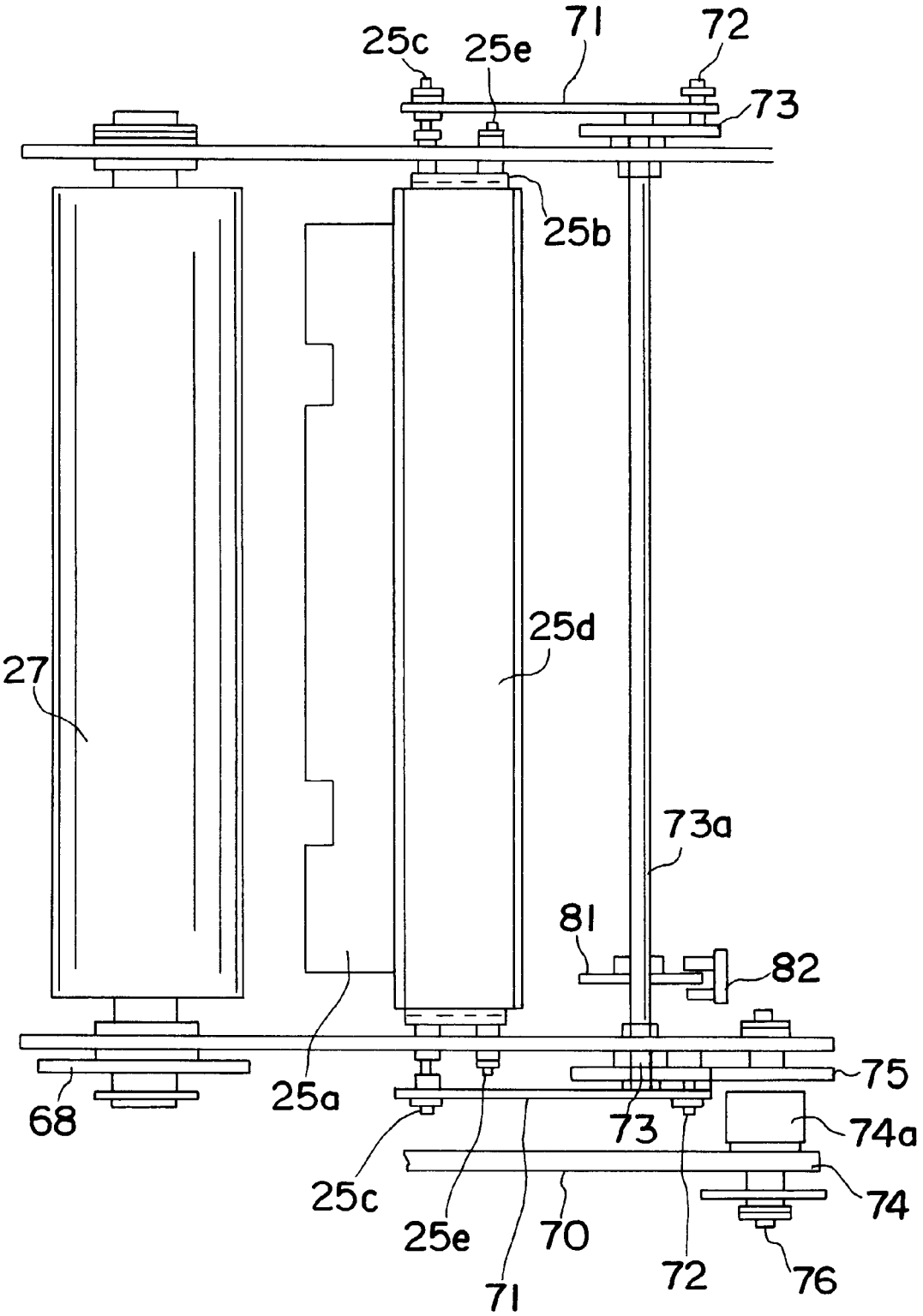
FIG. 5 is a front view of the pusher unit and fold roller section of the same sheet folding apparatus.

Referring to FIGS. 4 and 5, the driving mechanism for a folding means will be described.

A reference numeral 64 designates a folding motor, and to its output shaft, a pulley 65 is fixed.

A reference numeral 67 designates an idler gear pulley constituted of two pulleys and a gear disposed between the two pulleys. Wrapped around one of the two pulleys and the pulley 65 is a timing belt 66.

Reference numerals 68 and 69 designate folding gears, which are fixed to the folding rollers 26 and 27, respectively, and are meshed with each other.

The folding gear 68 is also meshed with the gear portion of the idler gear pulley 67.

A reference numeral 25 designates a pusher unit.

A reference numeral 25*a* designates a pusher plate. Since it must be moved right next to the nip between the folding rollers 26 and 27, it is formed of stainless steel plate or the like having a thickness of approximately 0.5 mm.

The pusher plate 25*a* is held by holders 25*d* and 25*b*. To the holder 25*b*, axes 25*c* and 25*e* are fixed. On the axle 25*c* and 25*e*, a roller is rotatively mounted. The roller is fitted in a groove 8*a* formed in the frame 8, being allowed to freely move along the frame 8.

A reference numeral 73 designates a gear having an axle on one of the lateral surfaces. This gear 73 is meshed with an idler gear 75.

The idler gear 75 is fixed to an axle 76. On this axis 76, a folding clutch 74*a* (pusher clutch) constituted of an electromagnetic clutch is mounted. The transmission of the rotation of the pulley 74 on the folding clutch 74*a* to the axle 76 is controlled by tuning on or off the folding clutch 74*a*.

On the peripheral surface of the pulley 74, a timing belt 70 is wrapped around, and the other end of the timing belt 70 is wrapped around the pulley portion of the idler gear pulley 67.

The gear 75 fixed to the axle 76 is meshed with the gear 73 fixed to an axle 73*a*, and to the axle 73*a*, a flag 81 with a notch is fixed.

Positioned to detect the notch of the flag 81 is a pusher plate home position sensor 82, wherein it detects the notch of the flag 81 when the retracted pusher plate 25*a* is farthest away from the sheet conveyance path formed by the guides 12 and 21.

The rotation of the folding motor 64 is transmitted to the idler gear pulley 67 by way of the pulley 65 and the timing belt 68.

The rotation of the idler gear pulley 67 is transmitted to the folding gear 69 through the folding gear 68, to drive the folding rollers 26 and 27.

On the other hand, the rotation of the idler gear pulley 67 is transmitted to the pulley 74 on the folding clutch 74*a* through the timing belt 70.

As the folding clutch 74*a* is turned on or off, the rotation of the pulley 74 is transmitted to the axle 76, rotating the idler gear 75. Then, the gear 73 is rotated by the rotation of the idler gear 75. Consequently, the axle 72 is moved in circular motion about the axis 73*a*.

A link 71 connected to the axle 72 by one end is connected to the axis 25*c* by the other end. Since the axis 25*c* is fixed to the pusher unit 25, and the rollers attached to the axes 25*c* are fitted in the groove 8*a* of the frame 8, the axle 25*c* is linearly moved along the groove 8*a*. As a result, the pusher plate 25*a* of the pusher unit 25 is also linearly moved between a pushing position and a home position.

[Driving Mechanism for Stacking Discharge Roller]

Referring to FIG. 2, the driving mechanism for a stacking discharge roller 5 will be described.

The top portion of the sheet folding apparatus 2 is provided with an axle 5*a* to which the stacking discharge roller 5 is fixed. On this axle 5*a*, a pulley 98 is mounted.

A reference numeral 95 designates a stacking discharge roller motor 95, and to its output shaft, a pulley 96 is fixed.

Wrapped around the pulleys 96 and 98 is a timing belt 97, and the rotation of the stacking discharge roller motor 95 is transmitted to the pulley 98 by way of the pulley 96 and timing belt 97, and then drives the stacking discharge roller 5 through the axle 5*a*.

The stacking discharge roller motor 95 is constituted of a stepping motor. The peripheral velocity of the stack discharge roller motor 95 is rendered greater than that of the discharge roller 1*a*.

The sheet gripping force of the discharge roller 1*a* is rendered greater than that of the pair of stacking discharge rollers 5 and 6. Therefore, while a sheet is being conveyed by being pinched between the discharge rollers 1*a* and 1*b*, the pair of stacking discharge rollers 5 and 6 keep on slipping on the sheet, failing to convey the sheet, but as the trailing end of the sheet comes out of the nip between the discharge rollers 1*a* and 1*b*, they regain their grip on the sheet and conveys the sheet.

FIG. 9 is a block diagram for controlling the sheet folding apparatus in this embodiment.

A reference numeral 150 designates a central processing unit (hereinafter, CPU). The I/Os are described with reference to this CPU.

Connected to the input side of the CPU 150 are: an entrance sensor 83 which is a means for detecting that a copy sheet discharged from the image forming apparatus 1 has advanced into the post-image formation processing apparatus (sheet folding apparatus); a leading edge detection sensor 33 which signals to the CPU 150 the arrival of a sheet at a predetermined location in the sheet folding apparatus 2; a discharged sheet sensor 29 which detects that a sheet has been discharged into the delivery tray 32; a folding roller clock sensor 216 which sends to the CPU 150 information for controlling the folding rollers 26 and 27; a roller guide home position sensor which detects the arrival of the roller guide 201 at its home position; a sheet positioning plate home position sensor 63 which detects the arrival of the sheet positioning plate 23 at its home position; a jogging plate home position sensor 24*e* which detects the arrival of the jogging plate 24 at its home position; a pusher plate position sensor 82 which detects the position of the pusher plate 25*a*; a half-moon roller position sensor which detects the rotational positions of the half-moon rollers 17*a* and 22*a*; a tray capacity limit sensor 218 which detects the overloading of a tray; a first door switch 219 which detects the opening or closing of a door for dealing with a paper jam; a second door switch 220 which detects the opening or closing of a door for staple exchange or the like operation; a first out-of-staple condition sensor 212 which detects presence or absence of staples in a first stapling unit; a first stapler motor position sensor 211 which detects the arrival of the stapling section at its on-standby position; a second out-of-staple condition sensor 215 which detects presence or absence of staples in a second stapling unit; and a second stapler motor home position sensor 214 which detects the arrival of the stapling section at its on-standby position.

Also connected to the input side of the CPU 150 are a means 222 for measuring the distance a set of sheets is moved by the sheet positioning member 23, and a means 223 for selecting a sheet folding mode among various sheet folding modes (single pass fold mode, twice-fold mode, and so on).

On the other hand, connected to the output side of the CPU 150 are: a conveyer motor 51 controlled through a driver D1 in a manner to convey copy sheets in the sheet folding apparatus; a roller guide motor 205 controlled through a driver D2 in a manner to move the roller guide plate so that the copy sheets in the sheet folding apparatus are guided from the folding roller; a sheet positioning motor 61 controlled through a driver D3 in a manner to hold the copy sheets in the sheet folding apparatus at a designated position; a jogging motor 24*d* controlled through a driver D4 in a manner to jog the copy sheets in the sheet folding apparatus; a pusher motor 64 controlled through a driver D5 in a manner to push and fold the set of sheets in the sheet folding apparatus; a folding clutch 74*a* controlled through a driver D6 in a manner to project the pusher plate 25*a*; a solenoid 15*a* controlled through a driver D7 in a manner to flip the flapper 15 which switches the sheet conveyance path in the sheet folding apparatus; a solenoid 16*d* controlled through a driver 8 in a manner to flip the flapper 16 which also switches the sheet conveyance path in the sheet folding apparatus; a first stapler motor 210 controlled through a driver D9 in a manner to drive the first stapling section 18 for binding the set of sheets; and a second stapler motor 213 controlled through a driver 10 in a manner to drive the second stapling section 18 for binding the set of sheets. The revolution of the motor 64 is controlled through the driver D5 based on a table designed to vary the revolution of the motor 64 according to the sheet count of a set of sheets. Further, whether the motor 64 is rotated forward or in reverse is controlled by the CPU through the driver D5.

A reference numeral 152 designates a read-only memory (ROM) in which the control routines to be carried out by the CPU 150 are stored in advance. A reference numeral 153 denotes a random access memory (RAM), which is a storing means for storing various data such as computation data from the CPU 150 or control data received from the image forming apparatus 1.

[Description of Operations]

Referring to FIGS. 10 through 14, the control of the sheet folding apparatus in this embodiment will be described.

Figure 10:
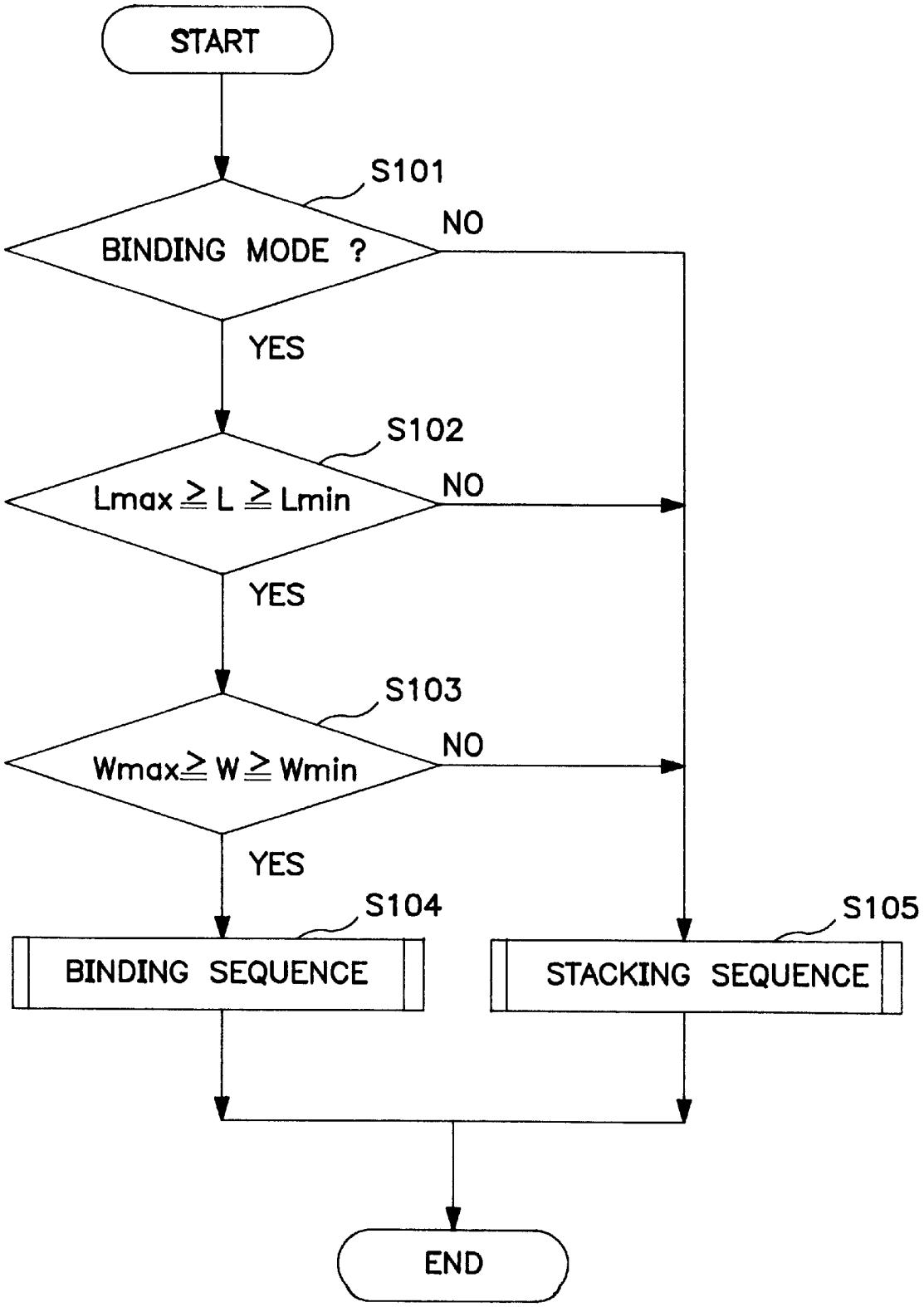
FIG. 10 is a main flowchart for the binding mode of the same sheet folding apparatus.

FIG. 10 presents the main routine in which the sheet folding apparatus 2 receives operational mode information for selecting the binding mode or stacking mode, and sheet information, that is, the sheet length L, sheet width W, sheet count N, and set count M, from the image forming apparatus 1 connected to the sheet folding apparatus 2. The operation of this sheet folding apparatus 2 is started as it receives a start signal.

Thereafter, the mode information is confirmed (S101). When the operational mode is not a binding mode, the operation goes to the stacking mode (S105), and when the operational mode is the stacking mode, it is confirmed whether or not the sheet length L and sheet width W are suitable for binding (S102, S103). When the sheet size is not acceptable, the operation goes to the stacking mode (S105).

When it is determined that the sheet size is suitable for binding, the operation advances to S104, in which the binding mode sequence is carried out.

[Basic Binding Operation]

Figure 11:
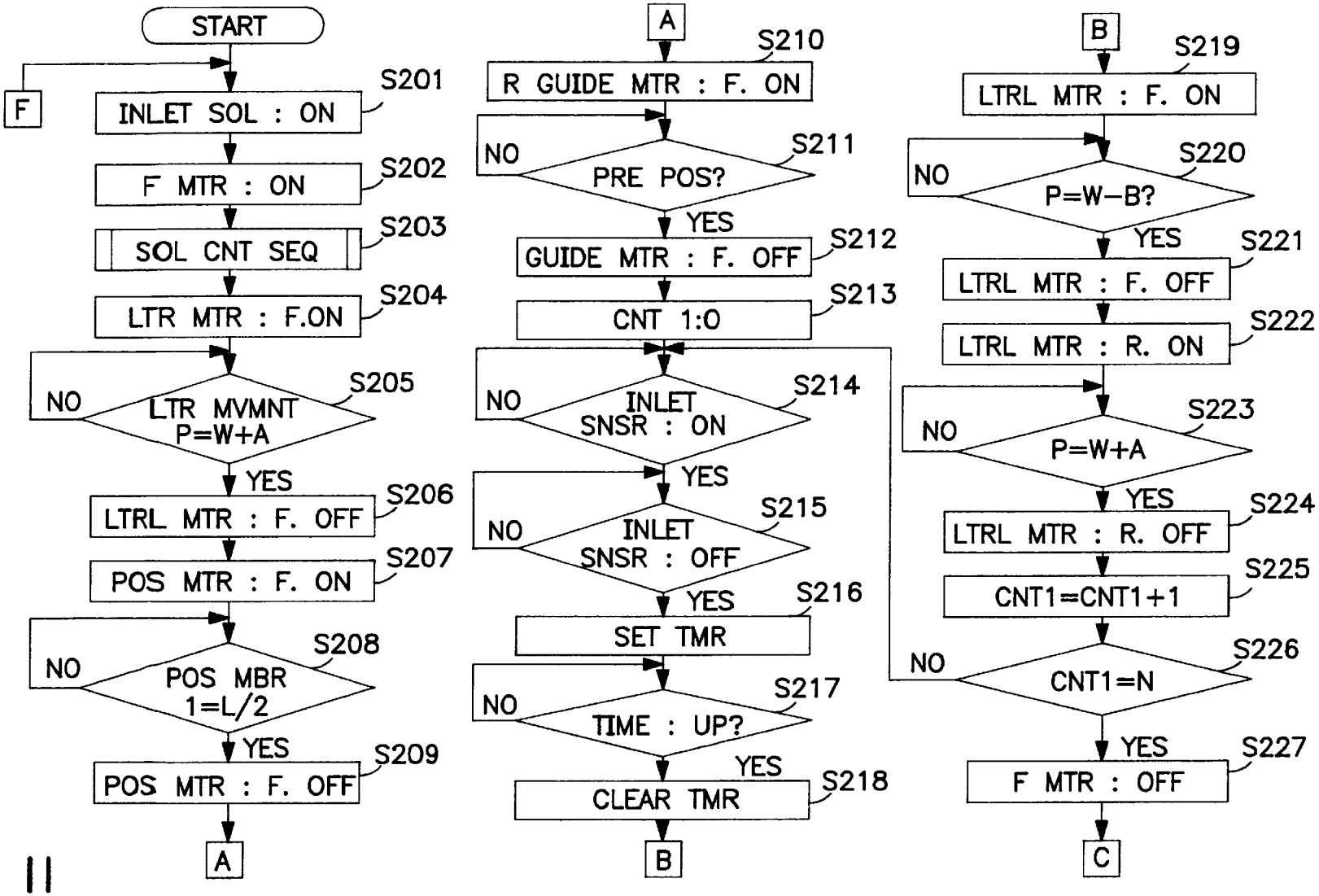
FIG. 11 is a flowchart for the basic operation of the same sheet folding apparatus.
Figure 12A:
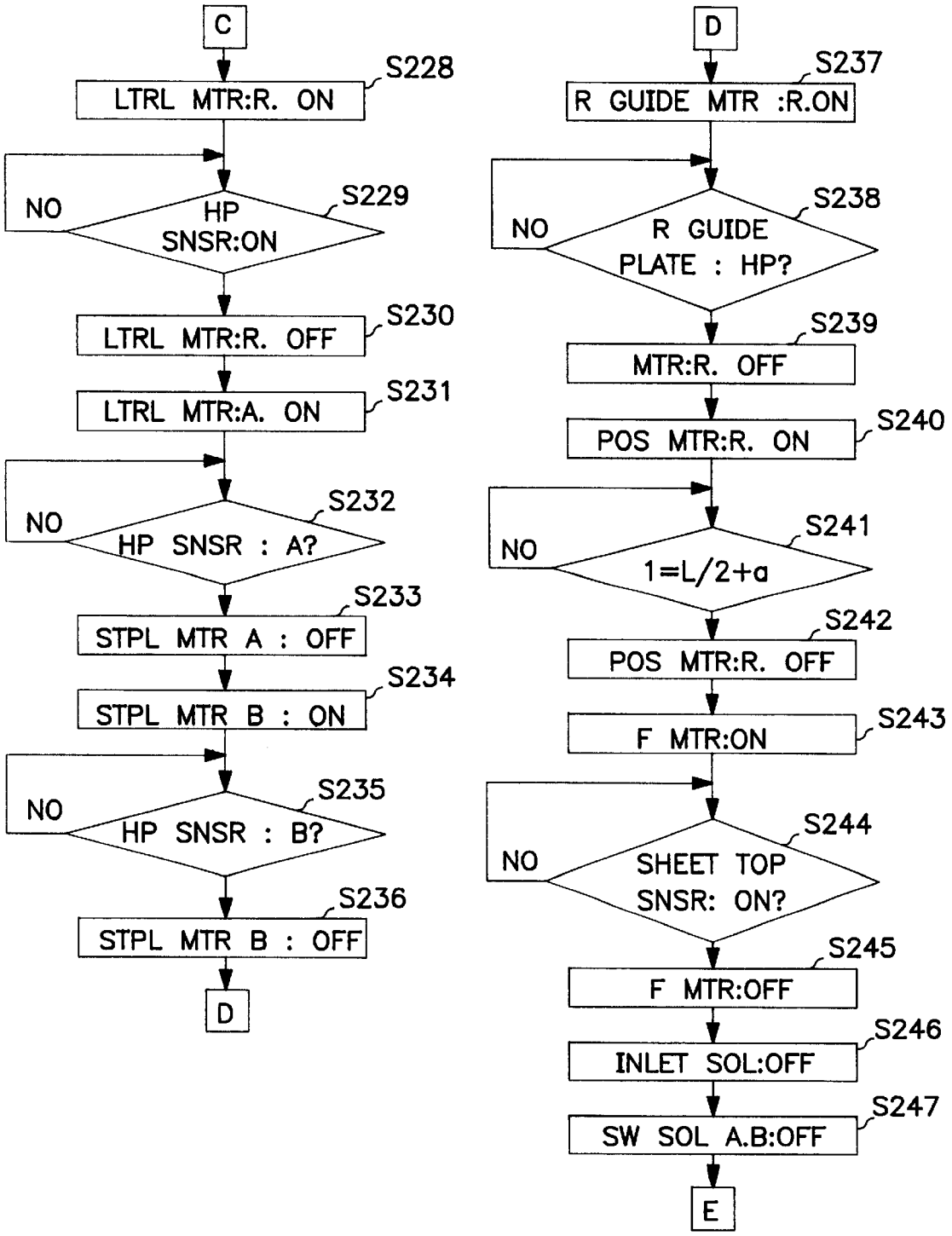
FIGS. 12*a* and 12*b* are also flowcharts for operation of the same sheet folding apparatus.
Figure 12B:
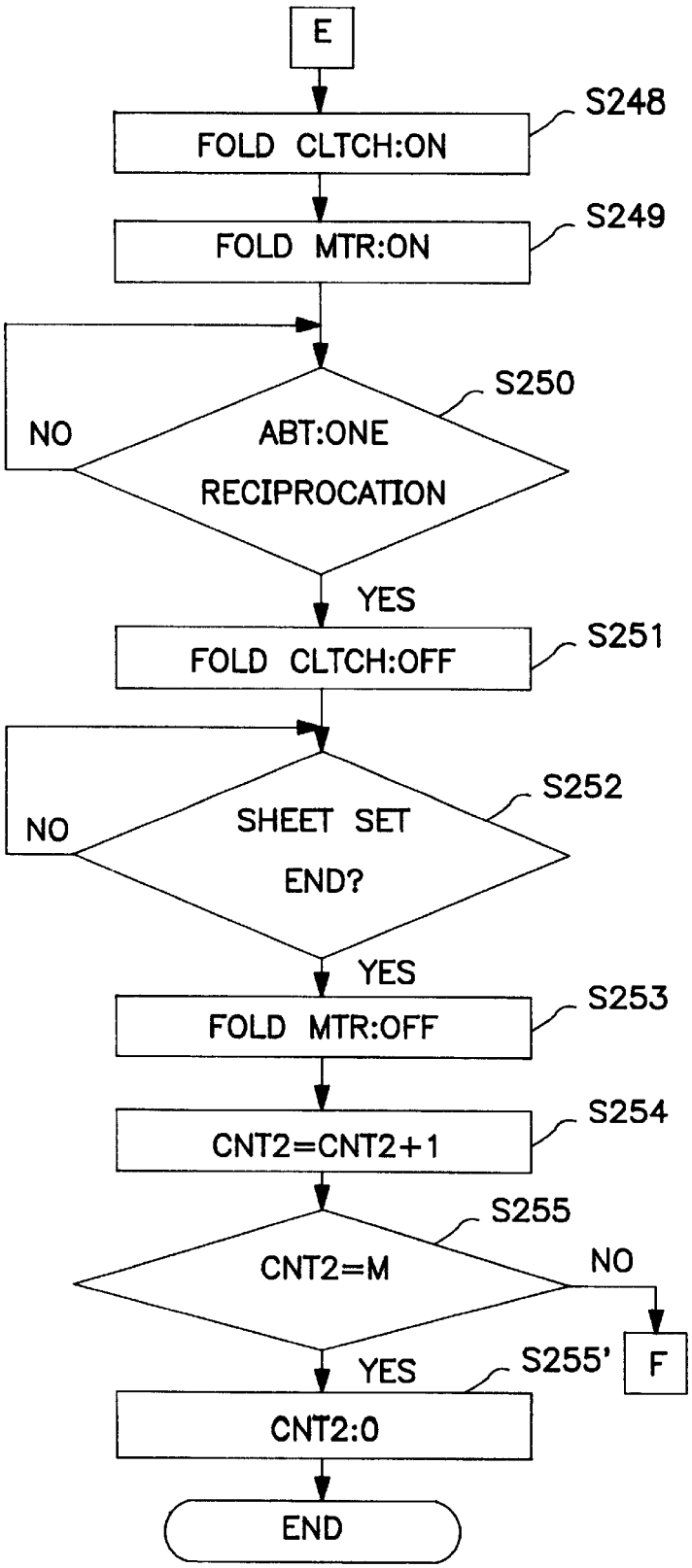

Referring to FIGS. 11 and 12, a basic binding mode sequence will be described.

First, when it is determined according to the sheet size information that the sheet size is suitable for binding, the operation advances to S201, in which the entrance solenoid 3*d* is turned on to open the path for the binding mode.

Then, the conveyer motor 51 is turned on to drive the conveyer rollers 13 and 14, and the half-moon rollers 17*a* and 22*a*, to prepare the apparatus for sheet conveyance (S202).

Next, the operation goes to S203 to control the sheet path switching solenoid 15*d* and 16*d*.

Then, the cross-shift motor 24*d* is turned on and rotated forward so that a distance P between the cross-shift members 24*a* and 24*b* becomes (W+A), wherein A being the gap between the sheet edge and the cross-shift member 24, being approximately 10 mm in a normal case (S204).

The driving of the cross-shift motor 24*d* is continued until the distance P between the cross-shift members 24*a* and 24*b* becomes (W+A) (S205).

As soon as the distance P between the cross-shift members 24*a* and 24*b* becomes (W+A), the forward driving of the cross-shift motor 24*d* is stopped (S206).

Next, the sheet positioning motor 61 is turned on and rotated forward so that the sheet positioning plate 23 is moved to a point which is on downstream side of the stapling point 19*a* (first predetermined position) for the stapler 18 by a distance of 1 (=L/2).

Figure 7:
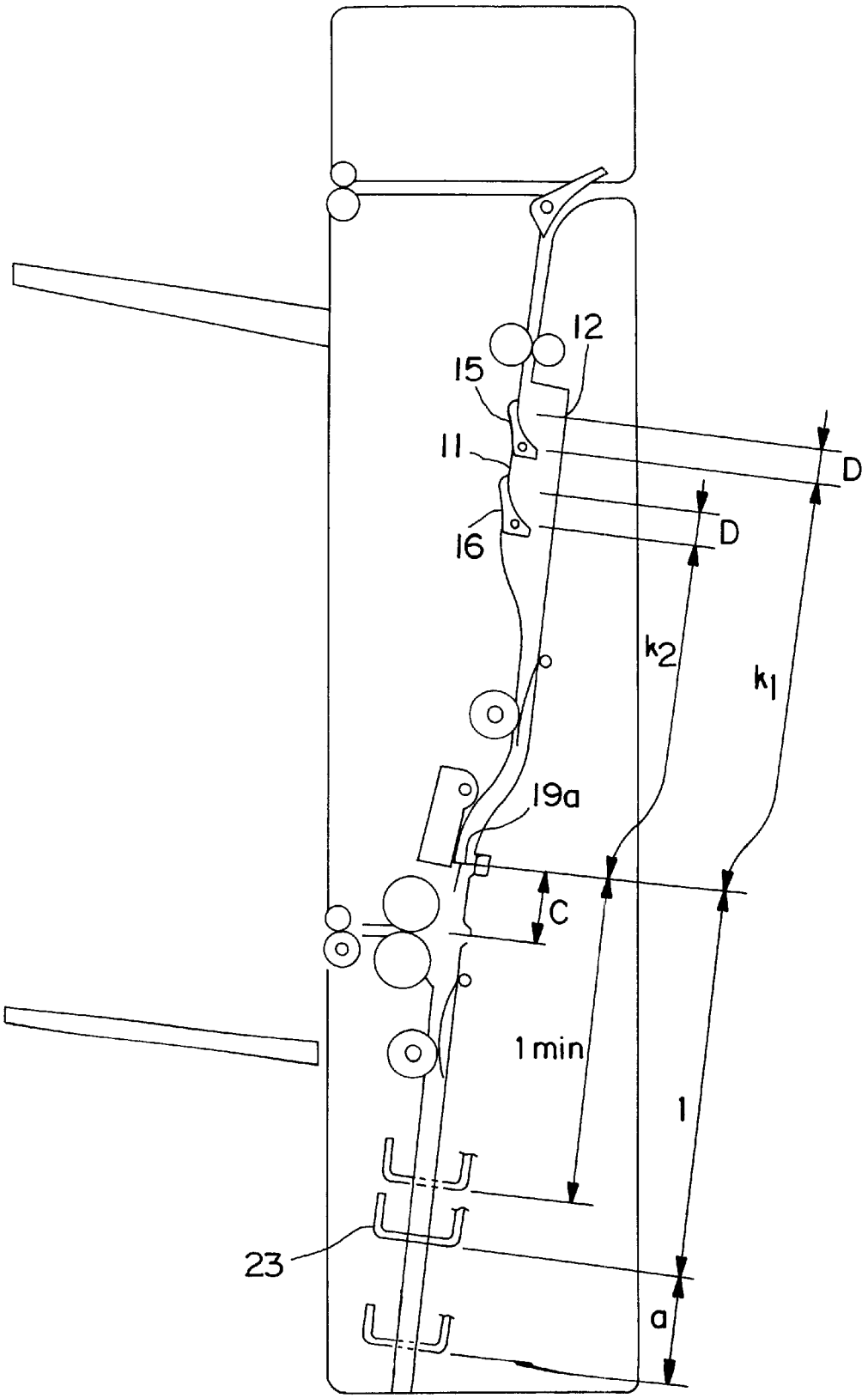
FIG. 7 is a vertical sectional view of the sheet positioning section of the same sheet folding apparatus, providing the essential measurements thereof.

As soon as the distance 1 between the position of the sheet positioning plate 23 and the stapling point 19*a* for the stapler 18 becomes L/2 (FIG. 7), the forward rotation of the sheet positioning motor 51 is stopped (S209).

At the same time, the roller guide motor 205 is turned on and rotated forward so that the roller guide 201 is moved to a predetermined position to prevent the delivered sheet from coming in contact with the folding rollers 26 and 27 (S210, S211).

Then, the sheet counter CNT 1 is set to zero (S213), and the signal from the entrance sensor 83 is confirmed (S214).

As soon as the status of the entrance sensor 83 changes from "ON" to "OFF" (S215), a cross-shift timer is set to a duration t1 which is the time it takes for the leading end of the sheet to hit the sheet positioning plate 23; in other words, the cross-shift time is set in such a manner that the sheet is jogged a duration of t1 after the sheet size information is received (S216).

The cross-shift member 24 is kept on standby until the cross-shift timer counts up to the set value (S217). As soon as the cross-shift timer counts up to the set value, the operation moves to S218, in which the cross-shift timer is cleared.

Then, the cross-shift motor 24*d* is turned on and rotated forward so that the cross shift members 24*a* and 24*b* are moved until the distance P becomes (W−B) (B is a combined distance the cross-shift members 24*a* and 24*b* are moved toward each other to jog a sheet, and normally, it is approximately 2 mm) (S219).

The forward rotation of the cross-shift motor 24*d* is continued until the distance P becomes (W−B) (S220).

As soon as the distance P between the cross-shift members 24*a* and 24*b* becomes (W−B), the forward rotation of the cross-shift motor 24*d* is stopped (S221).

Next, the cross-shift motor 24*d* is turned on and rotated in reverse to prepare the cross-shift members 24*a* and 24*b*, which have just finished jogging a sheet, for the next sheet jogging, that is, to move back the cross-shifting members 24*a* and 24*b* to their corresponding on-standby positions at which the distance P is (W+A) (S222).

In S223, as soon as the distance P between the cross-shift members 24*a* and 24*b* becomes (W+A), the reverse rotation of the cross-shift motor 24*d* is stopped (S224).

The above described operations in S219–S224 are carried out in an extremely short period of time in which the half-moon rollers 17*a* and 22*a* are not in contact with elastic members 17*d* and 22*d*, that is, the counterpart members of the rollers 17*a* and 22*a*, respectively.

Next, one is added to the sheet count in the sheet counter CNT 1 (S225). The above sequence is repeated until the sheet count in the sheet counter CNT 1 reaches a predetermined number N (S226).

As soon as it is confirmed that the sheet count has reached the predetermined number N, the conveyer motor 51 is turned off to cease the sheet conveyance (S227).

Then, the operation for returning the cross-shift members 24*a* and 24*b* to their home positions is carried out.

First, the cross-shift motor 24*d* is turned on and rotated in reverse (S228) until the cross-shift members 24*a* and 24*b* return to their home positions (S229).

After the arrival of the cross-shift members 24*a* and 24*b* at their home positions is confirmed in S229, the operation goes to the S230, in which the reverse rotation of the cross-shift motor 24*d* is ceased.

Next, a stapling operation (two point binding) is carried out (S231–S236) to bind a set of sheets.

Next, in order to prepare for the folding operation, the roller guide motor 205 is turned on and rotated in reverse so that the roller guide 201 is moved to its home position (S237).

The rotation of the roller guide motor 205 is continued until the roller guide 201 returns to the home position (S238).

As soon as the arrival of the roller guide 201 at its home position is confirmed in S238, the operation advances to S239, in which the reverse rotation of the roller guide motor 305 is stopped (S239).

Then, the sheet positioning motor 61 is turned on and rotated in reverse to move the sheet positioning plate 23 in the downstream direction so that the distance 1 between the sheet positioning plate 23 and the stapling position 19*a* becomes (L/2+C) (C is the distance between the stapling position 19*a* and the folding position) (S240).

The reverse rotation of the sheet positioning motor 61 is continued until the sheet positioning plate 23 reaches a predetermined position (S241).

As soon as the arrival of the sheet positioning plate 23 at the predetermined position (predetermined second position) is confirmed in S241, the operation goes to S242, in which the reverse rotation of the sheet positioning motor 61 is stopped.

Then, the conveyer motor 51 is restarted to convey the set of sheets until the set of sheets contacts the sheet positioning plate 23 (S243).

The driving of the conveyer motor 51 is continued until the set of sheets is conveyed to a predetermined position (S244).

As soon as it is confirmed in S244 that the leading end of the set of sheets hits the sheet positioning plate 23, the conveyer motor 51 is turned off (S245), and also, the entrance solenoid 3*d* and the sheet path switching solenoid 15*d* are turned off (S246, S247).

Next, the folding clutch 74*a* is turned on (S248), and folding motor 64 is turned on (S249).

As the folding clutch 74*a* is turned on, the pusher plate 25 begins a pushing action for guiding the set of sheets to the folding rollers 26 and 27.

The driving of the folding clutch 74*a* is continued until the completion of a single round trip immediately adjacent to the folding nip by the pusher plate 25*a* is detected by the home position sensor 82 (S250).

As soon as the completion of a single round trip by the pusher plate 25*a* is detected by the home position sensor 82 in S250, the folding clutch 74*a* is turned off (S151).

The rotation of the folding motor 64 is continued until the trailing end of the set of sheets is detected by the discharge sheet sensor 29.

As soon as the trailing end of the set of sheets is detected in S252, the folding motor 64 is turned off (S253).

Then, one is added to the sheet set count in the sheet counter CNT 2 (S254). When it is determined in S255 that the sheet set count in the sheet set counter CNT 2 has not reached a preset sheet set count M, the operation goes back to S201, and when it is determined in S255 that the sheet set count has reached the preset sheet set count M, the operation goes to S225', in which the sheet set counter CNT 2 is cleared, and the operation is ended.

Figure 13:
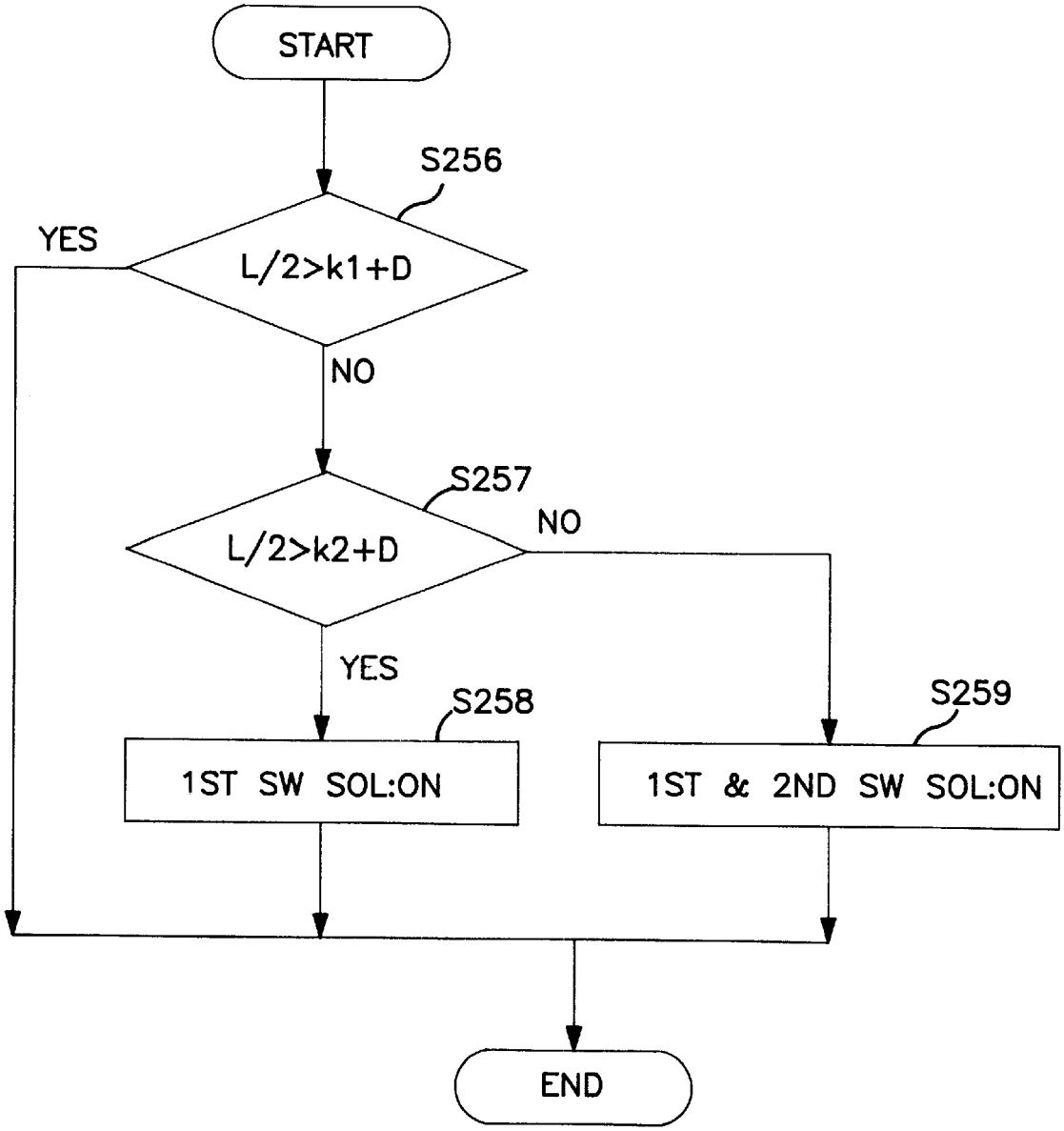
FIG. 13 is a flow chart for controlling the sheet path switching solenoid of the same folding apparatus.

Next, referring to FIG. 13, the control of the sheet path switching solenoid will be described.

When a half of the sheet size L, that is, L/2 is greater than the sum (k1+n) of a distance k1 (FIG. 7) from the stapling point 19*a* to the flapper 15 along the guides 11 and 12 and a constant D (S256), the operation is ended leaving the solenoids 15*d* and 16*d* in the "OFF" state (constant D represents the position of the trailing end of a set of sheets deposited in the tray when the sheet positioning plate 23 is at a proper position.

This constant D is a margin necessary to allow the following sheet to be deposited on the top of the sheet pile in stead of pushing its way into the sheet stack.

When L/2 is greater than (k1+D), L/2 is compared with (k2±n) (S257) (k2 is like k1; k2 is the distance between the stapling point 19*a* and the flapper 16, and D is the same margin)

When it is determined that L/2 is greater than (k2+D) (S257), the top solenoid 15*d* is turned on (S258) to guide the sheet using the bottom flapper 16.

When it is determined that L/2 is smaller than (k2+D) (S257), the top and bottom solenoids 15*d* and 16*d* (S259) are turned on to deposit the sheet along the guide 11.

Figure 14:
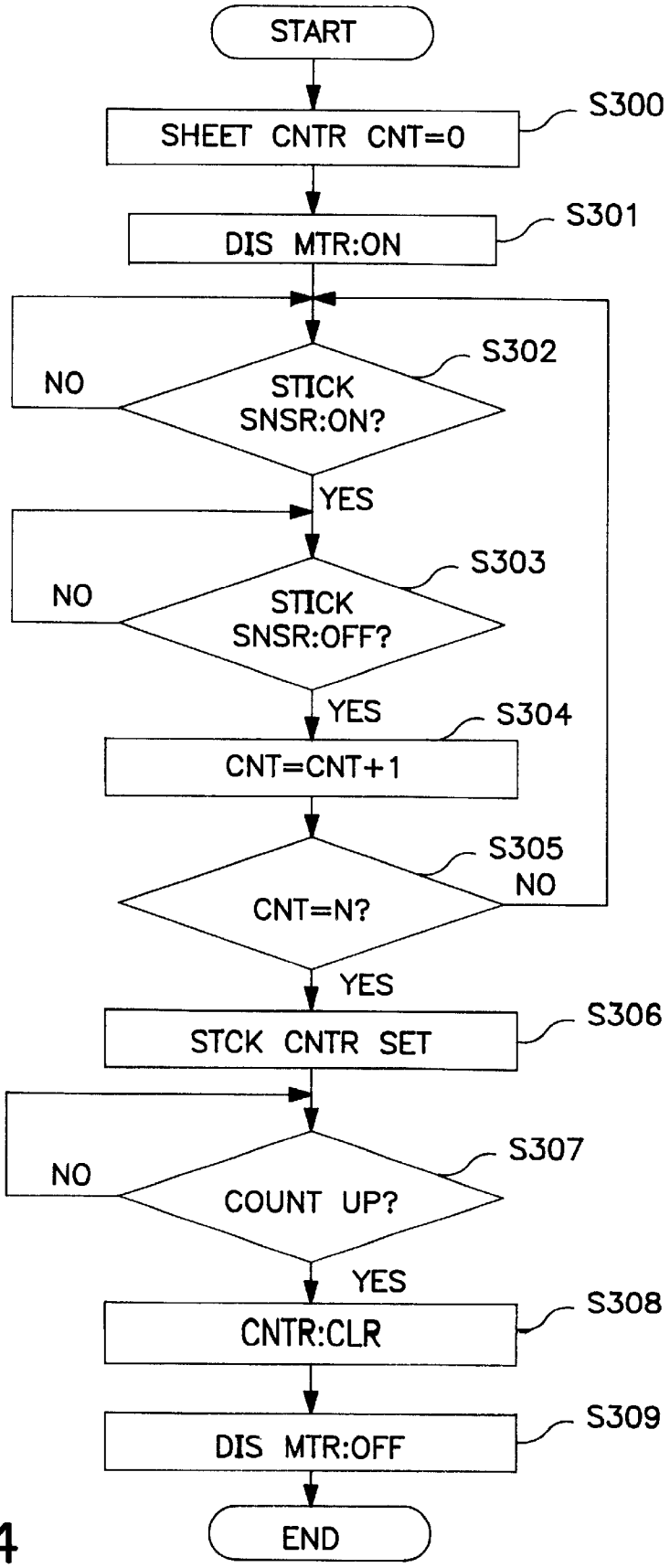
FIG. 14 is a flowchart for the stacking mode of the same.

Next, Referring to FIG. 14, the stacking mode will be described in detail.

First, the sheet counter CNT 1 is set to zero (S300). Then, the stacking discharge motor 95 is turned on (S301) to rotate the stacking discharge roller 5.

Next, it is confirmed whether the stack sensor 84 is on or not (S302). When the stack sensor 84 is on, the operation goes to S303, in which it is confirmed whether or not the stack sensor 84 has gone out (S303).

After the stack sensor 84 goes out, one is added to the sheet count in the sheet counter CNT 1 (S304), and then, it is confirmed whether or not the new sheet count matches the preset sheet count N (S305). When the new sheet count in the sheet counter CNT 1 is smaller than the preset sheet count N, the operation goes back to a point just before S302.

When the new sheet count in the sheet counter CNT 1 matches the preset count N, the stacking discharge motor 95 is turned off (S309) after the sheet is conveyed a predetermined distance which is sufficient to cause trailing end of the sheet to pass by the stack sensor 84 (S307).

EMBODIMENT 1

Figure 15:
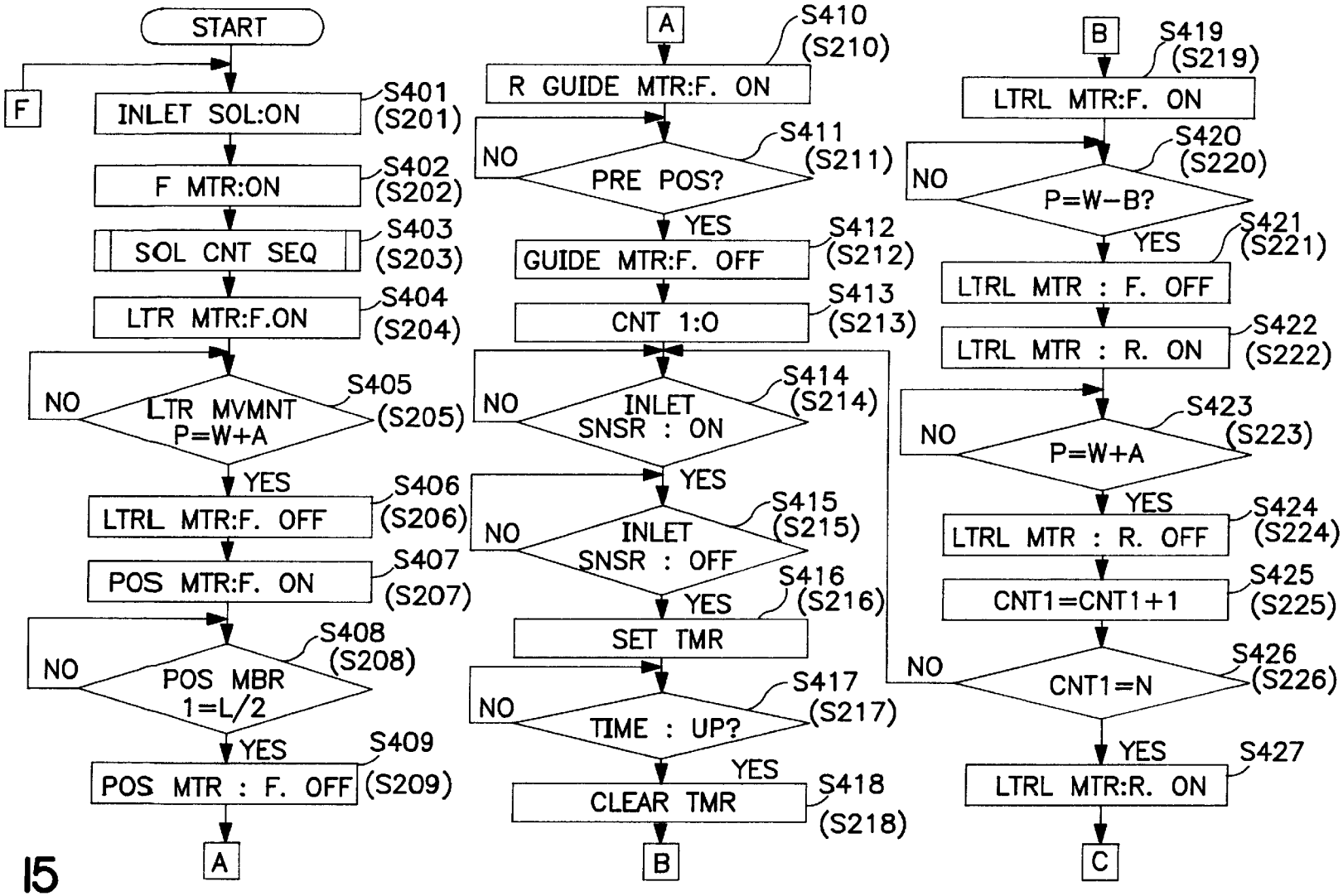
FIG. 15 is a flowchart for the first embodiment of the present invention.
Figure 16A:
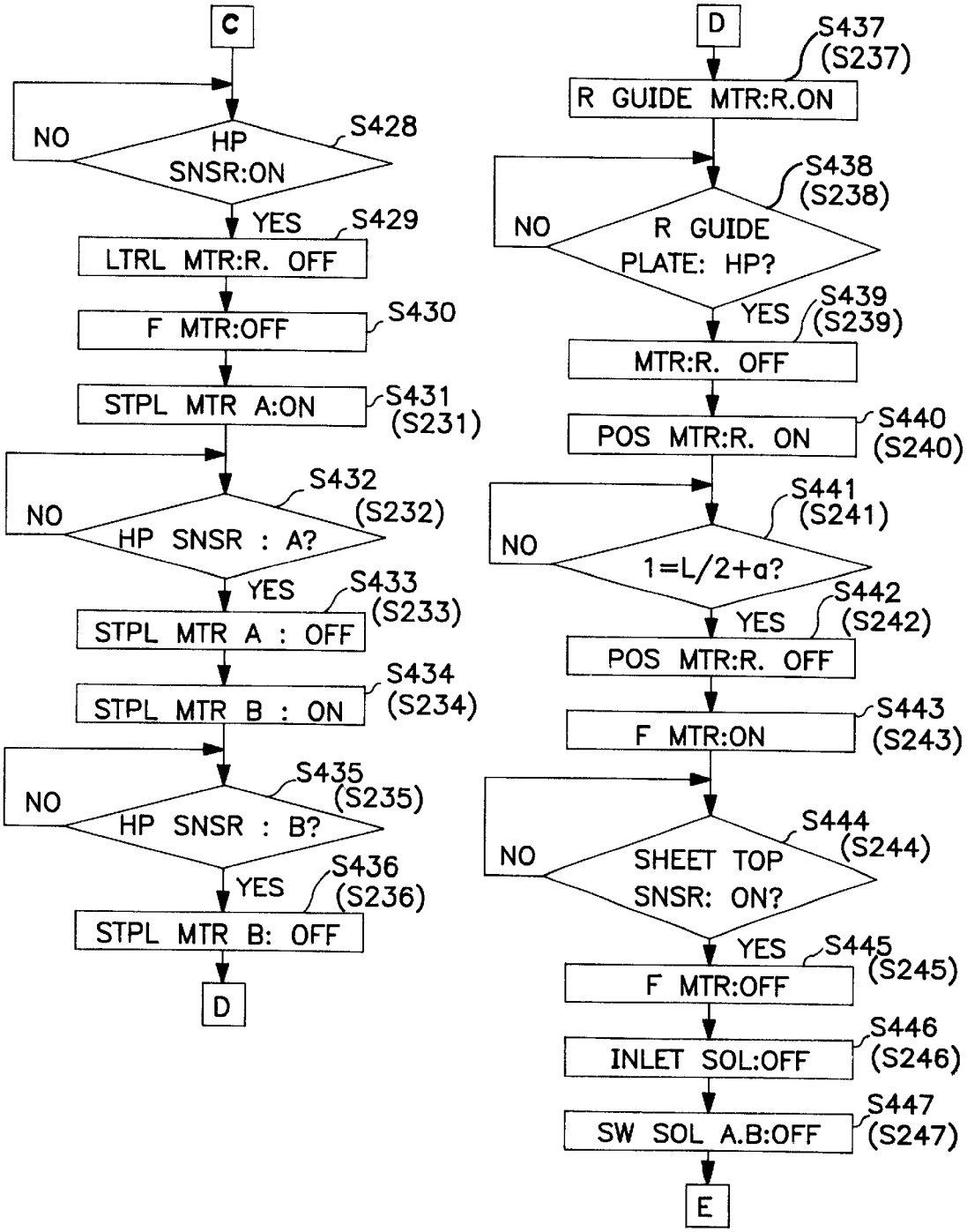
FIGS. 16*a* and 16*b* are also flowcharts for the first embodiment of the present invention.
Figure 16B:
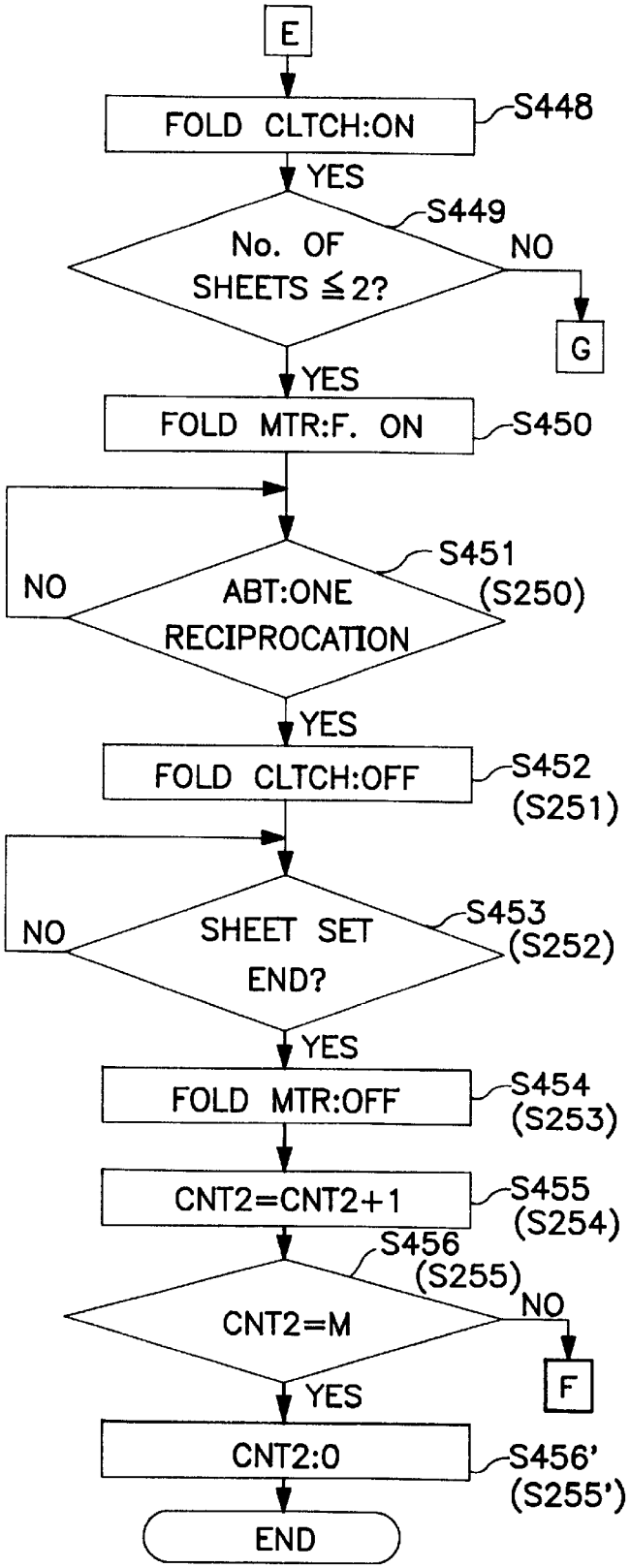
Figure 17:
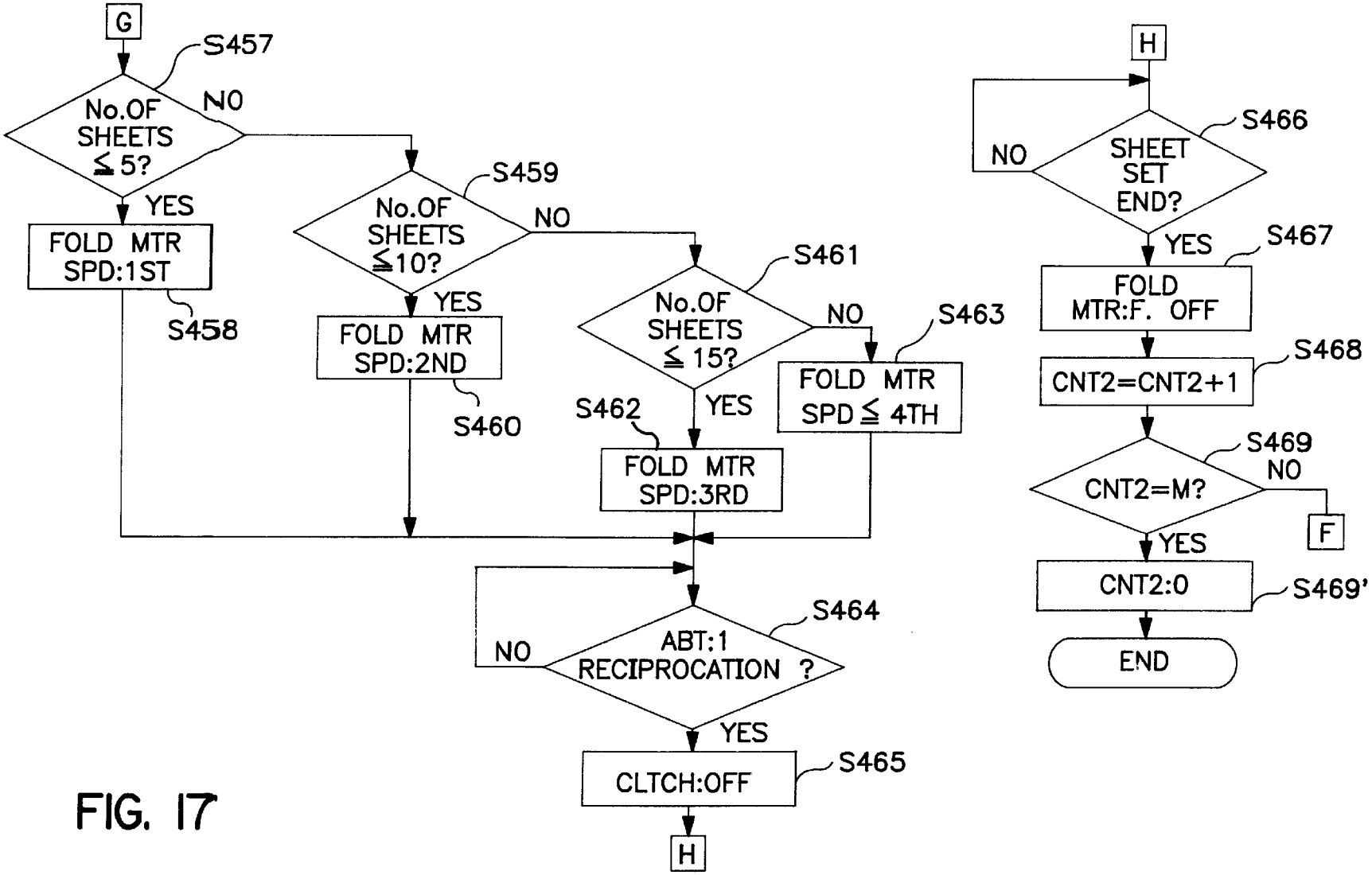
FIG. 17 is also a flowchart for the first embodiment of the present invention.

Referring to FIGS. 15 through 17, the binding mode sequence in this embodiment will be described.

Since sequences S401–S426 and S231–S247 are the same as the sequences S202–S226 and 231–S247, respectively, in FIG. 11, their description will be omitted, and only the special characteristics of this embodiment will be described.

In this embodiment, after it is confirmed in S426, as it is in S226, that the sheet count matches the preset count, the operation for returning the cross-shift members 24*a* and 24*b* to their home positions will be carried out.

First, the cross-shift motor 24*d* is turned on and rotated in reverse (S247) until the arrival of the cross-shift members 24*a* and 24*b* at their home positions (S248).

As soon as the arrival of the cross-shift members 24*a* and 24*b* at their home positions is detected in S248 (FIG. 16), the operation advances to S429, in which the reversely rotating cross-shift motor 24*d* is turned off, and then, goes to S430, in which the conveyer motor 51 is turned off.

Another characteristic of this embodiment is that the folding speed is varied according to the sheet size (count).

More specifically, after the folding clutch 74*a* is turned on (S448), the operation goes to S449, in which a decision is made as to whether or not the sheet count is no more than two. When the sheet count is no more than two, the operation goes to S450, in which the folding motor 64 is turned on. At this point of the operation, the folding speed is set at a normal speed Vm.

As the folding clutch 74*a* is turned on, the pusher plate 25*a* begins pushing the set of sheets to guide the set of sheets to the folding rollers 26 and 27.

The folding clutch 74*a* is left in the on-state until the completion of a single round trip immediately adjacent to the folding nip by the pusher plate 25*a* is detected by the pusher plate home position detection sensor 82 (S451). Since the sequence thereafter S452–S456' is the same as the sequence S250–S255', its description will be omitted.

Further, when it is determined in S449, based on the sheet count in the sheet counter, that the number of sheets to be folded is no less than three, the operation goes to S457 (FIG. 17), in which a decision is made as to whether or not the sheet data indicates no more than five sheets. When the sheet count is no more than five, the folding speed is set to the first speed V1 (Vm>V1), a high speed (S456).

Next, in S464, the folding clutch 74*a* is kept in the on-state until the completion of a single round trip by the pusher plate 25*a* is detected by the pusher plate home position detection sensor 52.

After the completion of a single round trip by the pusher plate 25*a* is detected by the pusher plate home position detection sensor 82 in S464, the folding clutch 74*a* is turned off (S465).

The folding motor 64 is left in the on-state until the trailing end of the set of sheets is detected by the sheet discharge sensor 29 (S466).

Next, as soon as the trailing end of the set of sheets is detected by the sheet discharge sensor 29 in S466, the folding motor 64 is turned off (S467).

Then, one is added to the sheet set count in the sheet set counter CNT 2 (S468). When it is determined in S469 that the sheet count has not reached a preset count M, the operation returns to S401, and when it is determined in S469 that the sheet count has reached the preset count M, the sheet set counter CNT 2 is cleared in S469', and the operation is ended.

However, when it is determined in S457 that the sheet count is no less than six, the operation goes to S459, in which a decision is made as to whether or not the sheet data indicates no less than ten sheets. When the sheet count data shows no less than ten sheets, the folding motor speed is set to a second speed V2 (Vm>V1>V2) (S460).

Then, only after it is determined in S464 that the completion of a single round trip by the pusher plate 25*a* is detected by the pusher plate home position detection sensor 83, the folding clutch is turned off in the same manner as described above (S464).

The folding motor 64 is left on until the trailing end of the set of sheets is detected by the sheet discharge sensor 29 (S466).

Next, only after the trailing end of the set of sheets by the sheet discharge sensor 29 in S466, the folding motor 64 is turned off (S467).

Then, one is added to the sheet set count in the sheet set counter CNT 2 (S468). Next, when it is determined in S469 that the sheet set count in the sheet set counter CNT 2 has not reached the preset count M, the operation returns to S401, and when it is determined in S469 that the preset count M has been reached, the operation goes to S469', in which the sheet set counter CNT 2 is cleared and the operation is ended.

When it is determined in S459 that the sheet count is no less than 11, the operation goes to S461, in which a decision is made as to whether or not the sheet data indicates no less than 15 sheets. When the sheet data indicates no more than 15 sheets, the folding speed is set to a third speed V3 (Vm>V1>V2>V3).

Then, only after the completion of a single round trip by the pusher plate 25*a* is detected by the pusher plate home position detection sensor 82 in S464, the folding clutch 74*a* is turned off in the same manner as described above (S465).

The folding motor 64 is kept on until the trailing end of the set of sheet sets detected by the sheet discharge sensor 29 (S466).

The folding motor 64 is turned off only after the trailing end of the set of sheets is detected by the sheet discharge sensor 29 (S467).

Then, one is added to the sheet set count in the sheet set counter CNT 2 (S468). When it is determined in S469 that the sheet set count has not reached a preset count, the operation goes back to S401. When it is determined in S469 that the sheet set count has reached the present count, the operation advances to S469', in which the sheet set counter CNT 2 is cleared, and the operation is ended.

On the other hand, when it is determined in S461, based on the sheet data, that the sheet count is no less than 16, the folding speed is set to a fourth speed V4, a low speed (Vm>V1>V2>V3>V4) (S463).

Thereafter, only after the completion of a single round trip by the pusher plate 25*a* is detected by the pusher plate home position detection sensor 82 in S464, the folding clutch 74*a* is turned off in the same manner as described above (S465).

The folding motor 64 is kept on until the trailing end of the set of sheets is detected by the sheet discharge sensor 29 (S466).

The folding motor 64 is turned off only after the trailing end of the set of sheets is detected by the sheet discharge sensor 29 (S467).

Then, one is added to the sheet set count value in the sheet set counter CNT 2 (S468). When it is determined in S469 that the sheet set count has not reached a preset count M, the operation returns to S401. When it is determined in S469 that the sheet set count has reached the present count M, the operation advances to S469', in which the sheet set counter CNT 2 is cleared, and the operation is ended.

As described above, the number of sheets deposited in the sheet positioning member 23 as the first sheet holding means is counted by the sheet counting means CNT 1, and the folding speed of the folding rollers 26 and 27 as the sheet conveying means is varied according to the sheet count. Therefore, a set of sheets with a relatively small sheet count is conveyed at a relatively high speed, and the sheet set conveyance speed is gradually reduced as the sheet set counts increases. As a result, a set sheets can be finished as a bound set of sheets with superior appearance.

EMBODIMENT 2

Figure 18:
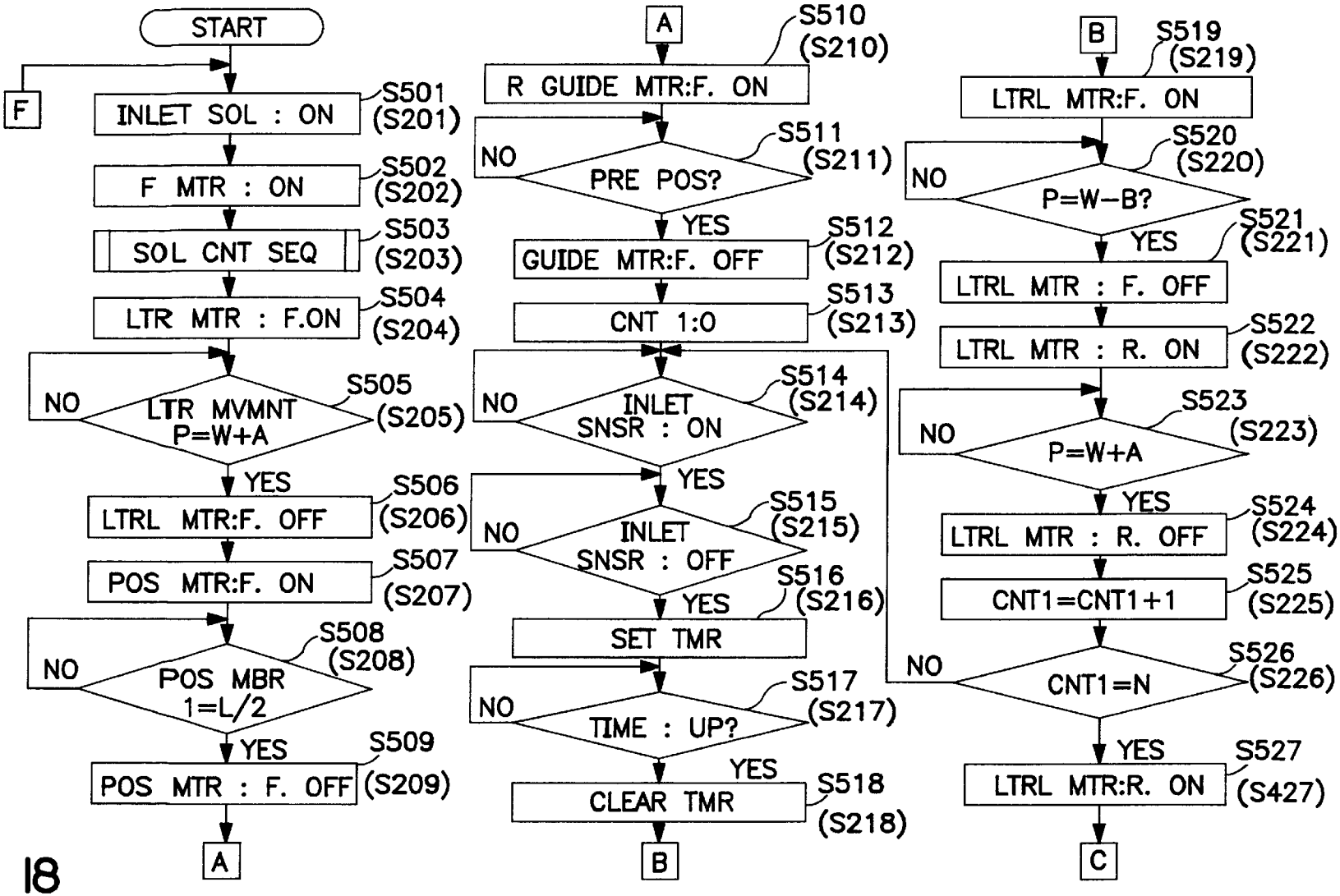
FIG. 18 is a flowchart for the second embodiment of the present invention.
Figure 19A:
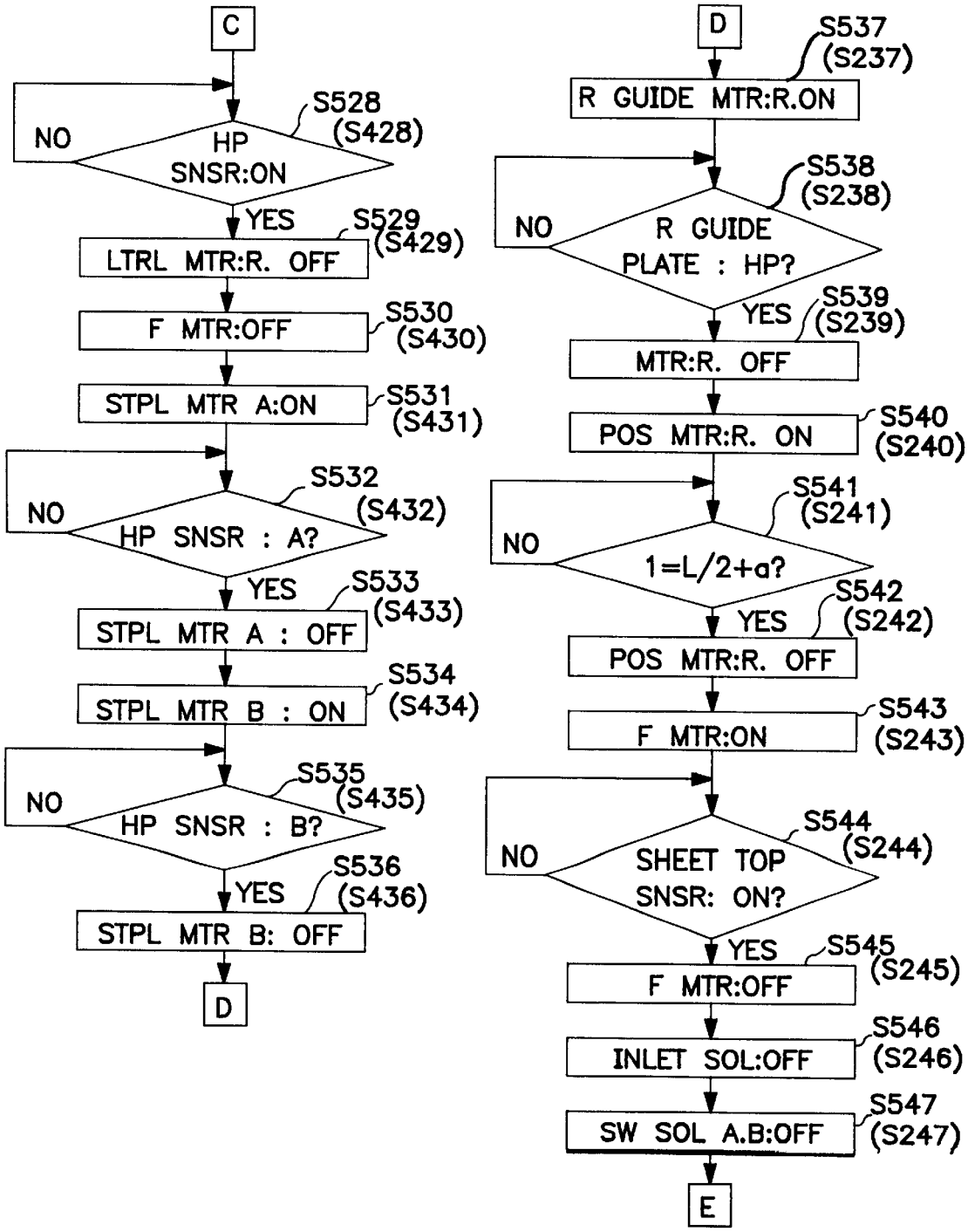
FIGS. 19*a* and 19*b* are also flowcharts for the second embodiment of the present invention.
Figure 19B:
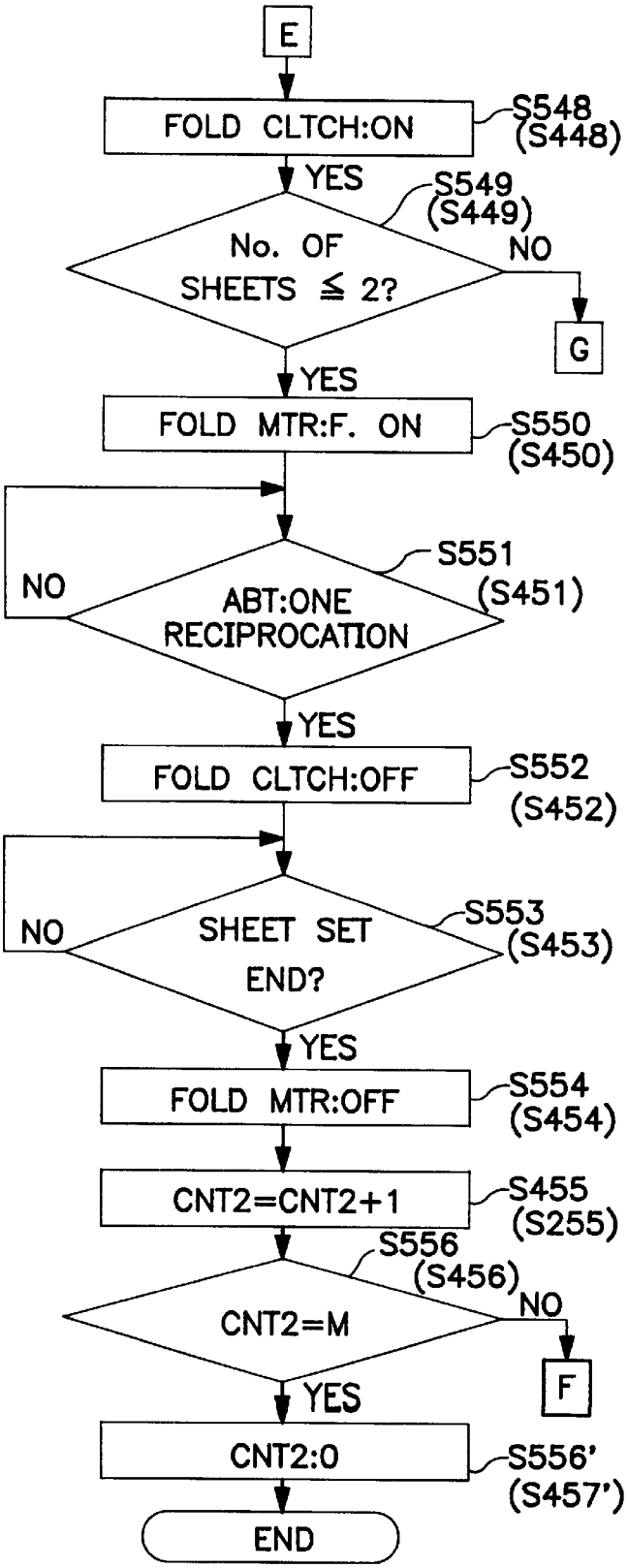
Figure 20:
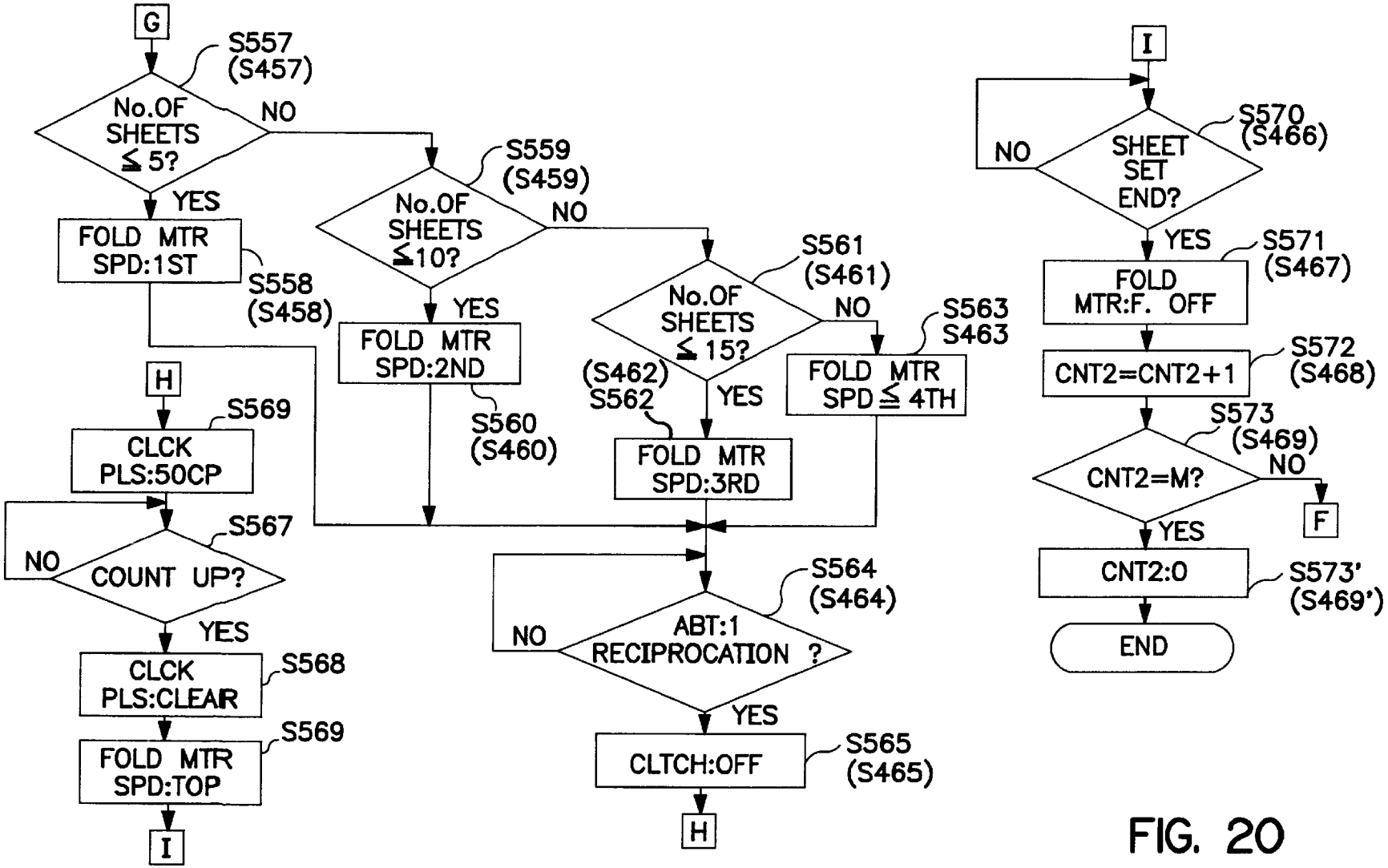
FIG. 20 is also a flow chart for the second embodiment of the present invention.

Referring to FIGS. 18–20, the binding mode sequence in the second embodiment will be described. In this embodiment, a basic operational sequence S501–S526 is the same as the sequence S201–S226 in the preceding embodiment; S527 is the same as S427; a sequence S528–S556' is the same as the sequence S428–S457; a sequence S557–S565 is the same as the sequence S457–S465; and a sequence S570–S573' is the same as the sequence S466–S469'. Therefore, their description will be omitted.

This embodiment has the following characteristic in addition to the same characteristics as those of the preceding embodiment. That is, in this embodiment, the conveyance speed is increased in the middle of a folding action.

As soon as the completion of a single round trip by the pusher plate 25*a* is detected by the pusher plate home position detection sensor 82 in S564, the folding clutch 74*a* is turned off (S565).

Next, after the folding clock pulse is set in S566, the operation goes to S567, in which the holding motor speed is held at the speed V1, V2, V3 or V4, which matches the sheet count of a set of sheets, until the folding clock counts up to the set value.

As soon as the folding clock counts up to the set value in S567, the operation advances to S568, in which the folding clock is cleared. Then the operation proceeds to 569, in which the folding speed is set to a top speed VH (VH>V1>V2>V3>V4). The top speed VH may be higher than Vm, the same as Vm, or lower than Vm.

The folding motor 64 is kept on until the trailing end of the set of sheets is detected by the sheet discharge sensor 29 (S570).

In other words, the control in this embodiment is executed in such a manner that the sheet conveyance speed of the folding rollers 26 and 27 as the sheet conveying means is set to the first speed (V1, V2, V3 and V4) in response to the output signal (sheet count) of the sheet counting means, and after a set of sheets is conveyed a predetermined distance by the sheet conveying means, the sheet set conveyance speed is adjusted to the second speed which is higher than the first speed, in response to the output signal of the sheet set conveyance distance measuring means. Therefore, a set of sheets is folded at a speed matching the sheet count of the set of sheets, and after the fold portion of the set of sheets is advanced a predetermined distance, the set of sheets is discharged at the second speed, the higher speed. As a result, operational efficiency is improved while finishing a set of sheets as a bound set of sheets with desirable appearance.

EMBODIMENT 3

Figure 21:
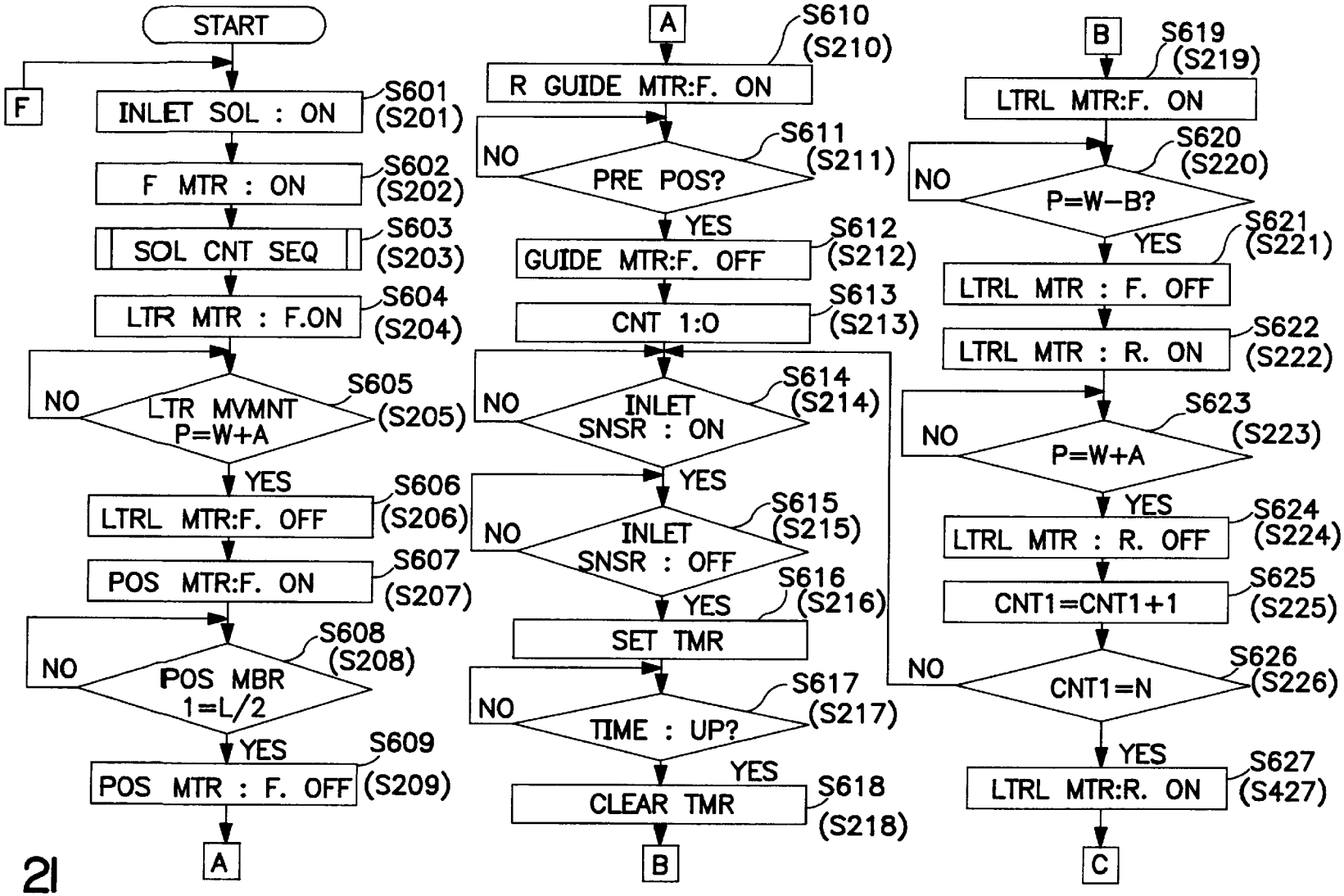
FIG. 21 is a flow chart for the third embodiment of the present invention.
Figure 22A:
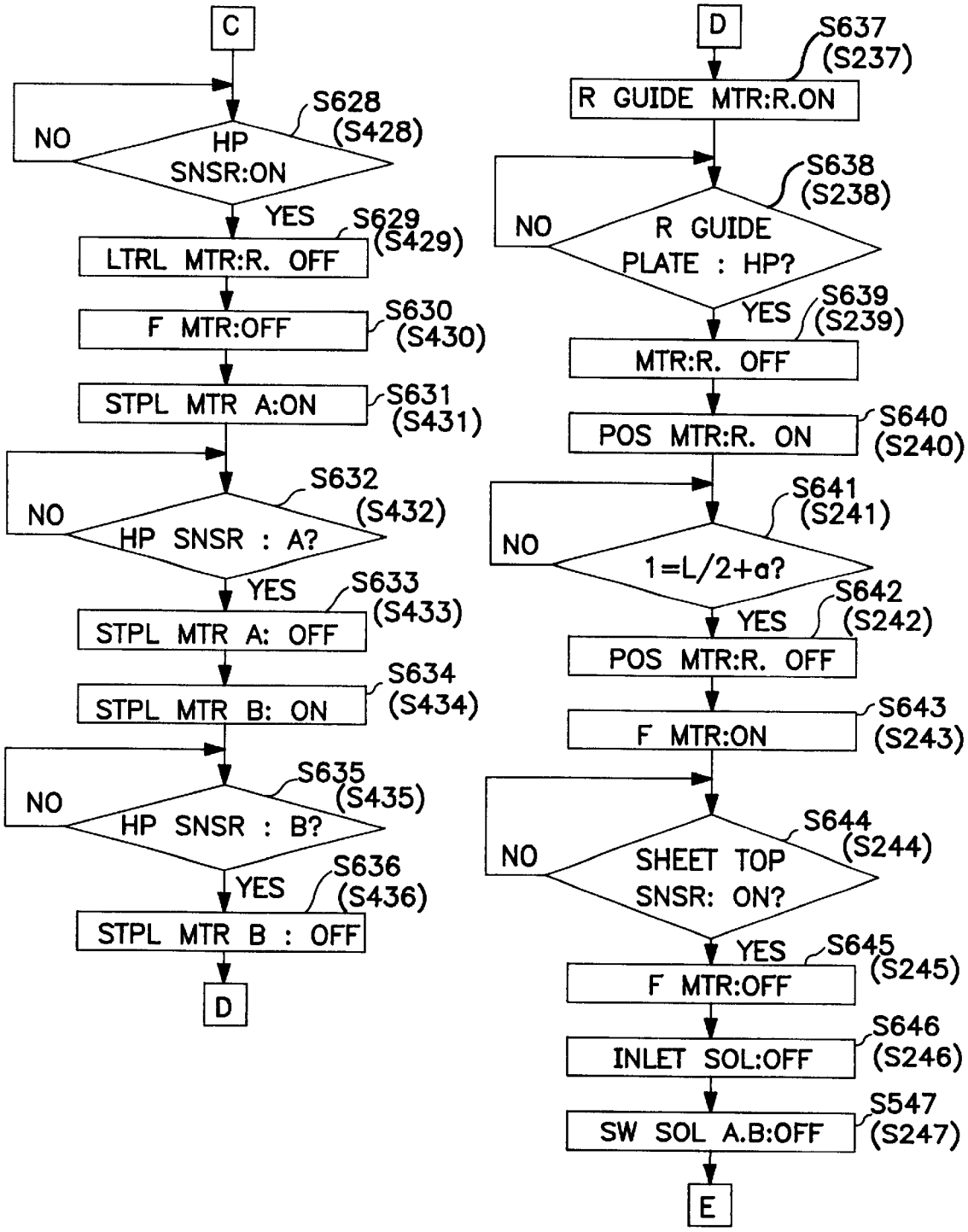
FIGS. 22*a* and 22*b* are also flowcharts for the third embodiment of the present invention.
Figure 22B:
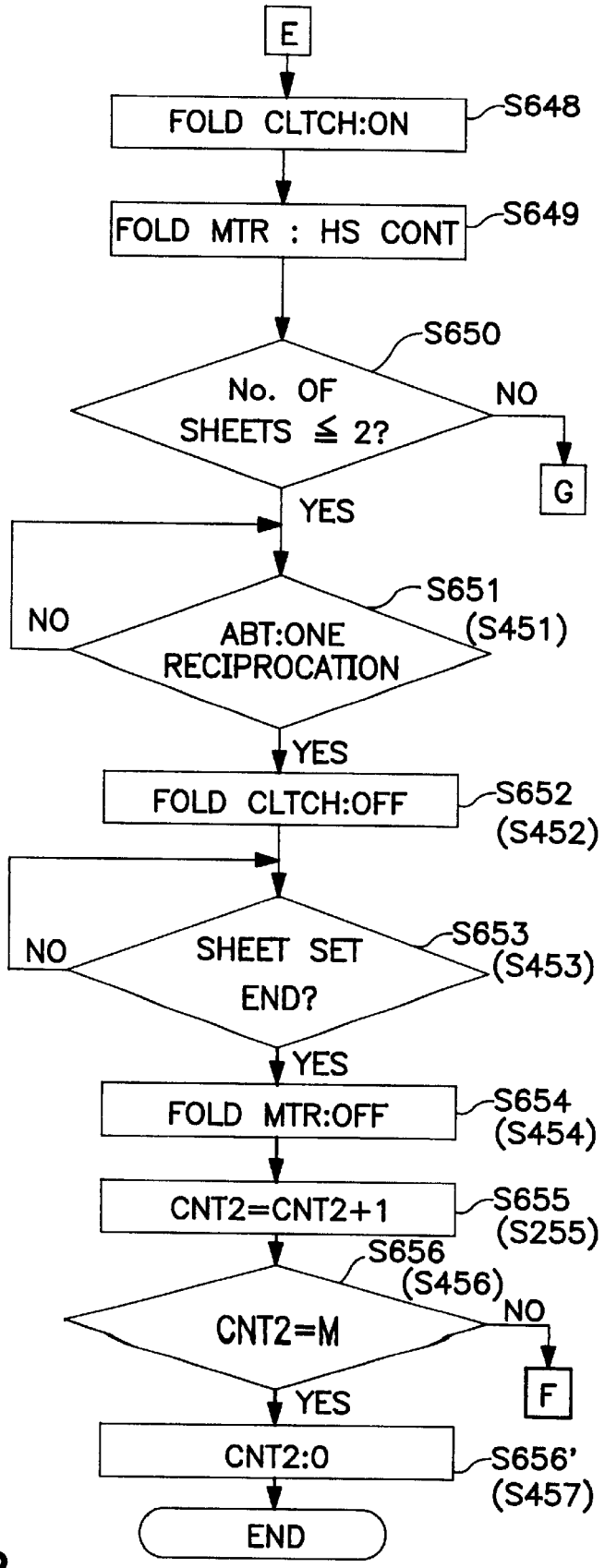
Figure 23A:
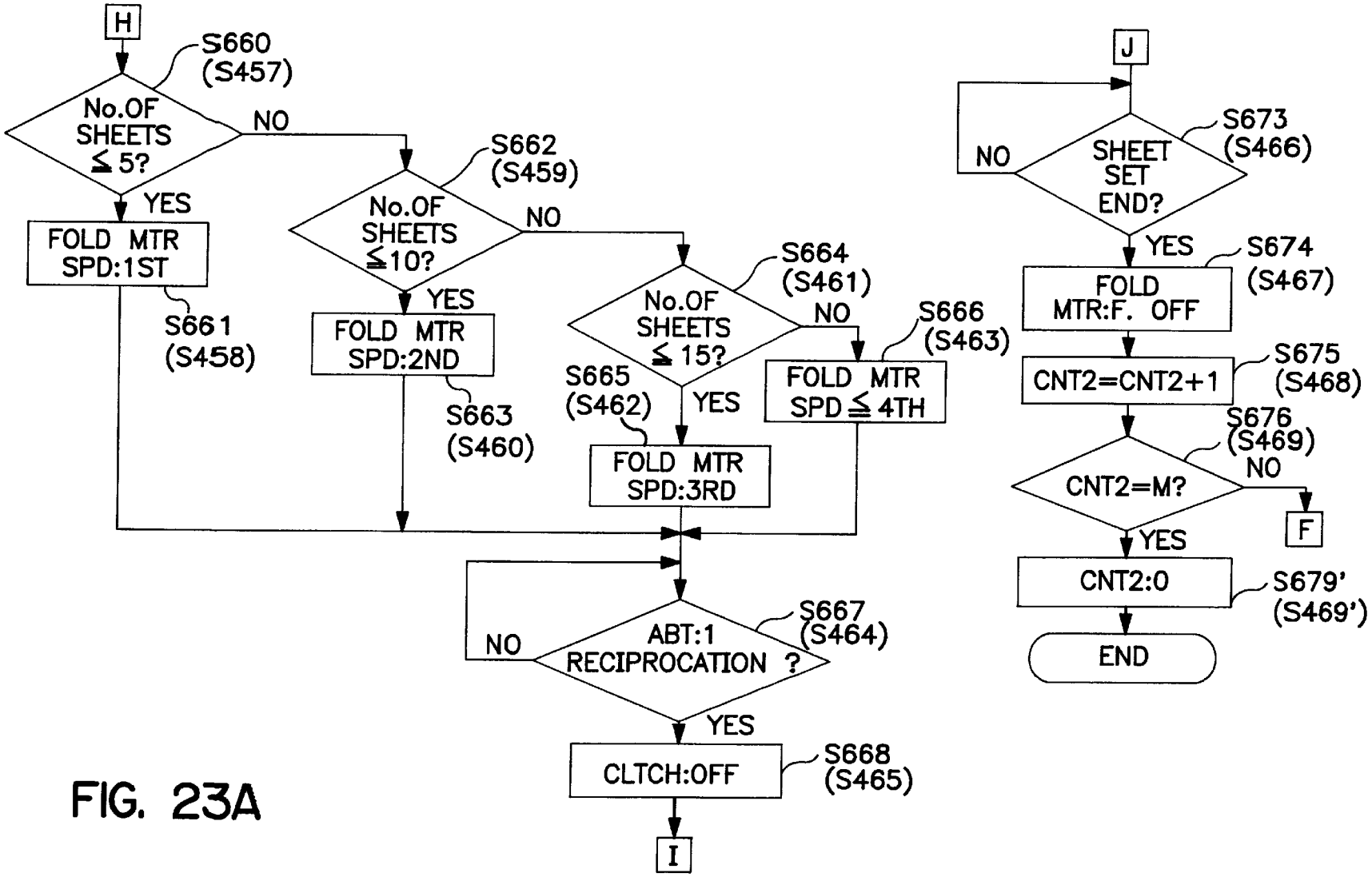
FIGS. 23*a* and 23*b* are also flowcharts for the third embodiment of the present invention.
Figure 23B:
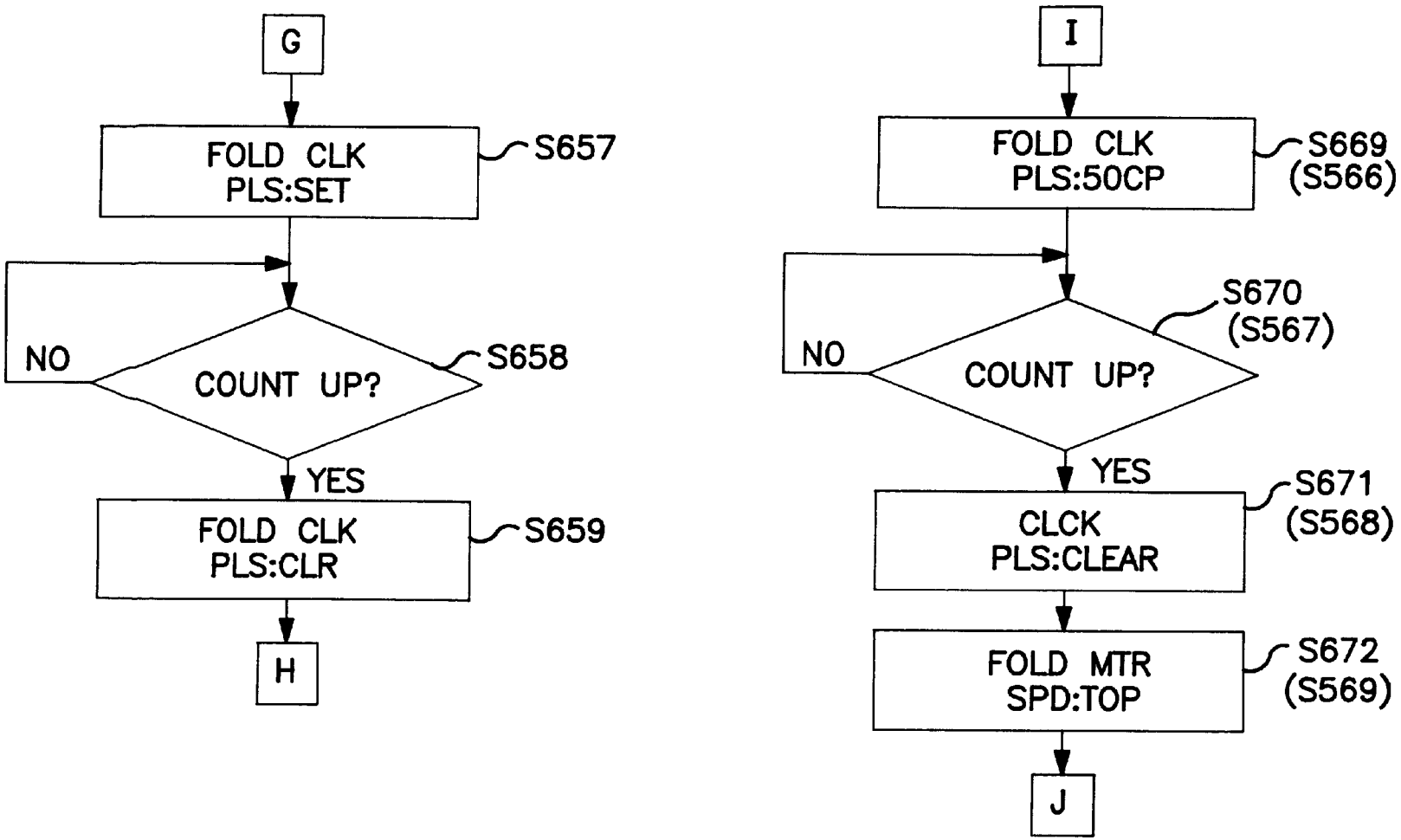

Referring to FIGS. 21 through 23, the binding mode sequence in the third embodiment of the present invention will be described. In this embodiment, a basic operational sequence S601–S626 is the same as the basic operational sequence S201–S226 in the preceding embodiments; S S627 is the same as S427; a sequence S628–S636 is the same as the sequence S428–S436; and a sequence S637–S647 is the same as the sequence S237–S247 in the preceding embodiments. Therefore, their description will be omitted.

The third embodiment is characterized in that a set of sheets if folded at the speed V1 even when the sheet count of the set of sheets is no more than two. More specifically, as soon as the contacting of the sheet positioning member 23 by the leading end of a set of sheets is detected in S644, the conveyance motor 51 is turned off (S645), and also, the entrance solenoid 3*d* and the sheet path switching solenoids 15*d* and 16*d* are turned off (S646, S647).

Then, the folding clutch 74*a* is turned on (S648), and the operation goes to S649, in which the speed of the folding motor 64 is changed to the first speed V1, the high speed. Then, the operation proceeds to S650, in which a decision is made as to whether or not the sheet data indicates no more than two sheets. When the sheet count is no more than two, the operation simply goes to S651.

As the folding clutch 74*a* is turned on, the pusher plate 25*a* pushes a set or sheets, guiding it to the folding rollers 26 and 27.

On the other hand, when it is determined in S650 that the number of sheets to be folded is no less than three, the operation goes to S657 (FIG. 23), in which the folding clock pulse is set, and the folding motor speed is maintained at the first speed V1 until the folding clock counts up to the set value.

As soon as the folding clock counts up to the set value in S658, the operation goes to S659, in which the folding clock is cleared. Then, the operation goes to S660, in which a decision is made as to whether or not the sheet data indicates no more than five sheets. When the sheet count is no more than five, the folding motor speed is maintained at the same high speed, that is, the first speed (S661).

When it is determined in S660 that the sheet count is no less than six, the operation moves to S662, in which a decision is made as to whether or not the sheet data shows no more than ten sheets. When the sheet data shows no more than ten sheets, the folding motor speed is adjusted to the speed V2 (S663).

When it is determined in S662 that the sheet count is no less than 11, the operation goes to S664, in which a decision is made as to whether or not the sheet data indicates no more than 15 sheets. When the sheet data indicates no more than 15, the folding motor speed is adjusted to the third speed V3 (S665).

When it is determined, based on the sheet data, that the number of sheets to be folded is no less than 16 (S664), the folding motor speed is adjusted to the low speed, that is, the fourth speed V4 (S666).

EMBODIMENT 4

Figure 24A:
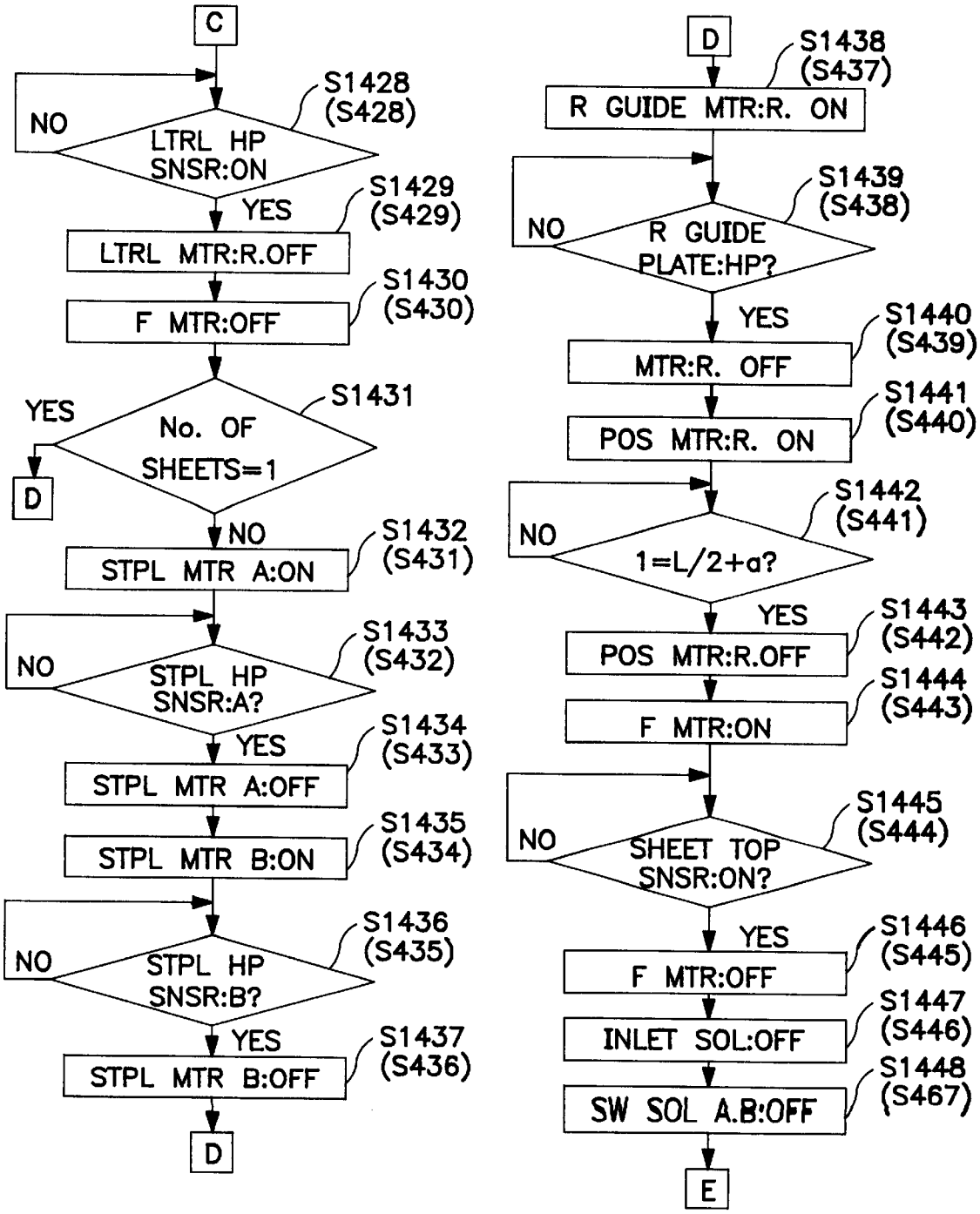
FIGS. 24*a* and 24*b* are flowcharts for the fourth embodiment of the present invention.
Figure 24B:
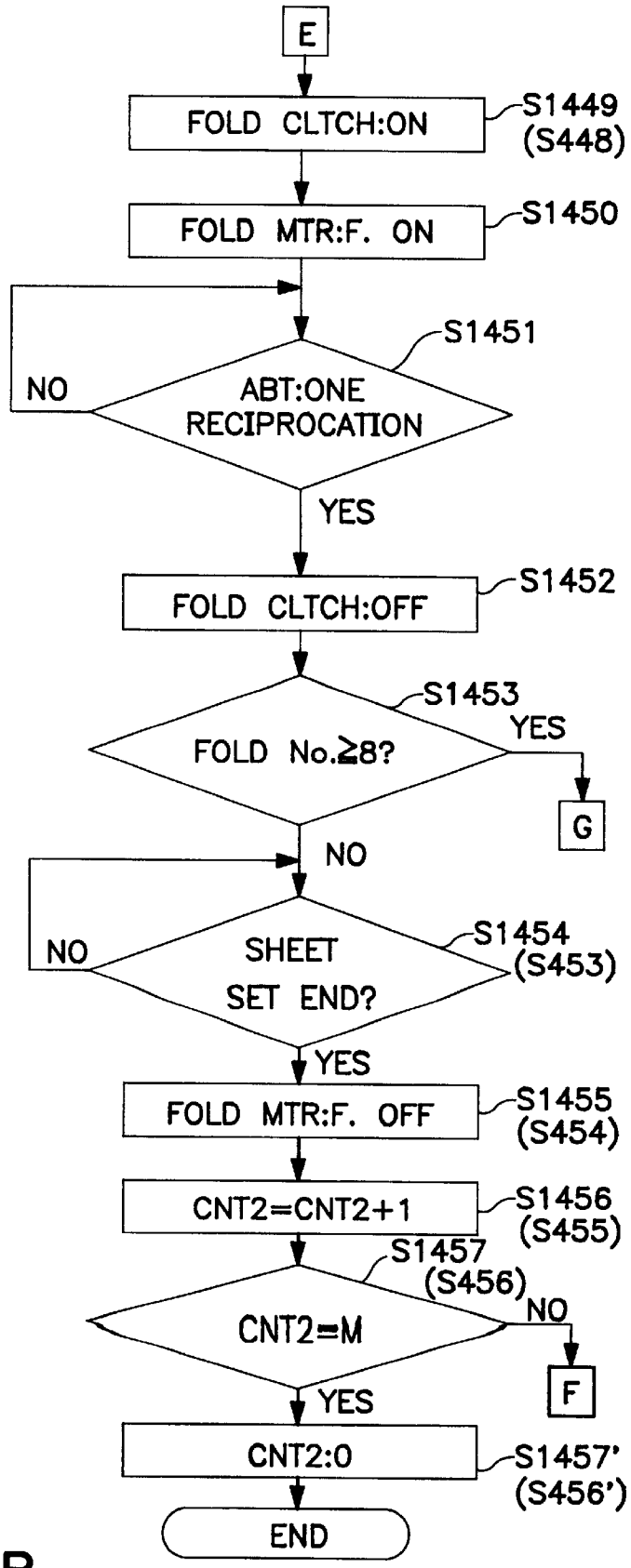
Figure 25:
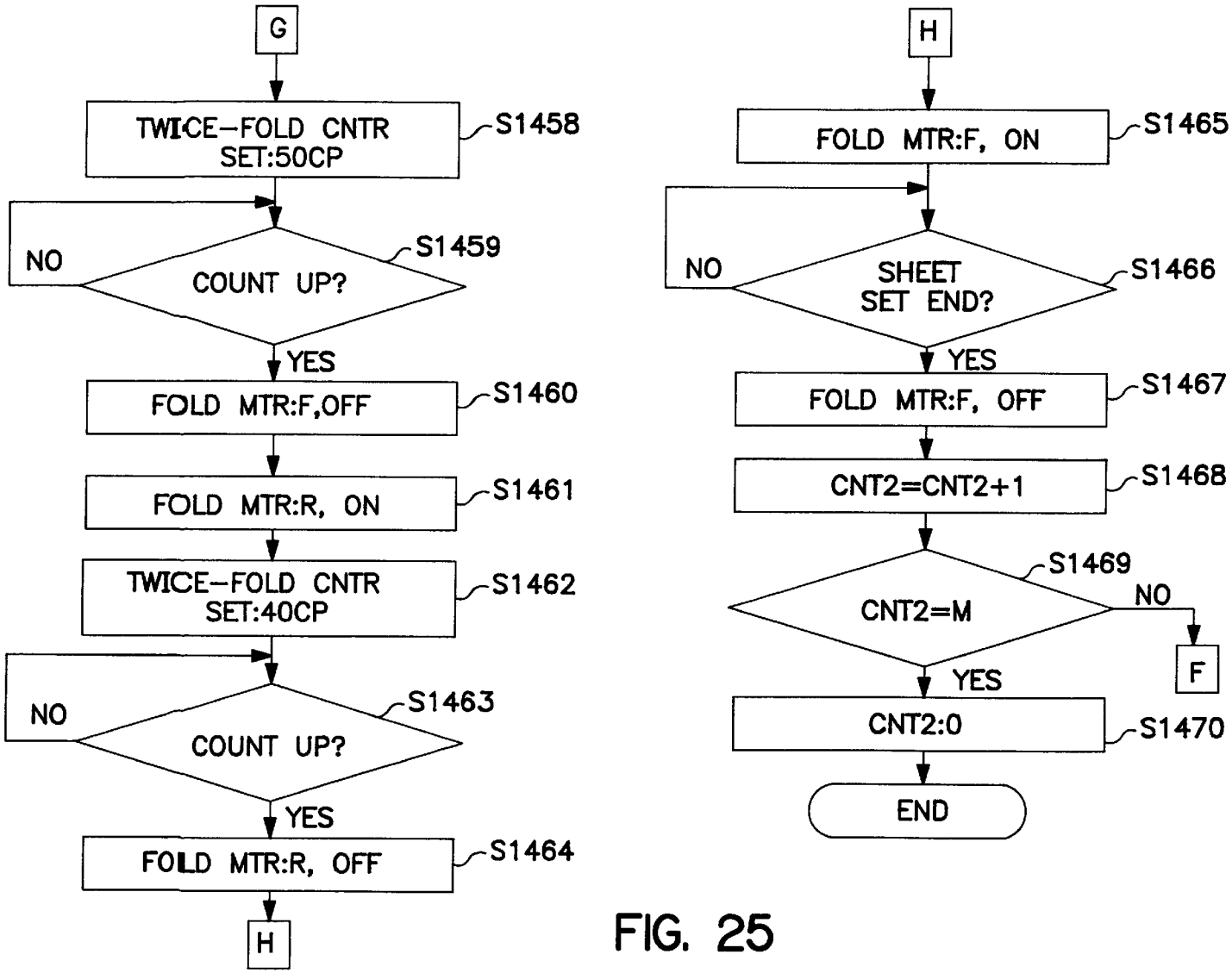
FIG. 25 is also a flowchart for the fourth embodiment of the present invention.

Referring to FIGS. 24 and 25, the binding mode sequence in the fourth embodiment will be described.

Since the basic operational sequence is the same as the sequence S401–S427 described above, the related drawings and descriptions will be omitted. Also, an operational sequence S1428–S1430 is the same as the sequence S428–S430; an operational sequence S1432–S1449 is the same as the operational sequence S431–S448; and an operational sequence S1454–S1457' is the same as the operational sequence S453–S456'.

The characteristic of this embodiment is that when the sheet count data indicates only one sheet, the binding operation is not carried out.

More specifically, a decision is made in S1431 as to whether the sheet data indicates a single sheet or a plurality of sheets. When the sheet data indicates a plurality of sheets, the operation advances to S1432, in which a stapling operation is carried out, but when the sheet data indicates a single sheet, a stapling operation is not carried out (control is executed to prohibit stapling), and the operation goes to S1438 to carry out a folding operation.

When a stapling operation is not carried out, the sheet positioning member 23 is moved to a sheet folding position, that is, the predetermined second position, so that the center portion of a set of sheets, at which the set of sheets is to be folded in half, is aligned with the folding rollers 26 and 27.

When the sheet count in the sheet counting means CNT 1 is a binding-possible count, the sheet positioning member 23 is moved to the predetermined first position so that an edge portion of a set of sheets is appropriately positioned for the aforementioned stapling unit 18.

When the sheet count is a binding-impossible count, the binding by the binding means is prohibited, and at the same time, the sheet positioning member 23 is moved to the predetermined second position so that the center portion of a set of sheets, at which the set of sheets is to be folded in half, is properly positioned for the folding rollers 26 and 27.

When in an folding operation, the pusher (folding) clutch 74*a* is turned on (S1449), and the folding motor 64 is turned on (S1450).

As the pusher (folding) clutch 74*a* is turned on, the pusher plate 25*a* begins to push the set of sheets to guide it to the folding rollers 26 and 27.

The folding clutch 74*a* is kept on until the completion of a single round trip by the pusher plate 25*a* is detected by the pusher plate home position detection sensor 83 (S1451).

As soon as the completion of the single round trip by the pusher plate 25*a* is detected by the pusher plate home position detection sensor 83, the pusher (folding) clutch 74*a* is turned off (S1452).

Then, a decision is made in S1453 as to whether or not the sheet count value is no less than eight. When it is no more than eight, the operation goes to S1454, in which the folding motor 64 is turned on and kept on until the trailing end of a set of sheets is detected by the sheet discharge sensor 29 (S1454).

However, when it is determined in S1453 that the data from the sheet counter indicates the number of sheets to be folded is no less than eight, a twice-fold counter is set in S1458 (FIG. 25), and the twice-fold counter counts up to the set value (S1459). In this embodiment, the twice-fold counter is set to 50 cp, but the numerical value does not need to be limited to 50 cp as long as it is such a value that allows the leading end of a set of sheets to be nipped between the pair of folding rollers 26 and 27 and project slightly from the other end of the nip after the fold motor 64 begins its action. Also in this embodiment, the distance a set of sheets is conveyed is measured by a pulse counting means, by a timer may be employed.

As soon as the twice-fold counter counts up to the set value, the operation goes to S1460, in which the forward rotation of the fold motor 64 is stopped. Then, the reverse rotation of the fold motor 64 is started in S1461, and the twice-fold counter is set to 40 cp in S1462. Even though the counter is set to 40 cp in this embodiment, this value merely exemplifies a distance a set of sheets is to be conveyed backward by the reverse rotation of the fold motor 64 after it is conveyed forward by the forward rotation of the fold motor 64; the numerical value to which the twice-fold counter is set is not limited to 40 pc. Also in this embodiment, the distance a set of sheets is conveyed backward is measured by a pulse counting means, but a timer may be employed.

A set of sheets is conveyed backward until the twice-fold counter counts up to the set value in S1463. As soon as the twice-fold counter finishes counting up, the operation advances to S1464, in which the fold motor 64 is turned off to stop its reverse rotation.

Then, the operation goes to S1465, in which the fold motor is turned on to be rotated forward. Next, the operation goes to S1466, in which the fold motor 64 is kept on until the trailing end of a set of sheets is detected by the sheet discharge sensor 29.

As soon as the trailing end of the set of sheets is detected by the sheet discharge sensor 29 in S1466, the fold motor 64 is turned off (S1467).

Then, one is added to the sheet set count value in the sheet set counter CNT 2 (S1468), and the operation proceeds to S469. When it is determined in S1469 that the sheet set count has not reached a preset sheet set count M, the operation returns to S401 (FIG. 15), but when it is determined that the sheet set count has reached the preset sheet set count M, the operation goes to S1470, in which the sheet set counter CNT 2 is cleared, and the operation is ended.

Since the stapling operation is controlled according to sheet count as described above, the sheet set folding operation can be more effectively controlled.

In this embodiment, when the sheet count is one, the stapling operation by the stapler 18 is prohibited, and also when the sheet count obtained by the sheet counting means CNT 1 exceeds a binding-possible count for the stapler 18, the sheet positioning member 23 is moved to the predetermined second position to prohibit the binding operation of the stapler 18.

As described above, according to the fourth embodiment of the present invention, the number of sheets held by the first sheet holding means is counted by the sheet counting means, and the binding operation of the binding means is controlled in response to the output signal of the sheet counting means. For example, when condition is not right for sheet binding, a sheet (set of sheets) is discharged without being bound. Therefore, the apparatus reliability can be improved.

Also, the first sheet holding means is moved to the predetermined second position by the first sheet holding means moving means in response to the output signal of the sheet counting means, to prohibit the binding operation of the binding means. For example, when the sheet count is one, or when the sheet count exceeds the binding-possible count for the binding means, a sheet or a set of sheets can be discharged without being bound. Therefore, it is possible to finish a set of sheets as a bound set of sheets with desirable appearance, and also it is possible to improve the apparatus reliability.

Further, when the sheet count is a binding-impossible count, a set of sheets is not moved to the sheet set binding position. Therefore, waste in moving the set of sheets to the sheet set binding position is eliminated.

EMBODIMENT 5

Figure 26A:
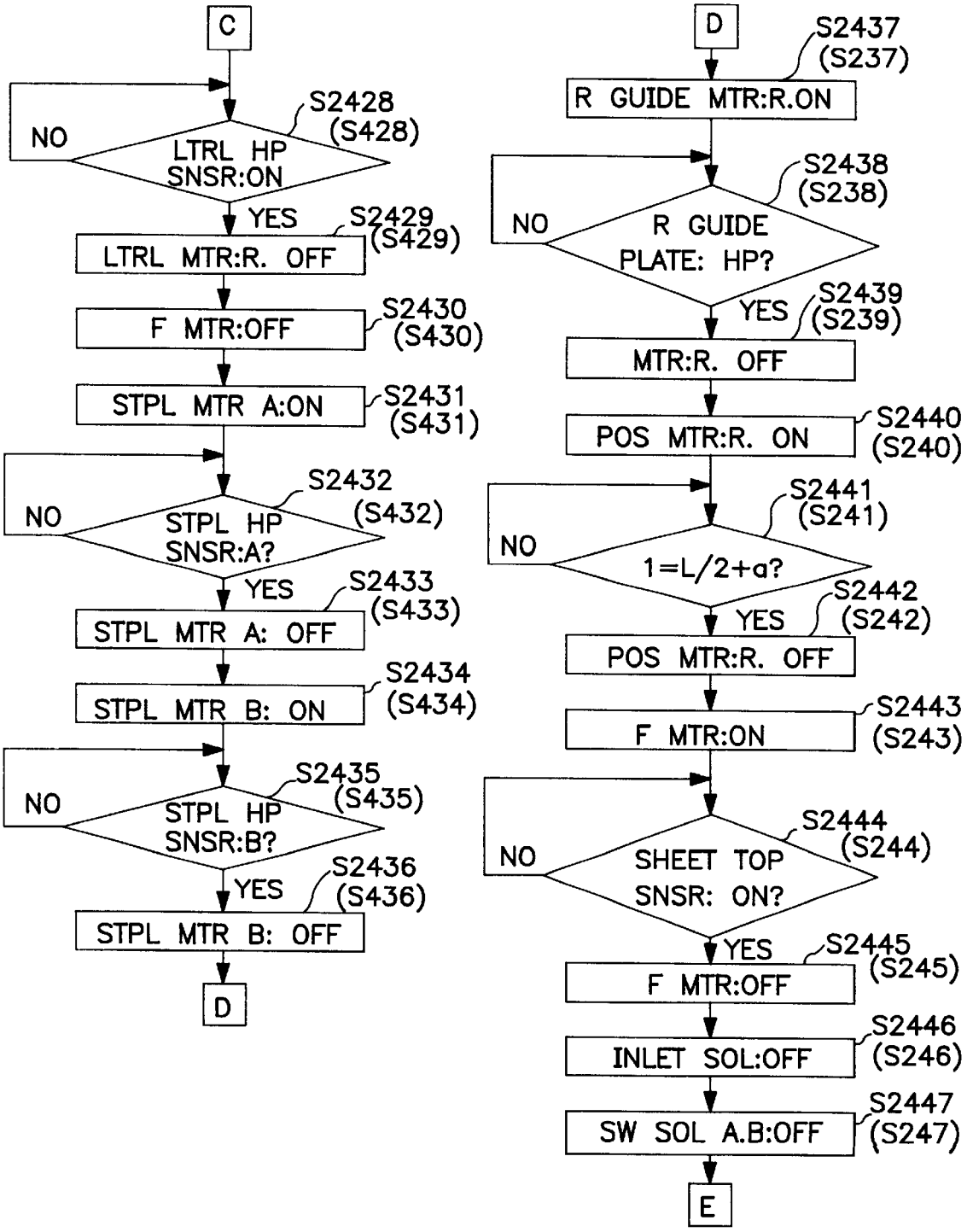
FIGS. 26*a* and 26*b* are flowcharts for the fifth embodiment of the present invention.
Figure 26B:
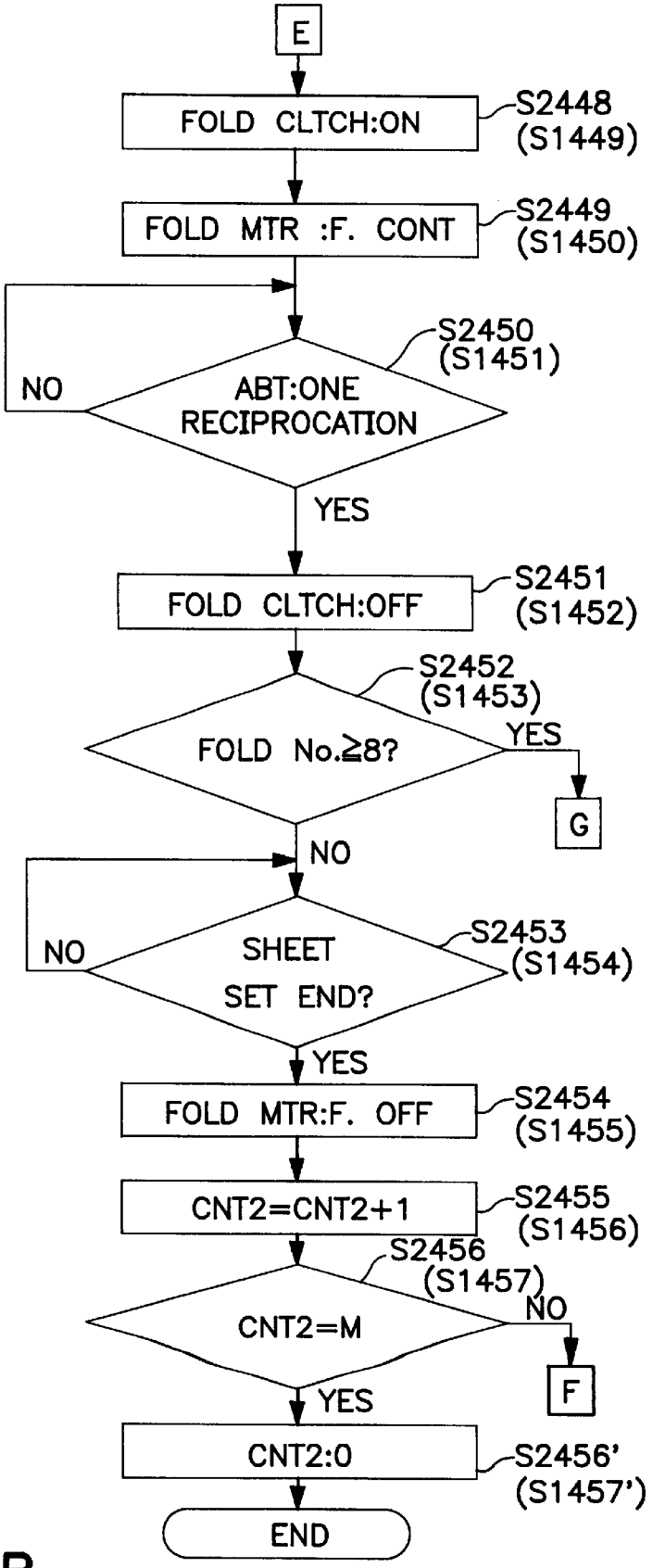
Figure 27:
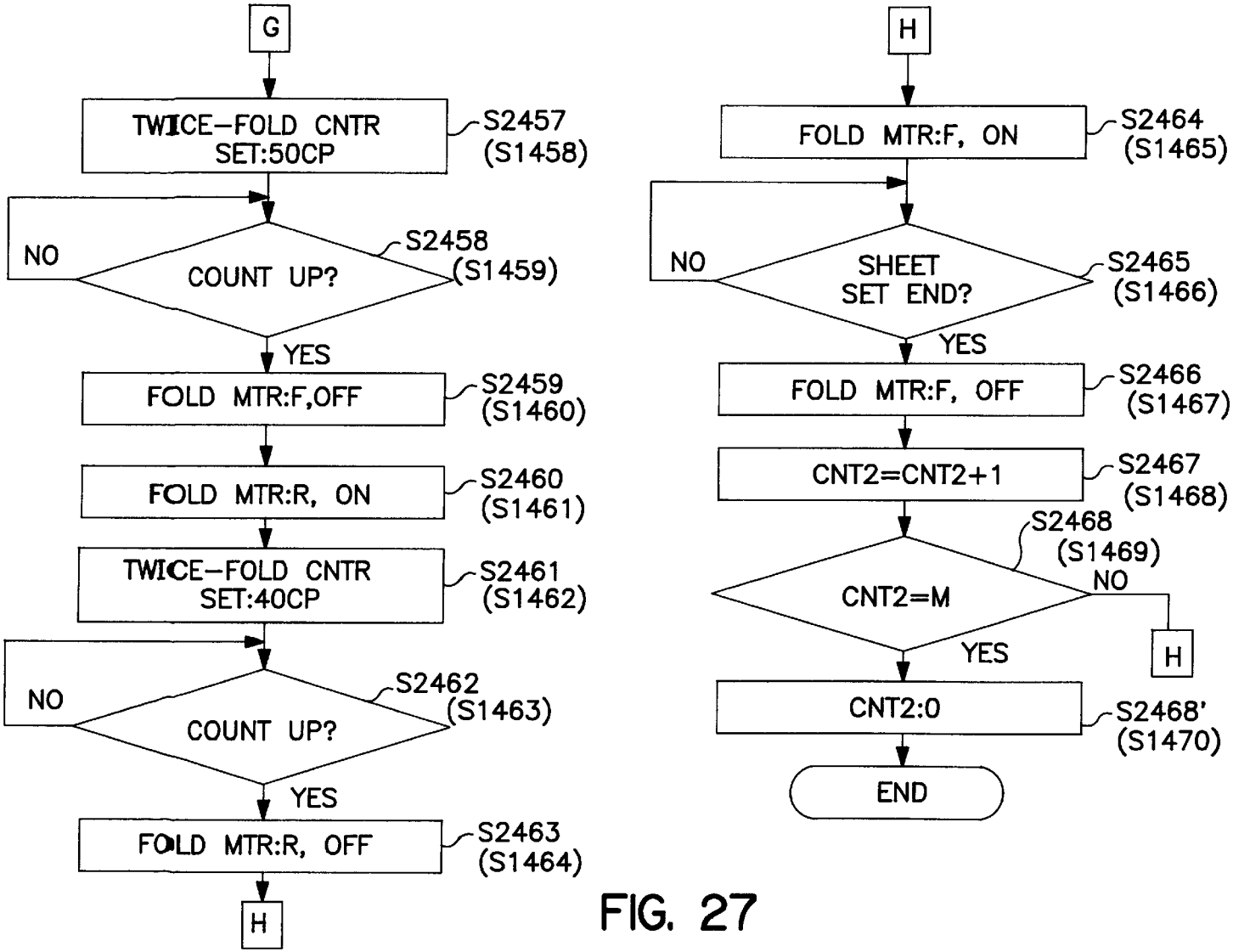
FIG. 27 is also a flowchart for the fifth embodiment of the present invention.

Referring to FIGS. 26 and 27, the binding mode operation sequence will be described.

Since the basic operation sequence is the same as the operation sequence S401–S427 in the first embodiment, the drawings and descriptions concerning the basic operational sequence are omitted. Further, a sequence S2428–S2447 is the same as the sequence S428–S447, and a sequence S2448–S2468' is the same as the sequence S1449–S1470.

The characteristic of this fifth embodiment is that when the number of sheets to be folded is large, a set of sheets is folded twice at the same fold line.

In this embodiment, the twice-fold mode operation is carried out through a sequence S2452–S2468', but its description is omitted since it is the same as the above description for the sequence S1453–S1470.

In other words, the folding rollers 26 and 27 is controlled by the controlling means (FIG. 9) so that its operational mode is switched between a first mode in which a set of sheet is folded only once, and a second mode in which a set of sheet is folded twice at the same fold line, in response to the output signal of the sheet counting means CNT 1.

Since a set of sheets is folded twice at the same fold line by switchbacking the set of sheets in response to the sheet count as described above, a set of sheet can be finished as a bound set of sheets with desirable appearance. In this embodiment, the threshold sheet count between two folding modes is eight, but it does not need to be limited to eight; it is optional.

EMBODIMENT 6

Figure 28A:
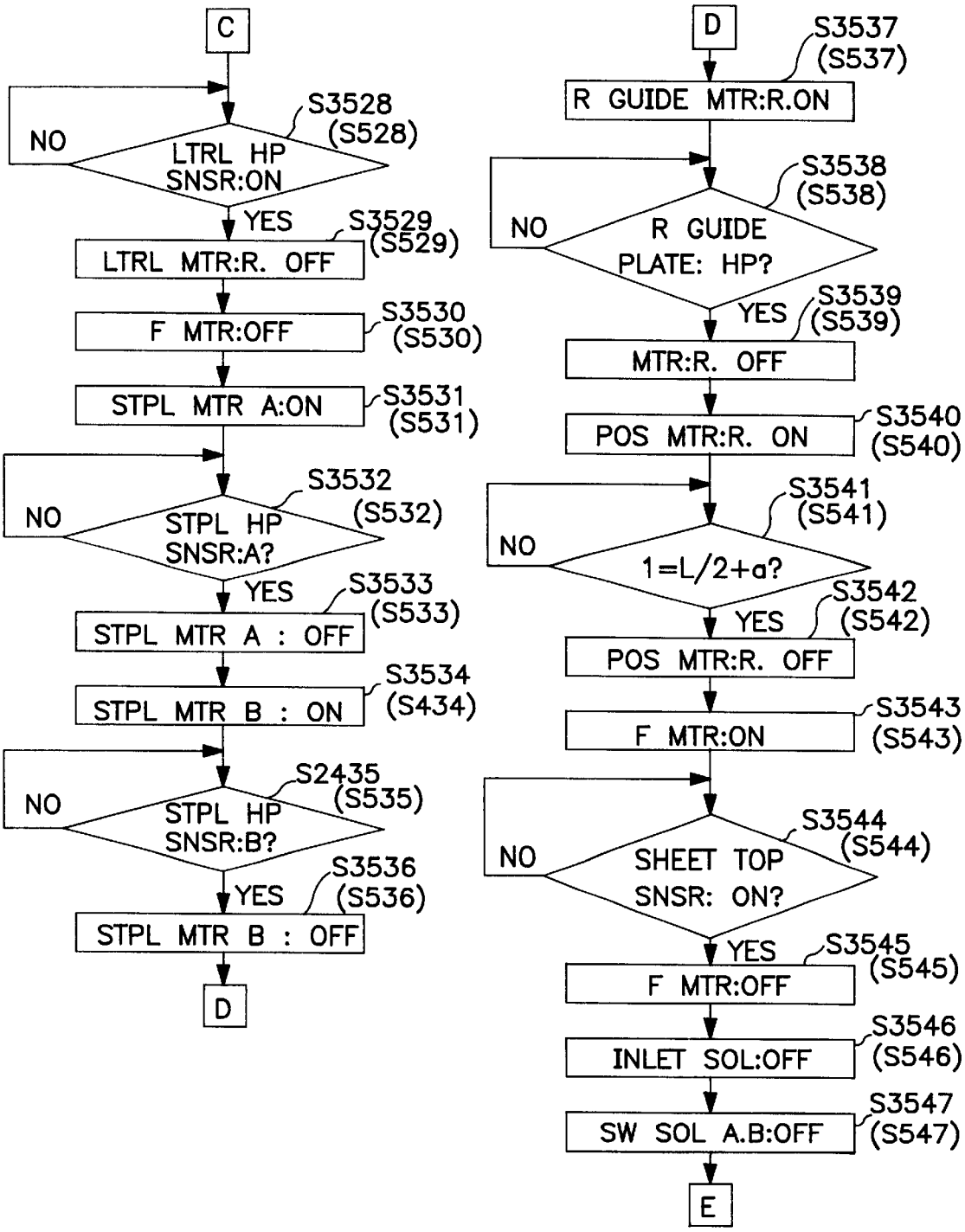
FIGS. 28*a* and 28*b* are flowcharts for the sixth embodiment of the present invention.
Figure 28B:
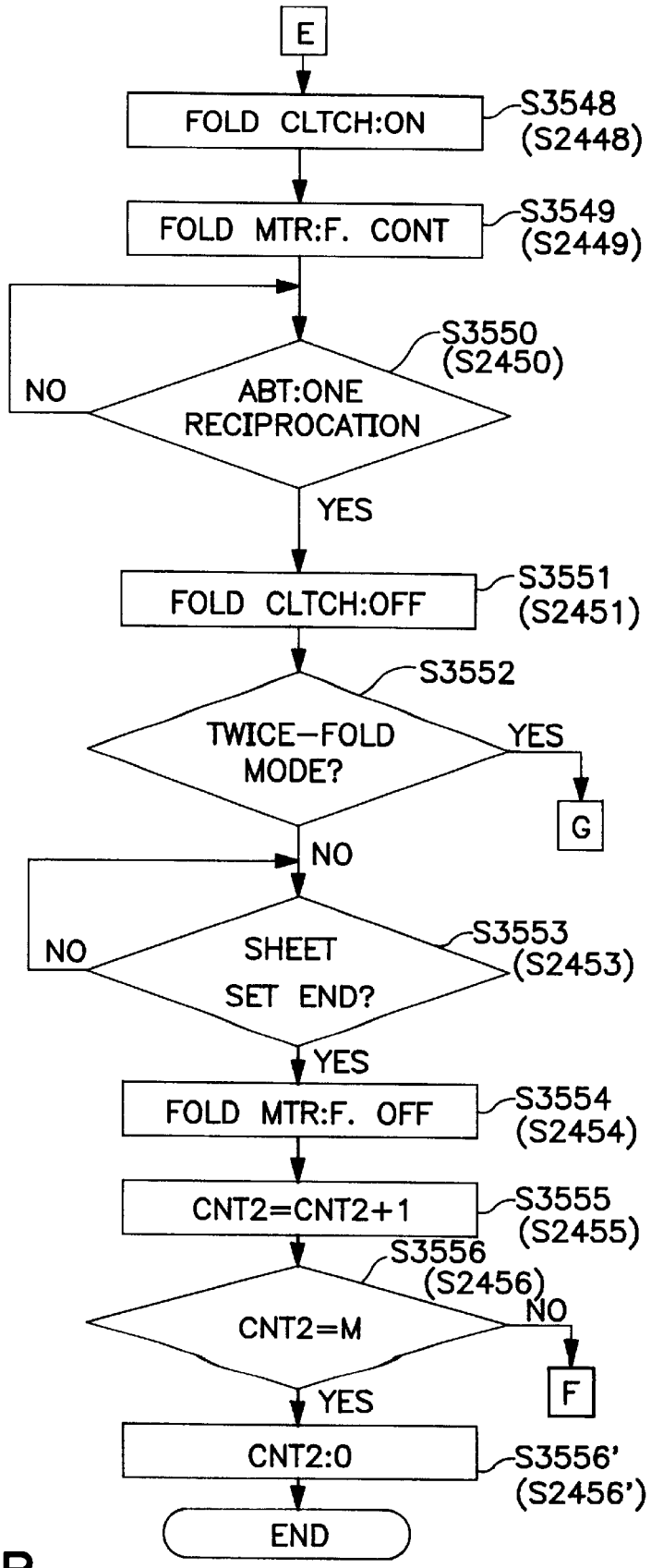
Figure 29:
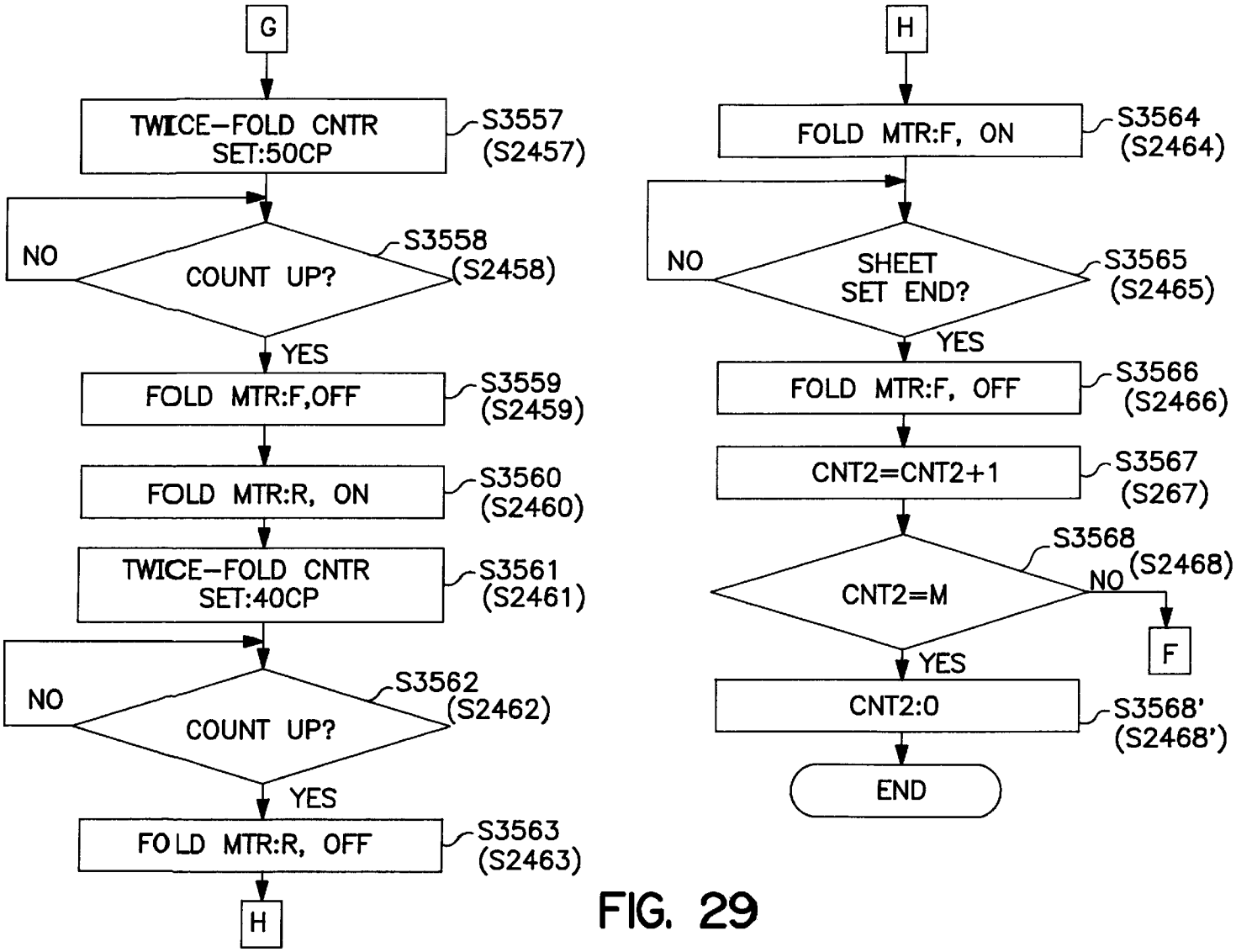
FIG. 29 is also a flowchart for the sixth embodiment of the present invention.

Referring to FIGS. 28 and 29, the operational mode sequence in sixth embodiment will be described.

The characteristic of this embodiment is that the decision regarding whether or not a set of sheets is to be folded twice at the same fold line is made according to mode selection.

In other words, when it is determined in S3552 that the twice-fold mode (second mode) has not been selected by the twice-fold mode selecting means 223, the twice-fold counter is set in S3557 (FIG. 29), and the operation goes to S2558, in which the twice-fold counter counts up to the set value.

That is, control is executed in such a manner that the fold rollers 26 and 27 operate in the first folding mode, that is, a single pass fold mode, or in the second folding mode, that is, the twice-fold mode, in response to the output signal of the fold mode selecting means 223 through which a mode selected by a user is inputted.

Since a set of sheets is folded twice at the same fold line by switchbacking the set of sheets in response to the output signal of the twice-fold mode selecting means 223, the set of sheets can be finished as a bound set of sheets with superior appearance.

EMBODIMENT 7

Figure 30A:
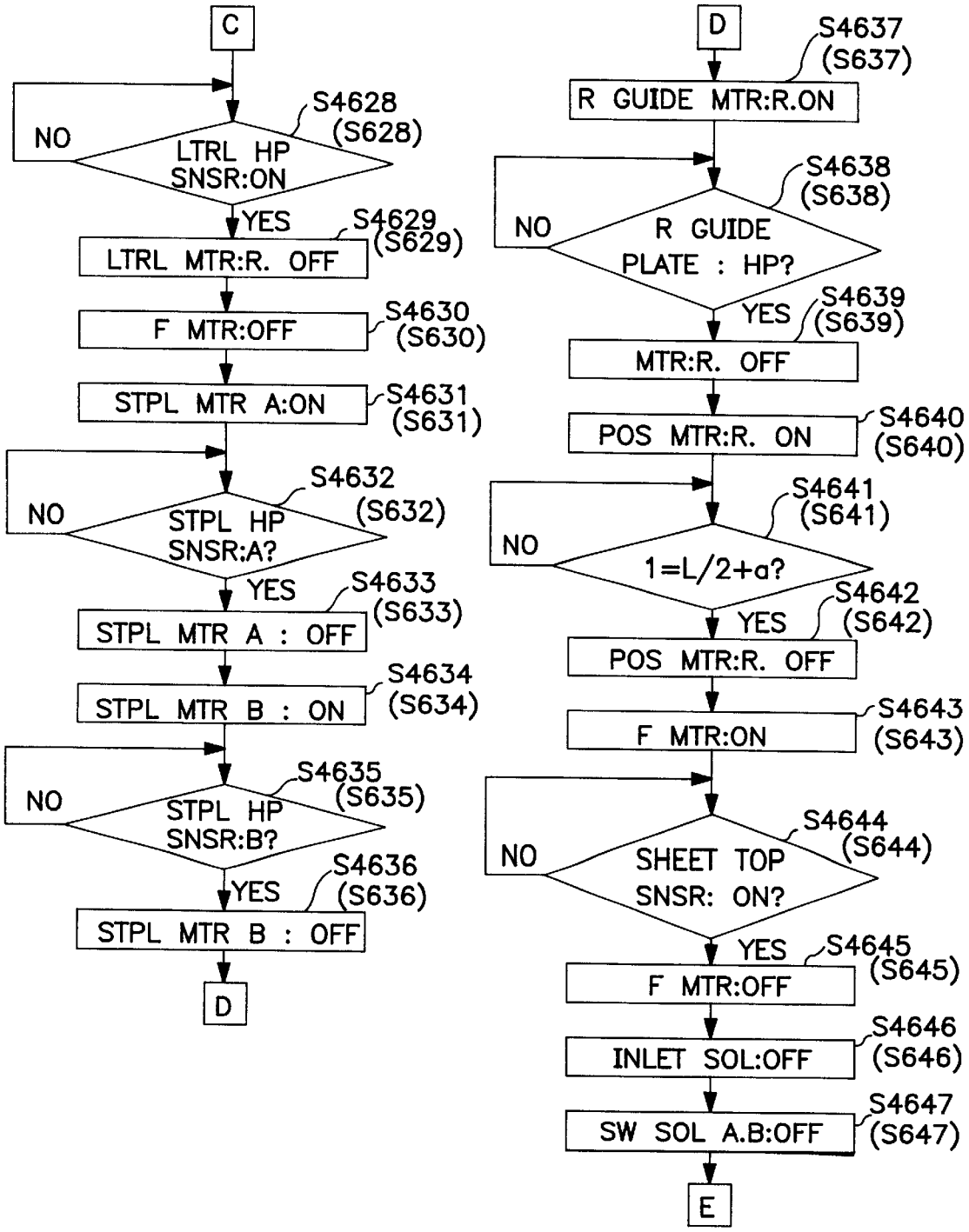
FIGS. 30*a* and 30*b* are flowcharts for the seventh embodiment of the present invention.
Figure 30B:
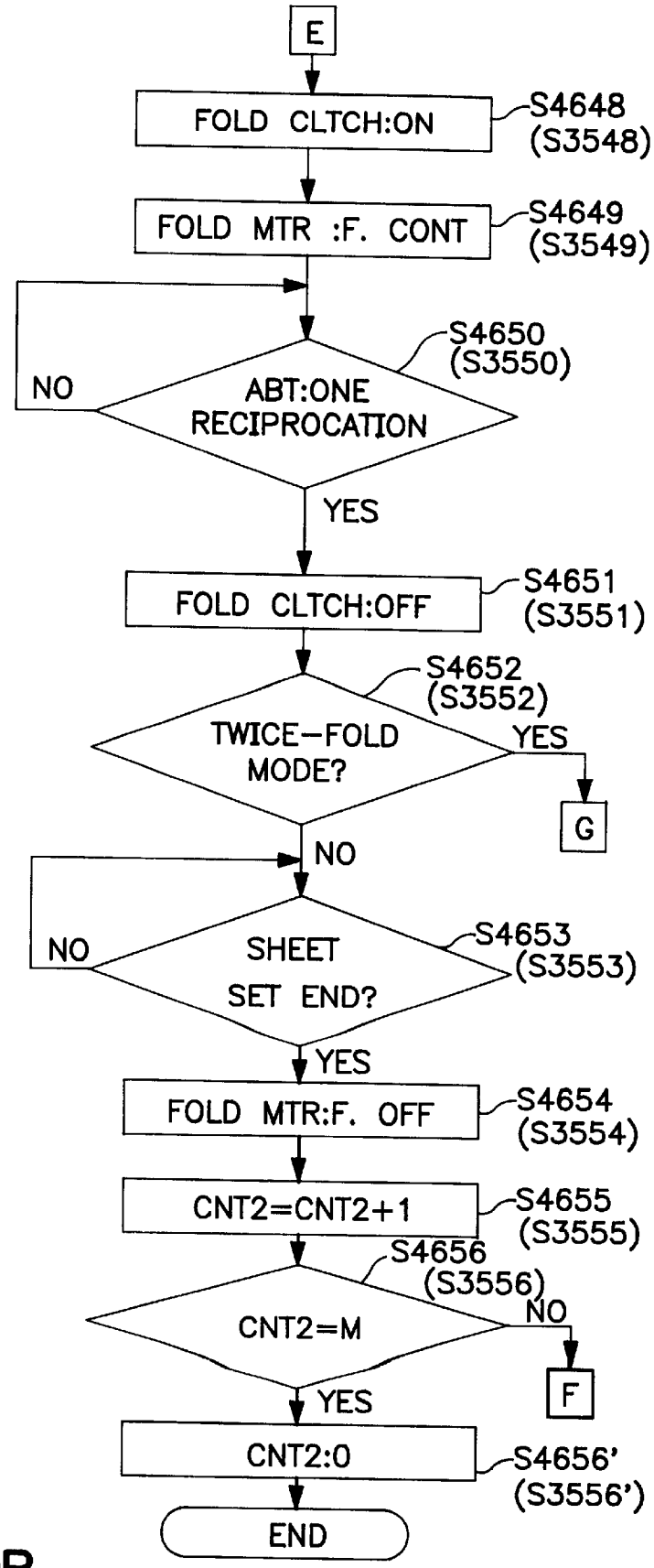
Figure 31:
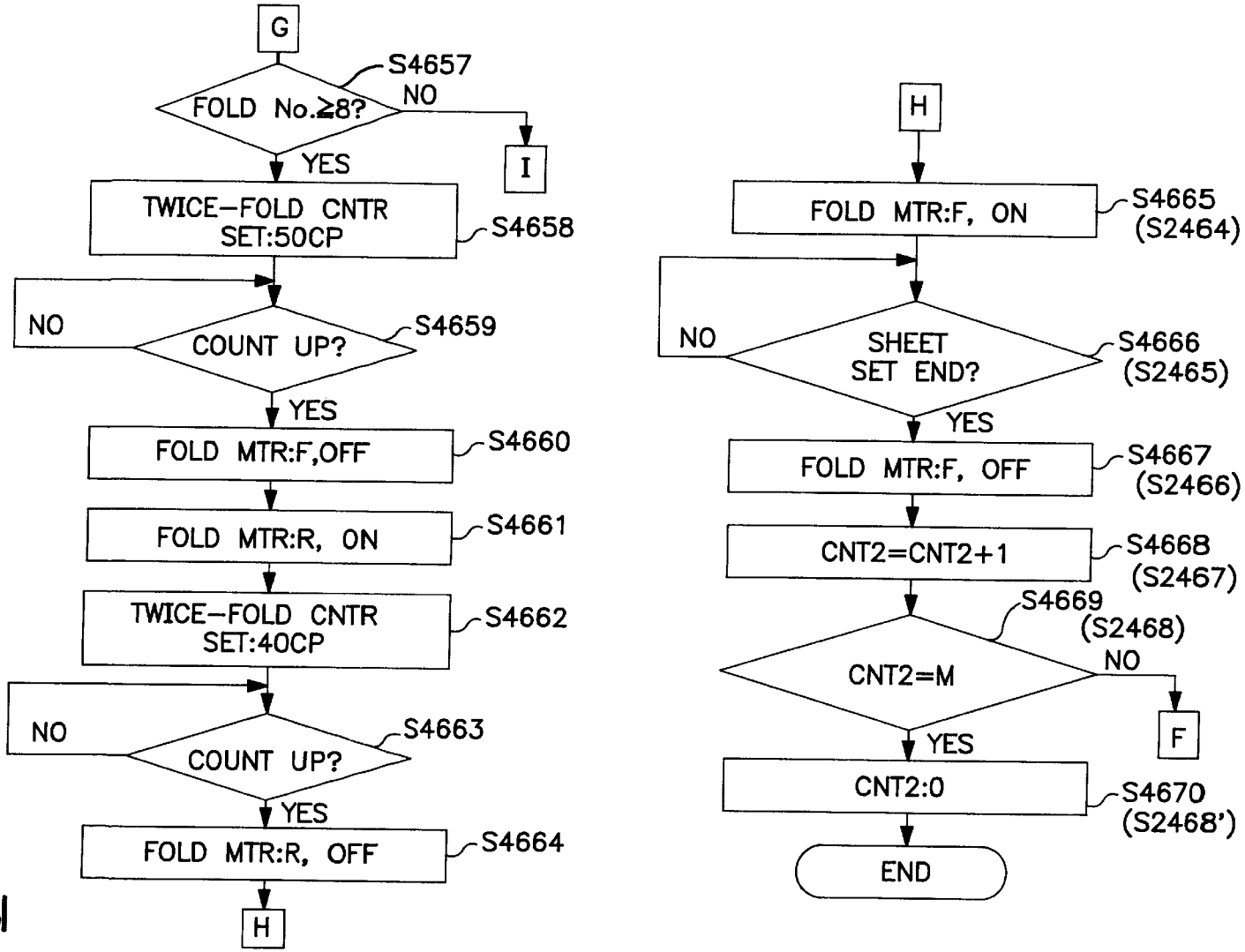
FIG. 31 is also a flowchart for the seventh embodiment of the present invention.

Referring to FIGS. 30 and 31, the operational mode in the seventh embodiment will be described.

This embodiment is characterized in that the twice-fold mode can be optionally selected by the user, but when the sheet count is no more than a predetermined count, the selected mode is cancelled.

More specifically, when it is determined in S4652 that the twice-fold mode (second mode) has not been selected by the twice-fold mode selecting means 223, the operation goes to S4653, in which the fold motor 64 is kept on until the trailing end of a set of sheets is detected by the sheet discharge sensor 29 (S4658).

However, when it is determined in S4652 that the twice-fold mode has been selected by the twice-fold mode selecting means, the operation advances to S4657 (FIG. 31), in which a decision is made as to whether the sheet count data indicates no less than eight sheets. When the sheet count data indicates no less than eight sheets, the operation goes to S4658, in which the twice-fold counter is set, and then, goes to S4659, in which the twice-fold counter counts up to the set value.

Further, even when it is determined that the twice-fold mode has been selected by the twice-fold mode selecting means, the twice-fold mode is canceled if the sheet count data indicates that the number of sheets to be folded is no more than eight. Thereafter, the operation returns to S4653, in which control is executed to carry out the single-pass-fold mode (first mode). In this embodiment, the threshold count between the first and second modes is eight, but is does not need to be limited to eight; it is optional.

Since the folding apparatus is controlled in such a manner that the fold mold of the fold rollers 26 and 27 as the sheet conveyance means is switched between the two modes in response to the output signal of the twice-fold mode selecting means, and the sheet count data of the sheet counting means CNT 1, binding time is shortened, and also a set of sheets can be finished as a bound set of sheets with superior appearance.

Further, the embodiments 4 through 7 may be combined with the embodiments 1 through 3.

As described above, according to the fifth embodiment of the present invention, the number of sheets to be held in the first sheet holding means is counted by the sheet counting means, and the sheet conveying means is controlled in response to the output signal of the sheet counting means. For example, a set of sheets can be folded either once, or twice at the same fold line, depending on the sheet count of a set of sheets. Further, the sheet conveyance speed of the sheet conveying means can be adjusted to match the sheet count. Therefore, binding time can be reduced, and also a set of sheets can be finished as a bound set of sheets with superior appearance.

Further, according to the sixth embodiment of the present invention, it is rendered possible to select the first or second sheet conveyance mode for the sheet conveying means, through the fold mode selecting means; therefore, a set of sheets can be optionally folded twice at the same fold line according to user's wish.

Further according to the seventh embodiment of the present invention, even after the twice-fold mode is selected by the folding operation mode selecting means, the twice-fold mode is cancelled in response to the output signal of the sheet counting means. For example, when the sheet count of a set of sheets is relatively small, the set of sheets is folded only once to reduce binding time, and also to finish the set of sheets as a bound set of sheets with superior appearance.

While the invention has been described with reference to the structures disclosed herein, it is not confined to the details set forth, and this application is intended to cover such modifications or changes as may come within the purposes of the improvements or the scope of the following claims.

What is claimed is:

1. A sheet folding apparatus wherein a set of sheets is fed by a pair of rotatable members, and is folded by nip force between the rotatable members, the improvement residing in that:

a control means for changing a feeding speed of the sheet set by the rotatable member in accordance with a thickness of the sheet set.

2. An apparatus according to claim 1, wherein the thickness of the sheet set is determined by the number of the sheets in the sheet set.

3. An apparatus according to claim 2, further comprising a sheet number counting means for counting number of the sheets in the sheet set.

4. An apparatus according to claim 3, wherein the feeding speed decreases with an increase of the number of the sheets in the sheet set.

5. An apparatus according to claim 4, further comprising sheet accommodating means for accommodating the sheet set to be folded, and a pre-folding means for acting on the sheet set accommodated in the sheet accommodating means to pre-fold the sheet set, and for feeding a pre-folded portion into the nip between the rotatable members.

6. An apparatus according to claim 5, further comprising binding means for binding the set of sheets in said sheet accommodating means.

7. An apparatus according to claim 1, wherein the feeding speed of the sheet set by the rotatable members is increased when a predetermined period elapses from start of feeding of the sheet set by the rotatable members.

8. An apparatus according to claim 1, wherein the rotatable member is rotated forwardly and backwardly to apply folding force to the sheet set a plurality of times.

9. An apparatus according to claim 8, wherein the forward and backward rotations of said rotatable member are executed when the number of the sheets in the set is not less than a predetermined number.

10. An apparatus according to claim 8, wherein the forward and backward rotations of said rotatable member are executed depending on a selected operational mode.

11. An apparatus according to claim 10, wherein the forward and backward rotations of said rotatable member are not executed even if the selected mode requires them, if the number of the sheets is smaller than a predetermined number.

12. A sheet folding apparatus wherein a set of sheets is fed by a pair of rotatable members, and is folded by nip force between the rotatable members, the improvement residing in that:

a control means for controlling the rotatable members so as to be rotatable forwardly and backwardly to apply folding force to the sheet set a plurality of times in accordance with a thickness of the sheet set.

13. An apparatus according to claim 12, wherein the forward and backward rotations of said rotatable member are executed when the number of the sheets in the set is not less than a predetermined number.

14. An apparatus according to claim 12, wherein the forward and backward rotations of said rotatable member are executed depending on a selected operational mode.

15. An apparatus according to claim 14, wherein the forward and backward rotations of said rotatable member are not executed even if the selected mode requires them, if the number of the sheets is smaller than a predetermined number.

16. An apparatus according to claim 12, further comprising sheet accommodating means for accommodating the sheet set to be folded, and a pre-folding means for acting on the sheet set accommodated in the sheet accommodating means to pre-fold the sheet set, and for feeding a pre-folded portion into the nip between the rotatable members.

17. An apparatus according to claim 16, further comprising binding means for binding the set of sheets in said sheet accommodating means.

18. A sheet folding apparatus comprising:

sheet feeding means for feeding sheets;

a first sheet accommodating means for temporarily accommodating the sheets fed one by one by said sheet feeding means;

sheet number counting means for counting the number of the sheets accommodated in the sheet accommodating means;

folding means for half-folding the sheet set substantially at a center portion of the sheet set accommodated in the first sheet accommodating means;

sheet set feeding rotating means for nipping and feeding the folded sheet set;

control means for changing a speed of the sheet set feeding rotating means on the basis of an output signal of the sheet number counting means;

a second sheet accommodating means for accommodating the folded sheet set.

19. An apparatus according to claim 18, wherein when the number of the sheets counted by the sheet number counting means is not more than two, the sheet set feeding speed of the sheet set feeding means is set at a predetermined normal speed, and when the number is not less than three, the feeding speed of the sheet set feeding means, is changed to a first speed which is lower than the normal speed.

20. An apparatus according to claim 19, wherein the first speed is variable depending on the number of the sheets.

21. An apparatus according to claim 19, further comprising sheet set movement distance measuring means for measuring a movement distance of the sheet set by the sheet set feeding rotating means, and when said measuring means measures a predetermined distance, the feeding speed of the sheet set feeding rotating means is changed to a second speed which is higher than the first speed.

22. An image forming apparatus comprising a sheet folding apparatus as defined in any one of claims 18 to 21, an image forming station for forming images on the sheets, and discharging means for discharging the sheet on which the image has been formed by said image forming station to the sheet folding apparatus.

23. A sheet folding apparatus comprising:

sheet feeding means for feeding sheets;

sheet accommodating means for temporarily accommodating the sheets fed one by one by said sheet feeding means;

sheet number counting means for counting number of the sheets accommodated in the sheet accommodating means;

binding means for binding the sheets accommodated in said sheet accommodating means;

folding means for half-folding the sheet set substantially at a center portion of the sheet set accommodated in the sheet accommodating means;

sheet accommodation moving means for moving a sheet accommodating position of the sheet accommodating means relative to said binding means;

control means for controlling the sheet accommodation moving means to move the sheet accommodating position, in accordance with an output signal of the sheet count means, to a first predetermined position where a predetermined position of the sheet set corresponds to said binding means or to a second predetermined position where substantially a central portion of the sheet set corresponds to the sheet folding.

24. An apparatus according to claim 23, wherein said control means controls the sheet accommodation moving means to move said sheet accommodation moving means to said second predetermined position and controls said binding means to prevent operation of said binding means, in accordance with the output signal of the sheet count means.

25. An apparatus according to claim 24, wherein when a count of said sheet count means is 1, the binding means is prevented to operate.

26. An apparatus according to claim 24, wherein when a count of said counter means is larger than a bindable number of said binding means, the binding operation of said binding means is prevented.

27. An image forming apparatus comprising a sheet folding apparatus as defined in any one of claims 23 to 26, an image forming station for forming images on the sheets, and discharging means for discharging the sheet on which the image has been formed by cold image forming station to the sheet folding apparatus.

28. A sheet forming apparatus, comprising:

sheet feeding means for feeding sheets;

sheet accommodating means for temporarily accommodating the sheets fed one by one by said sheet feeding means;

folding means for half-folding the sheet set substantially at a center portion of the sheet set accommodated in the sheet accommodating means;

sheet set feeding rotating means for nipping and feeding the folded sheet set; and control means for controlling a rotational direction of the sheet set feeding rotating means according to one of a first mode and a second mode, wherein the number of folds differs for each mode.

29. An apparatus according to claim 28, wherein the control means rotates said sheet set feeding rotating means in forward and backward directions on the basis of a mode selection between a first mode wherein the sheet set is folded once and a second mode wherein the sheet set is folded twice.

30. An apparatus according to claim 28, wherein said control means effects a control as if the first mode is selected even if the second mode is selected, if the number of the sheets is not more than a predetermined number.

31. An apparatus according to claim 29, wherein either the first mode or the second mode is selected automatically in accordance with number of the sheets in the sheet set.

32. An image forming apparatus comprising a sheet folding apparatus as defined in any one of claims 28 to 31, an image forming station for forming images on the sheets, and discharging means for discharging the sheet on which the image has been formed by said image forming station to the sheet folding apparatus.

* * * * *

UNITED STATES PATENT AND TRADEMARK OFFICE

CERTIFICATE OF CORRECTION

PATENT NO. : 6,003,853

DATED : December 21, 1999

INVENTOR(S) : NORIAKI NAKAZAWA ET AL.

It is certified that error appears in the above-identified patent and that said Letters Patent is hereby corrected as shown below:

COLUMN 4

Line 3, "flow chart" should read --flowchart--;
Line 17, "flow chart" should read --flowchart--; and
Line 19, "flow chart" should read --flowchart--.

COLUMN 5

Line 52, "forms" should read --form--.

COLUMN 9

Line 20, "axle" should read --axles--;
Line 57, "axis" should read --axle--;
Line 59, "axis" (both occurrences) should read --axle--; and
Line 60, "axis" should read --axle--.

COLUMN 10

Line 23, "conveys" should read --convey--.

UNITED STATES PATENT AND TRADEMARK OFFICE

CERTIFICATE OF CORRECTION

PATENT NO. : 6,003,853

DATED : December 21, 1999

INVENTOR(S) : NORIAKI NAKAZAWA ET AL.

It is certified that error appears in the above-identified patent and that said Letters Patent is hereby corrected as shown below:

COLUMN 12
Line 2, "solenoid" should read --solenoids--;

COLUMN 13
Line 49, "hits" should read --contacts--.

COLUMN 14
Line 21, "pile" should read --stack--; and
Line 24, "(k2±n)" should read --(k2+D)--.

COLUMN 15
Line 30, "(S456)." should read --(S458).--.

COLUMN 16
Line 66, "set" should read --set of--.

UNITED STATES PATENT AND TRADEMARK OFFICE

CERTIFICATE OF CORRECTION

PATENT NO. : 6,003,853

DATED : December 21, 1999

INVENTOR(S) : NORIAKI NAKAZAWA ET AL.

It is certified that error appears in the above-identified patent and that said Letters Patent is hereby corrected as shown below:

COLUMN 17

Line 57, "S S627" should read --S627--; and

Line 63, "if" should read --is--.

COLUMN 18

Line 11, "or' should read --of--.

COLUMN 19

Line 15, "an" should read --a--.

COLUMN 21

Line 3, "is" should read --are--;

Line 6, "sheet" should read --sheets--;

Line 7, "sheet" should read --sheets--; and

Line 11, "sheet" should read --sheets--.

UNITED STATES PATENT AND TRADEMARK OFFICE

CERTIFICATE OF CORRECTION

PATENT NO. : 6,003,853

DATED : December 21, 1999

INVENTOR(S) : NORIAKI NAKAZAWA ET AL.

It is certified that error appears in the above-identified patent and that said Letters Patent is hereby corrected as shown below:

COLUMN 22

Line 7, "mold" should read --mode--; and

Line 61, "number" should read --the number--.

COLUMN 24

Line 5, "means;" should read --means; and--;

Line 35, "number" should read --the number--; and

Line 46, "means" should read --means; and--.

COLUMN 25

Line 5, "cold" should read --said--.

COLUMN 26

Line 13, "number" should read --the number--.

Signed and Sealed this

First Day of May, 2001

*Attest:*

Nicholas P. Godici

NICHOLAS P. GODICI

*Attesting Officer*

*Acting Director of the United States Patent and Trademark Office*